US010443988B2

(12) United States Patent
Macher

(10) Patent No.: US 10,443,988 B2
(45) Date of Patent: Oct. 15, 2019

(54) DART SCORING SYSTEM

(71) Applicant: DartConnect LLC, Boston, MA (US)

(72) Inventor: David Macher, Boston, MA (US)

(73) Assignee: DartConnect LLC, Boston, MA (US)

( * ) Notice: Subject to any disclaimer, the term of this patent is extended or adjusted under 35 U.S.C. 154(b) by 0 days.

(21) Appl. No.: 15/876,037

(22) Filed: Jan. 19, 2018

(65) Prior Publication Data

US 2018/0142995 A1 May 24, 2018

Related U.S. Application Data

(63) Continuation-in-part of application No. 14/832,366, filed on Aug. 21, 2015, now Pat. No. 9,989,337.

(60) Provisional application No. 62/040,299, filed on Aug. 21, 2014.

(51) Int. Cl.
*F41J 5/14* (2006.01)
*F41J 3/02* (2006.01)

(52) U.S. Cl.
CPC .. *F41J 5/14* (2013.01); *F41J 3/02* (2013.01)

(58) Field of Classification Search
None
See application file for complete search history.

(56) References Cited

U.S. PATENT DOCUMENTS 5,559,490 A 9/1996 McDonald et al.
5,857,912 A 1/1999 Freitag et al.
5,882,111 A 3/1999 Chen
9,989,337 B2 6/2018 Macher
2001/0053722 A1 12/2001 Miller
(Continued)

FOREIGN PATENT DOCUMENTS

DE 102004016775 A1 10/2005
EP 1473065 A2 11/2004
(Continued)

OTHER PUBLICATIONS

Gex-Collet, A., "Partial Supplementary European Search Report Re Application No. 15834019.0", dated Mar. 6, 2018, p. 7 Published in: EP.

(Continued)

*Primary Examiner* — Damon J Pierce
(74) *Attorney, Agent, or Firm* — Neugeboren O'Dowd PC

(57) ABSTRACT

A platform for facilitating a dart tournament allows gathering, at an electronic bracket program, a master tournament player list for the tournament, which includes the event or events in which each player is participating. The platform allows generating, at a cloud server application, a tournament record based on the master tournament player list. The platform allows sending of the master tournament player list and the tournament record to mobile computing devices executing an electronic dart scoring application. The platform allows scoring a plurality of matches of the tournament on the mobile computing devices executing the electronic dart scoring application. The platform allows automatically sending scores in substantially real-time from each of the plurality of matches upon their completion to the cloud server application and electronic bracket program via the one or more application program interfaces; and automatically advancing players at the electronic bracket program based on the sent scores.

22 Claims, 37 Drawing Sheets

(56) References Cited

U.S. PATENT DOCUMENTS

| | | | | |
|---|---|---|---|---|
| 2002/0193162 | A1* | 12/2002 | Walker | A63F 13/12 463/42 |
| 2003/0064782 | A1 | 4/2003 | Beaulieu et al. | |
| 2004/0121855 | A1 | 6/2004 | Giegerich | |
| 2005/0278041 | A1* | 12/2005 | Bortnik | A63F 13/12 700/91 |
| 2006/0189389 | A1* | 8/2006 | Hunter | G07F 17/32 463/42 |
| 2006/0247058 | A1 | 11/2006 | Kromer | |
| 2011/0109045 | A1 | 5/2011 | Su et al. | |
| 2012/0083342 | A1* | 4/2012 | Cross | F41J 3/0009 463/42 |
| 2012/0101604 | A1 | 4/2012 | Segal et al. | |
| 2012/0258788 | A1 | 10/2012 | Hong | |
| 2014/0038729 | A1 | 2/2014 | Borge | |
| 2014/0378195 | A1 | 12/2014 | Lee et al. | |
| 2015/0111642 | A1* | 4/2015 | Lawson | G07F 17/3276 463/31 |
| 2016/0054103 | A1 | 2/2016 | Macher | |
| 2016/0084618 | A1 | 3/2016 | Hong | |

FOREIGN PATENT DOCUMENTS

| | | | |
|---|---|---|---|
| GB | 2445123 | A | 6/2008 |
| KR | 100824354 | B1 | 4/2008 |

OTHER PUBLICATIONS

Pierce, Damon Joseph, "United States Office Action Re U.S. Appl. No. 14/832,866", dated May 3, 2017, p. 28 Published in: US.

Pierce, Damon Joseph, "United States Office Action Re U.S. Appl. No. 14/832,366", dated Oct. 17, 2017, p. 26 Published in: US.

Otero, Vanessa, "Response to United States Office Action Re U.S. Appl. No. 14/832,336", dated Aug. 3, 2017, p. 17 Published in: US.

Otero, Vanessa L., "Response to United States Office Action Re U.S. Appl. No. 14/832,366", dated Jan. 17, 2018, p. 19, Published in: US.

Wittmann-Regis, Agnes, "International Preliminary Report on Patentability Re Application No. PCT/US2015/046318", dated Mar. 2, 2017, p. 8 Published in: CH.

Young, Lee W., "International Search Report and Written Opinion re Application No. PCT/US15/46318", dated Jan. 14, 2016, p. 12 Published in: WO.

Favero, "Game-On Electonic Dart Scorer", Retrieved from https://www.favero.com/en2_darts_electronic_led_scoreboard_with_infrared_remote_control_for_darts_game-72-25.html, Oct. 14, 2008, p. 2.

Gex-Collet, A, "European Extended Search Report Regarding Application No. EP15834019", dated Jun. 18, 2018, p. 6 Published in: EP.

Young, Lee W., "International Search Report and Written Opinion Regarding International Application No. PCT/US2019/13837", dated Apr. 12, 2019, p. 8, Published in: WO.

Gex-Collet, A.L., "Office Action Regarding Application No. 15834019.0", dated May 9, 2019, p. 6, Published in: EP.

* cited by examiner

DCTV More Darts!

Player Performance

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

*Select Report:* Summary > Game Detail > Player Performance Match Counts > My DCA >

'01 Leaders

| | | |
|---|---|---|
| High Turn | 126 | David Macher |
| High DO | 2 | David Macher |
| | | David Macher |

High Points Per Round

| | | |
|---|---|---|
| High PPR (S) | 35 | David Macher |

Cricket Leaders

| | | |
|---|---|---|
| High Turn | 5M | David Macher x 2 |
| Bulls | 7 | David Macher |
| Triples | 5 | David Macher |

High Marks Per Round

| | | |
|---|---|---|
| High MPR (S) | 2.86 | David Macher |

| Players | Match | | | All '01 Games | | | All Cricket Games | | |
|---|---|---|---|---|---|---|---|---|---|
| | Games | Wins | Win % | Points | Darts | PPR | Marks | Darts | MPR |
| Jung Mike | 4 | 0 | 0% | 986 | 102 | 29.0 | 23 | 51 | 1.4 |
| Macher David | 4 | 4 | 100% | 1,002 | 102 | 29.5 | 45 | 51 | 2.6 |

*An email address is required for DartConnect to calculate, report and deliver player performance data. Membership is required for league statistics, select reporting features and trend analysis. Confirm your email address on the device that hosted this match & join DartConnect today!*

| Game | | Player | C | P-3DA | 3DA | PDC | T | WA | RD | CO | S9 | PR | DT | PT8 | MKS | 180 | HT | 9M |
|---|---|---|---|---|---|---|---|---|---|---|---|---|---|---|---|---|---|---|
| 1.1 | 501 SIDO | David Macher | | | 25.5 | 8.5 | 2 | W | 20 | 2 | 501 | | 59 | 501 | | | | |
| | | Mike Jung | | | 24.6 | 8.3 | 1 | | | | 501 | 5 | 60 | 496 | | | | |
| 1.2 | 501 SIDO | David Macher | | | 35.0 | 11.7 | 1 | W | 15 | 2 | 501 | | 43 | 501 | | | | |
| | | Mike Jung | | | 35.0 | 11.7 | 2 | | | | 501 | 11 | 42 | 490 | | | | |
| 1.3 | Cricket | David Macher | | | 2.5 | 0.8 | 2 | W | 10 | | 0M | | 29 | | 24M | | | |
| | | Mike Jung | | | 1.3 | 0.4 | 1 | | | | 0M | | 30 | | 13M | | | |
| 1.4 | Cricket | David Macher | | | 2.9 | 1.0 | 1 | W | 8 | | 0M | | 22 | | 21M | | | |
| | | Mike Jung | | | 1.4 | 0.5 | 2 | | | | 0M | | 21 | | 10M | | | |

DCTV More Darts!

Match Counts

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

Select Report: Summary > Game Detail > Player Performance > Match Counts My DCA >

| Opponents | Match | | | All '01 Games | | | All Cricket Games | | |
|---|---|---|---|---|---|---|---|---|---|
| | Score | Sets | Games | Points | Darts | PPR | Marks | Darts | MPR |
| David M | 4 | 1 | 4 | 1,002 | 102 | 29.5 | 45 | 51 | 2.6 |
| Mike J | 0 | | | 986 | 102 | 29.0 | 23 | 51 | 1.4 |
| All Games Played (AGP) | n/a | 1 | 4 | 1,988 | 204 | 29.2 | 68 | 102 | 2.0 |

*An email address is required for DartConnect to calculate, report and deliver player performance data. Membership is required for league statistics, select reporting features and trend analysis. Confirm your email address on the device that hosted this match & join DartConnect today!*

60+ Double-Ins

| High | Count | 60-99 | 100-139 | 140+ |
|---|---|---|---|---|

60+ Double-Outs

| High | Count | 60-99 | 100-139 | 140+ |
|---|---|---|---|---|

'01 100+ Turns

| | Points | Count | High Turn | 100-119 | 120-139 | 140-169 | 160-179 | 180 |
|---|---|---|---|---|---|---|---|---|
| Jung, Mike | 126 | 1 | 126 | | 1 | | | |
| Macher, David | 100 | 1 | 100 | 1 | | | | |

'01 95+ Turns

| | Points | Count | High Turn | 95-113 | 114-132 | 133-161 | 162-179 | 171-180 |
|---|---|---|---|---|---|---|---|---|
| Jung, Mike | 126 | 1 | 126 | | 1 | | | |
| Macher, David | 100 | 1 | 100 | 1 | | | | |

Cricket 5M+ Turns

| | H Mark Total | Count | 5M-% | 5 Marks | 6 Marks | 7 Marks | 8 Marks | 9 Marks |
|---|---|---|---|---|---|---|---|---|
| Macher, David | 12 | 2 | 11% | | 2 | | | |

| | Cricket Bulls | | | | | Marksman Counts | | |
|---|---|---|---|---|---|---|---|---|
| | All Bulls | 3 Bulls | 4 Bulls | 5 Bulls | 6 Bulls | Triples | D. Bulls | Hat Tricks |
| Macher, David | 7 | 1 | | | | 5 | 2 | |
| Jung, Mike | 2 | | | | | 2 | | |

FIG. 24

DartConnect Recap
To: David
David M (4) vs. Mike J (0)

July 27, 2015 10:35 PM
Hide Details
Inbox - iCloud

DART CONNECT

Score.
Track.
Connect.

David,

Here is a link to a summary of the DartConnect match you just completed:

http://members.dartconnect.com/history/report/match/55b6e8c2edee1/50076dbef9

Thank you for your support - Shoot Well!

The DartConnect Team
support@dartconnect.com www.dartconnect.com

*To keep up with the latest developments and releases, Like us on Facebook or follow DartConnect on Twitter.*

2626

FIG. 26

Patriot Dart League
★ Where Accuracy Counts ★

Stars & Stripes 2015 Shootout

DART CONNECT
PERFECT YOUR GAME

'01 Leaders

| 01 Leg Victories % | | | Event PPR | | | Set PPR (3+ Legs) | | | High 501 PPR (Singles) | | |
|---|---|---|---|---|---|---|---|---|---|---|---|
| 1 Caisse, S | 100 | | 1 Roy, J | 86.2 | | 1 Curtin, T | 88.6 | * | 1 Curtin, T | 117.0 | * |
| 2 Delana, J | 100 | * | 2 Delana, J | 84.8 | * | 2 Curtin, T | 87.1 | * | 2 Sawyer, T | 110.5 | * |
| 3 Hamel, B | 100 | | 3 Consalvo, P | 80.1 | * | 3 Sawyer, T | 86.0 | * | 3 Curtin, T | 107.4 | * |
| 4 Keogh, J | 100 | | 4 Curtin, T | 77.7 | * | 4 Kelley, J | 84.7 | | 4 Sawyer, T | 100.5 | * |
| 5 Morehouse, J | 100 | | 5 Vye, S | 76.9 | * | 5 Consalvo, P | 80.1 | | 5 Sawyer, T | 100.5 | * |
| 6 Perkins, M | 100 | * | 6 Kelley, J | 75.3 | | 6 Remick, L | 77.2 | * | 6 Curtin, T | 93.9 | * |
| 7 Roy, J | 100 | | 7 Ellison, T | 75.0 | * | 7 Brousseau, C | 74.8 | | 7 Curtin, T | 93.3 | * |
| 8 Demers, J | 90 | * | 8 Brousseau, C | 74.8 | | 8 Gaudreau, B | 74.0 | | 8 Sawyer, T | 92.0 | * |
| 9 Payne, G | 89 | * | 9 Sawyer, T | 73.2 | * | 9 Sawyer, T | 73.5 | * | 9 Thoits, R | 91.5 | |
| 10 Curtin, T | 84 | * | 10 Remick, L | 71.6 | * | 10 Sawyer, T | 73.2 | * | 10 Sawyer, T | 91.3 | * |

2015 Stars & Stripes Shootout
Andover, MA
July 17 - 19

DartConnect Numbers

| | |
|---|---|
| DC Matches | 109 |
| Players Scored | 133 |
| 01 Legs | 239 |
| 01 Darts | 8,280 |
| 01 Points | 128,010 |
| Event PPR | 46 |
| Cricket Legs | 180 |
| Cricket Darts | 8,201 |
| Cricket Marks | 6,270 |
| Event MPR | 2.3 |

*Thanks to the members and volunteers who helped make this report possible, especially those who brought a tablet to the event. Data may be incomplete or subject to input errors and is intended to be representative of the event.*

2727

Performance Highlights

| Total Points | | | Total 100+ Points | | | 100+ Count | | | 180's/High Turn | | | High DO | | |
|---|---|---|---|---|---|---|---|---|---|---|---|---|---|---|
| 1 Sawyer, T | 10884 | * | 1 Sawyer, T | 4261 | * | 1 Sawyer, T | 36 | * | 1 Sawyer, T | 3X | * | 1 Gaudreau, B | 157 | |
| 2 Curtin, T | 7723 | * | 2 Curtin, T | 3975 | * | 2 Curtin, T | 33 | * | 2 Curtin, T | 2X | * | 2 Curtin, T | 128 | * |
| 3 Remick, L | 4724 | * | 3 Guadreau, B | 1786 | | 3 Gaudreau, B | 15 | | 3 Remick, T | 1X | * | 3 Sawyer, T | 108 | * |
| 4 Gaudreau, B | 4087 | | 4 Remick, L | 1359 | * | 4 Remick, L | 12 | * | 4 Gaudreau, B | 157 | | 4 Terry, P | 104 | |
| 5 Briggs, V | 3826 | * | 5 Briggs, V | 964 | * | 5 Briggs, V | 8 | * | 5 Provencal, K | 156 | * | 5 Briggs, V | 100 | * |
| 6 Balcom, K | 3505 | * | 6 Walsh, D | 923 | * | 6 Walsh, D | 8 | * | | | | 6 Payne, G | 87 | |
| 7 Provencal, K | 3289 | | 7 McKeon, P | 821 | * | 7 Kelley, J | 7 | | | | | 7 Remick, L | 87 | * |
| 8 Walsh, D | 3044 | * | 8 Kelley, J | 780 | | 8 McKeon, P | 7 | * | | | | 8 Walsh, D | 80 | * |
| 9 Demers, J | 2949 | * | 9 Provencal, K | 661 | * | 9 Amaral, S | 5 | * | | | | 9 McCandless, K | 68 | * |
| 10 Terry, D | 2423 | * | 10 Amaral, S | 587 | * | 10 Provencal, K | 5 | * | | | | 10 McCandless, H | 66 | |
| | | | | | | | | | | | | Smith Davis, T | 66 | * |

** Indicates players who are par t of the DartConnect Launch Team*
*- Congrats to Staff & Volunteers on their Inaugural Event!*

*For additional details of this event, go to:*
*http://app.dartconnect.com/dctvlistings/tournaments.html*

DCTV

FIG. 27

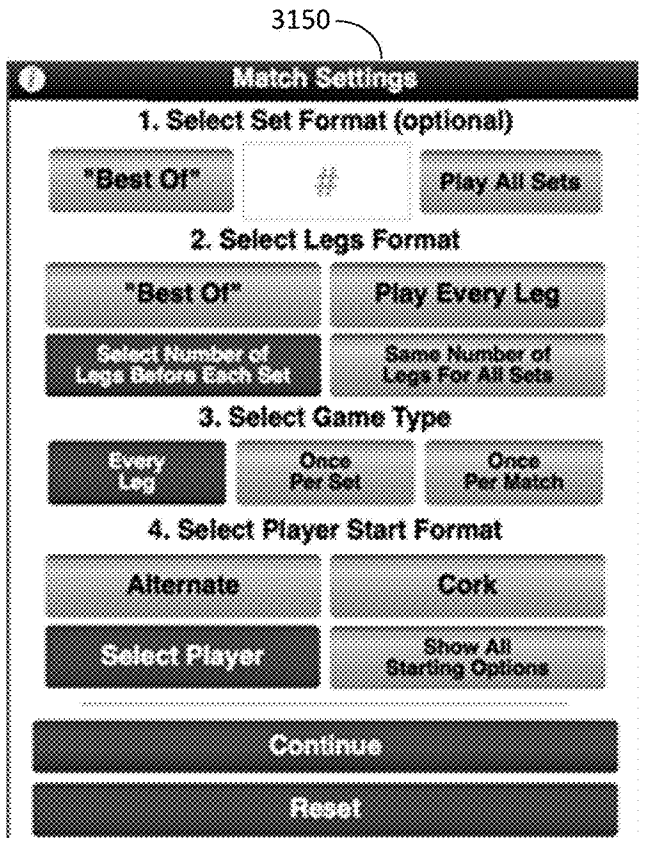
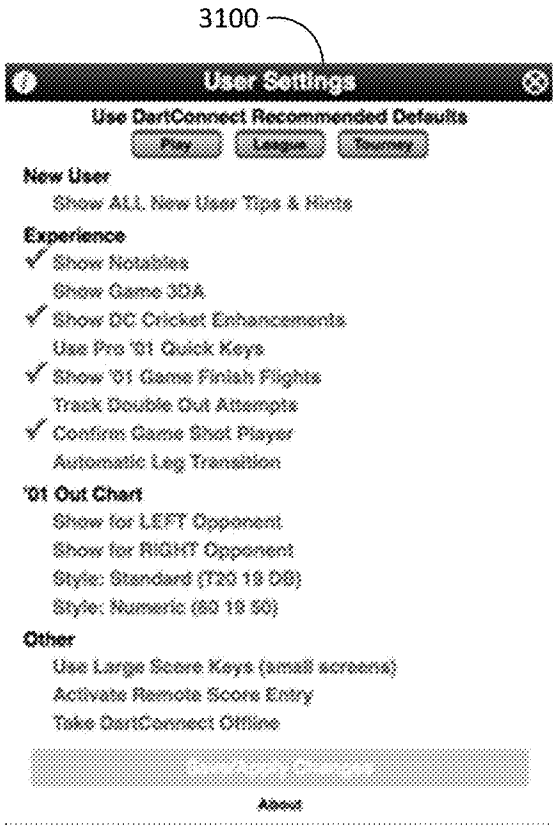
FIG. 31

DART SCORING SYSTEM

PRIORITY

This application is a continuation-in-part of U.S. patent application Ser. No. 14/832,366 filed Aug. 21, 2015 and entitled "Dart Scoring System", which claims priority to U.S. Provisional Application No. 62/040,299, filed Aug. 21, 2014 and entitled "Dart Scoring System", which is incorporated herein by reference in its entirety.

FIELD OF THE INVENTION

This invention is related to the game of darts. In particular, but not by way of limitation, the invention is related to providing a scoring system for various dart games.

BACKGROUND OF THE INVENTION

The game of darts is traditionally an English pub game in which each player takes turns throwing 3 steel-tipped throwing devices (i.e., "darts") at various targets on a bristle board containing 20 segments and bulls eye. The two primary games played in the United States are titled '01 ("oh-one") and Cricket.

Historically, scoring was done on chalkboards and more recently, dry erase boards. Although electronic wall-mounted score machines have been developed, they can be expensive and many have a steep learning curve. Furthermore, electronic soft tip machines use special darts and special scoreboards to automatically record scores when the darts hit the board. These are akin to video games, often requiring money for each game and requiring players go to specific establishments having such scoreboards.

Additionally, dart software programs (i.e., applications) typically have a narrow focus and their interfaces tend to be technical and difficult to learn as they do not conform to the typical chalkboard/dry erase board scoring system. Team/league and tournament play is especially challenging to accommodate in such software due to the nature of match format variations and group play.

Many additional factors have prevented easy-to-use modern scoring systems from being developed and/or widely accepted. A first of these is math. Scoring a dart game is prone to math errors, which at a minimum slows game play and often results in incorrect scores. It is this particular pain point that is credited for giving rise to the soft-tip electronic vending game industry described above, impacting the popularity of the steel tipped game. A second factor is the existing electronic scoreboards, which, as stated, can be intimidating or confusing, especially for the uninitiated. Confirming and editing recent scores can be very difficult on these systems, due to a lack of instructions. Furthermore, interfaces vary dramatically from traditional chalk board scoring. A third preventing modern scoring systems from wide acceptance is that darts is a hard game to watch. For example, teammates and spectators often struggle with seeing the current score of the match due to legibility, lighting, positioning, and space restrictions. This often prevents spectators from keeping up with the status of a live game. A fourth problem is finding opponents & creating opportunities to play. As with scheduling any joint activity, the logistics of finding an agreeable time and a common meeting point, while managing the personal commitments in life, can make playing darts a challenge. A fifth issue are game rule variations. There are dozens of niche dart games and practice routines with rule variations. The result is that there are hundreds of possibilities of game types, with even identical games going by different names depending on geography. This difference creates decreased accuracy. Player performance also limits acceptance. Players are not familiar with ways to measure their performance as current player performance measurement tools require additional manual calculations after every game or match and is especially tedious for cricket-based games.

SUMMARY OF THE INVENTION

An aspect of the disclosure provides an integrated dart scoring platform comprising an electronic bracket program, a cloud server application, an electronic dart scoring application, and one or more application program interfaces. The platform may be configured to facilitate a dart tournament scored on the plurality of mobile computing devices executing the electronic scoring dart application by gathering, at the electronic bracket program, a master tournament player list for the tournament, wherein the master tournament player list includes the event or events in which each player is participating. Then, the platform may include, generating, at the cloud server application, a tournament record based on the master tournament player list wherein the tournament record comprises at least device settings and match rules. The platform may further comprise, sending the master tournament player list and the tournament record to each of the plurality of mobile computing devices executing the electronic scoring dart application. The platform may then comprise scoring a plurality of matches of the tournament on the plurality of mobile computing devices executing the electronic scoring dart application. Then the platform may include automatically sending scores in substantially real-time from each of the plurality of matches upon their completion to the cloud server application and electronic bracket program via the one or more application program interfaces; and automatically advancing players at the electronic bracket program based on the sent scores.

Another aspect of the disclosure provides a method for facilitating a dart tournament. The method may include gathering, at an electronic bracket program, a master tournament player list for the tournament, wherein the master tournament player list includes the event or events in which each player is participating. Then, the method may include, generating, at a cloud server application, a tournament record based on the master tournament player list wherein the tournament record comprises at least device settings and match rules. The method may further comprise, sending the master tournament player list and the tournament record to each of a plurality of mobile computing devices executing an electronic scoring dart application. The method may then comprise scoring a plurality of matches of the tournament on the plurality of mobile computing devices executing the electronic scoring dart application. Then the method may include automatically sending scores in substantially real-time from each of the plurality of matches upon their completion to the cloud server application and electronic bracket program via the one or more application program interfaces; and automatically advancing players at the electronic bracket program based on the sent scores.

Yet another aspect of the invention comprises a non-transitory, tangible, computer-readable storage medium, encoded with processor-readable instructions to perform a method of facilitating a dart tournament. The method may include gathering, at an electronic bracket program, a master tournament player list for the tournament, wherein the master tournament player list includes the event or events in which each player is participating. Then, the method may include, generating, at a cloud server application, a tournament record based on the master tournament player list wherein the tournament record comprises at least device settings and match rules. The method may further comprise, sending the master tournament player list and the tournament record to each of a plurality of mobile computing devices executing an electronic scoring dart application. The method may then comprise scoring a plurality of matches of the tournament on the plurality of mobile computing devices executing the electronic scoring dart application. Then the method may include automatically sending scores in substantially real-time from each of the plurality of matches upon their completion to the cloud server application and electronic bracket program via the one or more application program interfaces; and automatically advancing players at the electronic bracket program based on the sent scores.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

FIG. 24 depicts a report comprising statistics screen according to one embodiment of the invention;

FIG. 26 depicts a communication according to one embodiment of the invention;

FIG. 27 depicts various statistical leaders according to one embodiment of the invention;

FIG. 31 depicts a settings screen and a match rules screen according to one embodiment of the invention;

DETAILED DESCRIPTION

Figure 1:
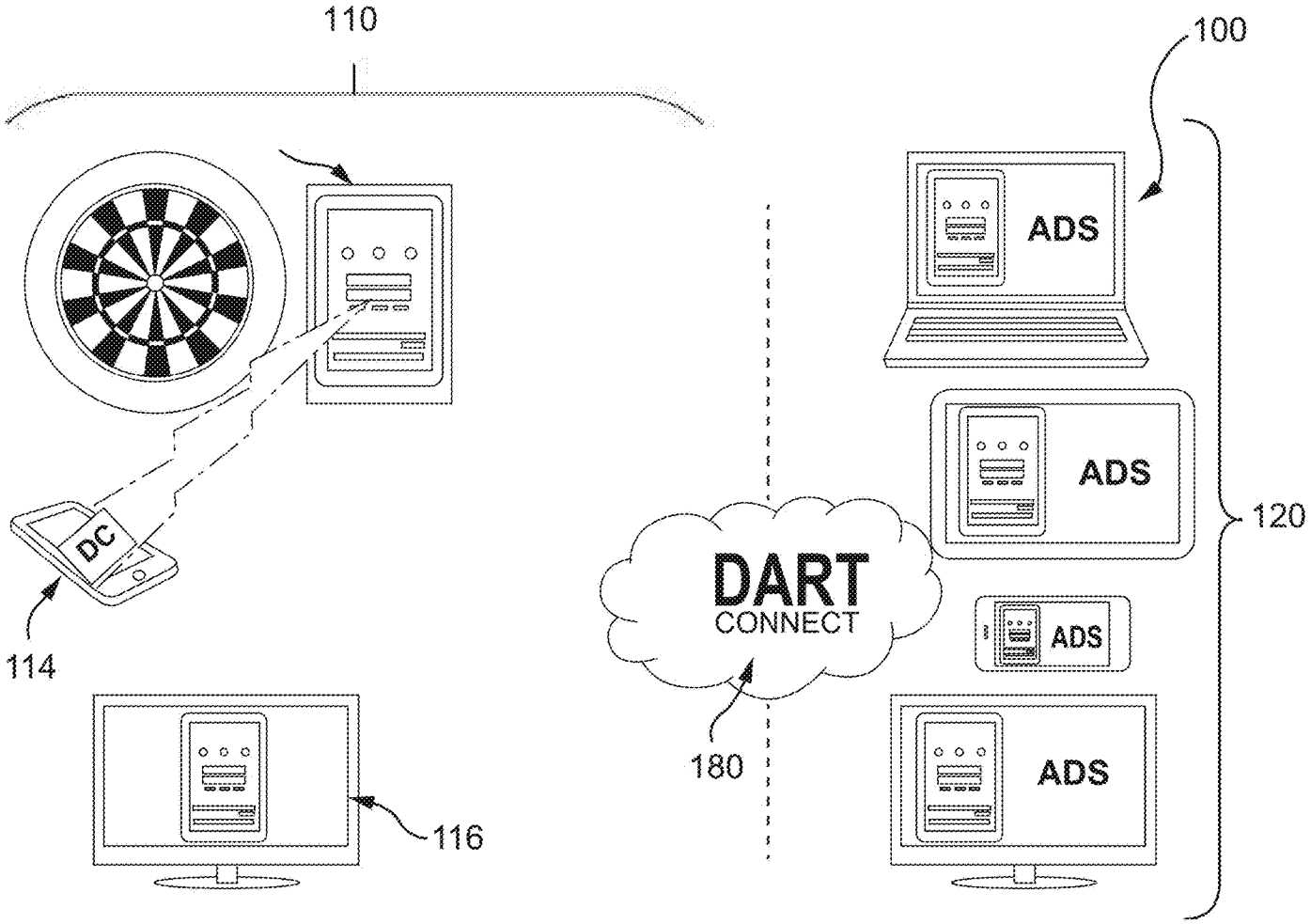
FIG. 1 depicts a dart game system according to one embodiment of the invention.

The dart game system 100 (also referred to herein as a dart scoring system or dart gaming system) seen in FIG. 1 has addressed the issues presented above. For example, the dart gaming system's unique interface substantially decreases the need for math skills and does not interfere with even the most proficient player's game. The dart gaming system 100 may also provide a calculation of your three dart average for all games, including a reference point that compares it to your most recent 3 month average. The dart gaming system's interface makes it easy to score, confirm or edit what was entered on the prior turn. With network access, the dart gaming system's interface can be broadcast to any computing device, allowing spectators who are at a distance or even offsite to follow the score of the game on a public or personal device. Furthermore, with network or internet-enabled devices, the dart gaming system 100 allows two opponents in separate locations to play a game, each taking turns scoring their respective turns. The dart gaming system 100 also provides a custom play option for enabling various game rules, where users have the ability to design games and practice routines to create the version of the game they are accustomed to playing or want to play.

One embodiment of the dart scoring system improves game play and the scoring experience. For example, the dart gaming system 100 captures data and statistics during the scoring of the game, eliminating the need for manual documentation. The dart gaming system 100 further utilizes the cloud to broadcast games for spectators to follow on any internet enabled device and enables game play between 2 opponents in separate locations. League and tournament play is supported with instant results & stats available to administrators, captains and players, and an interactive community is created utilizing the data collected from game play. It is contemplated that the system 100 may be utilized with or without a network connection. For example, when there is a network connection, the system 100 will automatically update the player/league/tournament statistics on a per throw/game/match segment, as identified by the user. However, if no network connection is available, the system stores the information locally and transfers the data to the server 180 up re-establishing a network connection, integrating the information with any previous information stored.

Turning first to FIG. 1, seen is on embodiment of a dart gaming system 100. Although each figure described below may refer to a particular aspect of the dart gaming system 100, it is contemplated that the figure, or a feature thereof, may be referred to as the system 100. As seen in FIG. 1, one dart gaming system 100 comprises on-site solutions 110 and off-site solutions 120. The on-site solutions 110 may comprise a scoreboard 112, mobile device 114 or home device 116, while the off-site solutions 120 may comprise one or more network-enabled or internet-enabled devices. The off-site solutions 120 may also be referred to herein as remote devices or broadcast devices. The use of the system 100 is adapted to provide a quick, easy, and effective dart game scoring mechanism, having the ability to score many niche dart games and/or dart games with one or more regional variation. Each of the devices seen in FIG. 1 may comprise a mobile computing device, a desktop device, or any other computing device known in the art.

Figure 19:
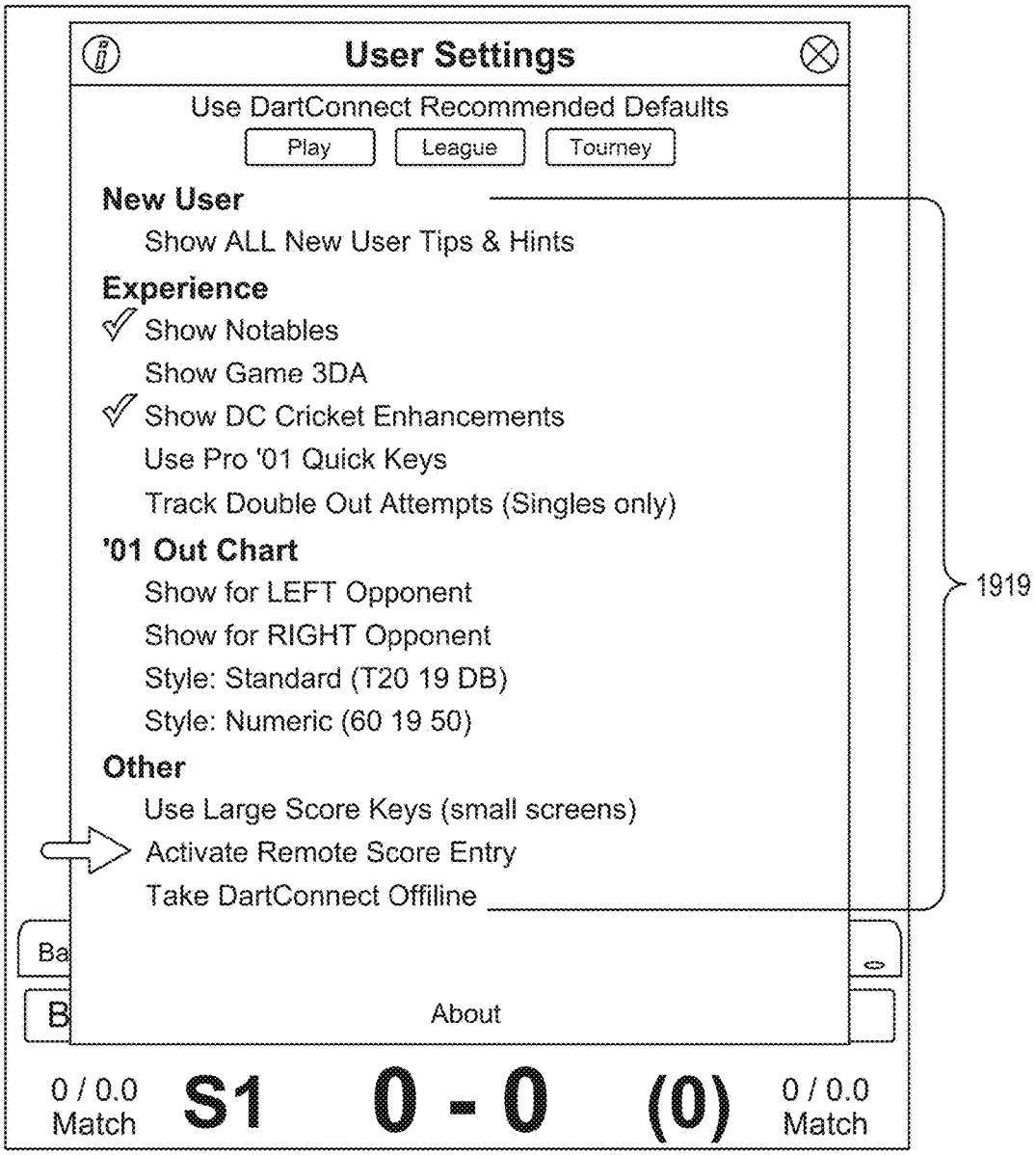
FIG. 19 depicts user settings according to one embodiment of the invention.

In one embodiment, the scoreboard 112 may be used to enter and display a dart game score on a user interface. A server 180 may broadcast the user interface to the remote devices. The home devices 116 may mirror the user interface by as a remote device 120. In addition to the scoreboard, 112, the mobile device 114 may also be used to enter scores onto the user interface. For example, the scoreboard 112 device may be placed near a dart board. In order to enter scores in a safe manner, a player may wish to use his or her handheld mobile device 114 to enter scores into the user interface instead of the scoreboard. However, if a mobile device 114 is used to enter scores, the scoreboard 112 may still control various user settings. Seen in FIG. 19 is one set of user settings 1919 that may be controlled by the scoreboard. One of these user settings 1919 may comprise when the broadcast scores (i.e., the scores on the remote devices 120) are updated. For example, the scores on the broadcast devices may be updated after each dart throw or may be updated after each player, or after each round. Other update scenarios are contemplated. As seen in FIG. 1, the remote devices may comprise advertisements—"ADS", as shown in the figure.

Figure 3:
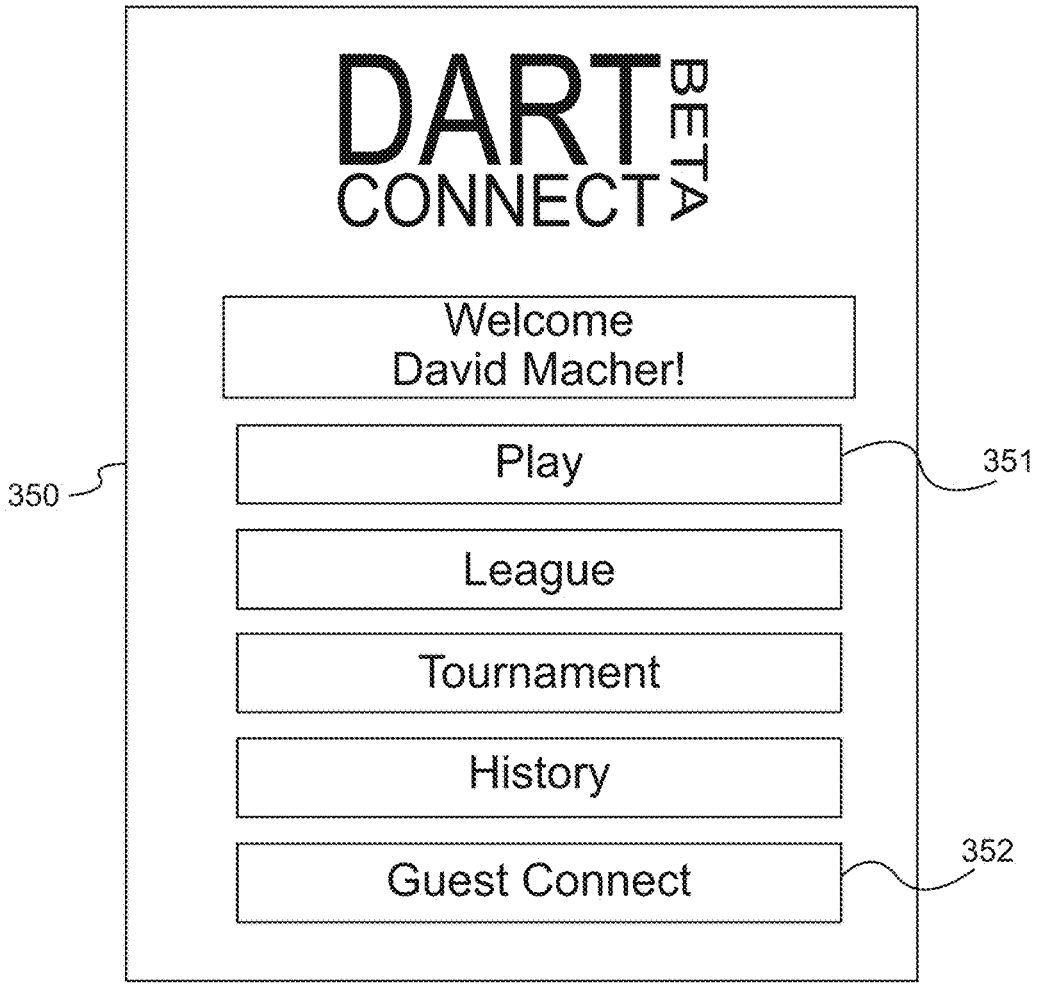
FIG. 3 depicts a launch screen according to one embodiment of the invention.
Figure 20:
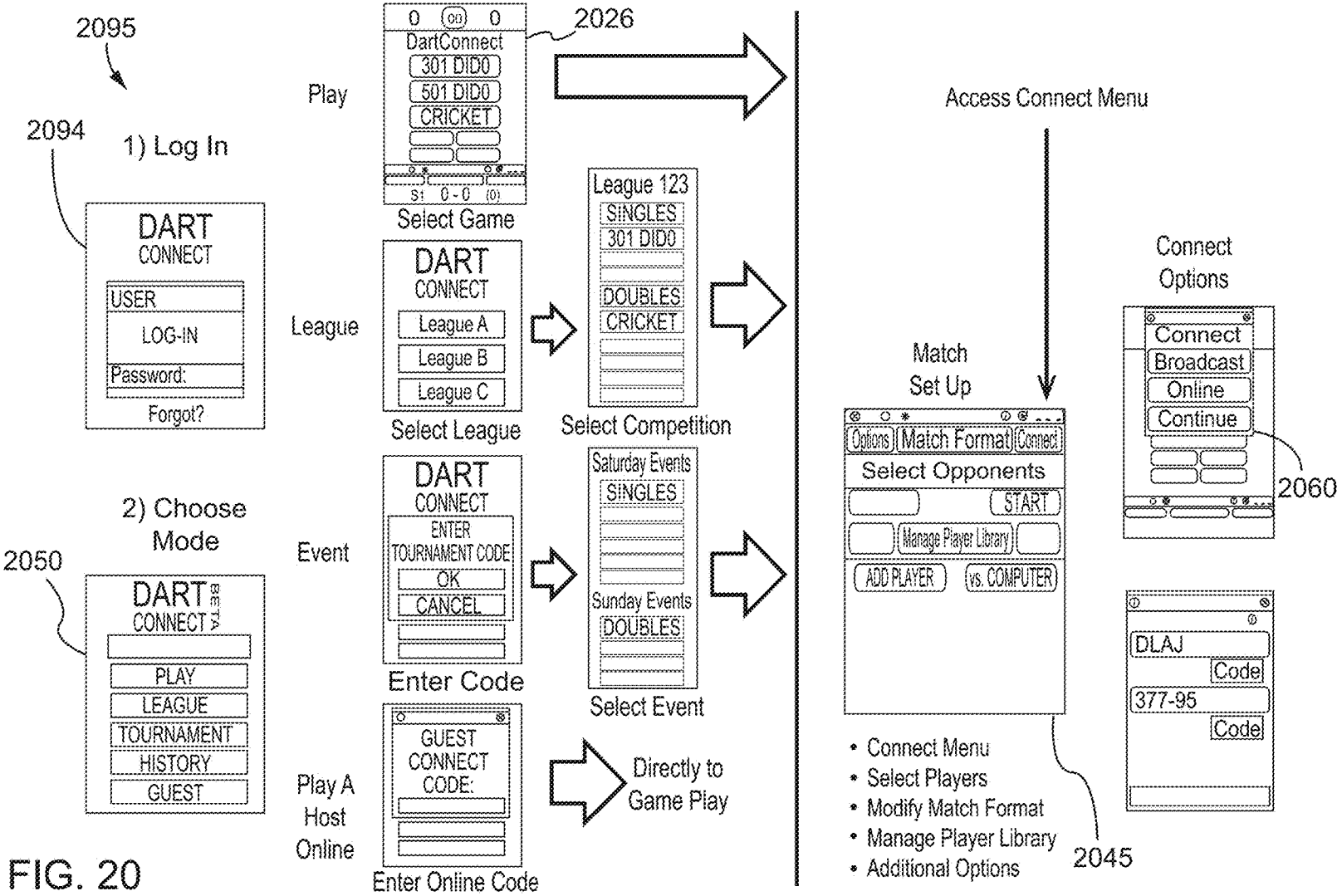
FIG. 20 depicts various user interface screens for a dart gaming system according to one embodiment of the invention.

Turning now to FIG. 20, seen is a system flow 2095 for enabling various system 100 features. For example, the log-in screen 2094 may be initially displayed to a user upon initiating the system 100 on any of the devices seen in FIG. 1. Through this screen, a user of the dart gaming system 100 may create an active member user profile in the system 100 and access the system 100 features. Each active member may have access to all matches & events (e.g., games, tournaments, etc.) in which they have participated. Data from the games that users have participated in may be populated within a membership account on the server 180, giving each user access to performance analysis. Such analysis may be used to provide a user rating and/or a user ranking and/or any other rating/ranking information or metrics which can be used to compare to the user to other members. It is also contemplated that the dart gaming system 100 may be used be a guest user 352, as seen in FIG. 3. A guest user may have the option of subscribing to the system 100 at any point and identifying the games they have previously participated in, populating their membership account with previous game data. Additionally, approved "outsiders" (e.g., though leagues, tournaments, etc.) can be given permission to have access to selected matches. As member games are stored over time, opportunities for virtual game play (i.e., database play) against themselves or others is available.

Figure 16:
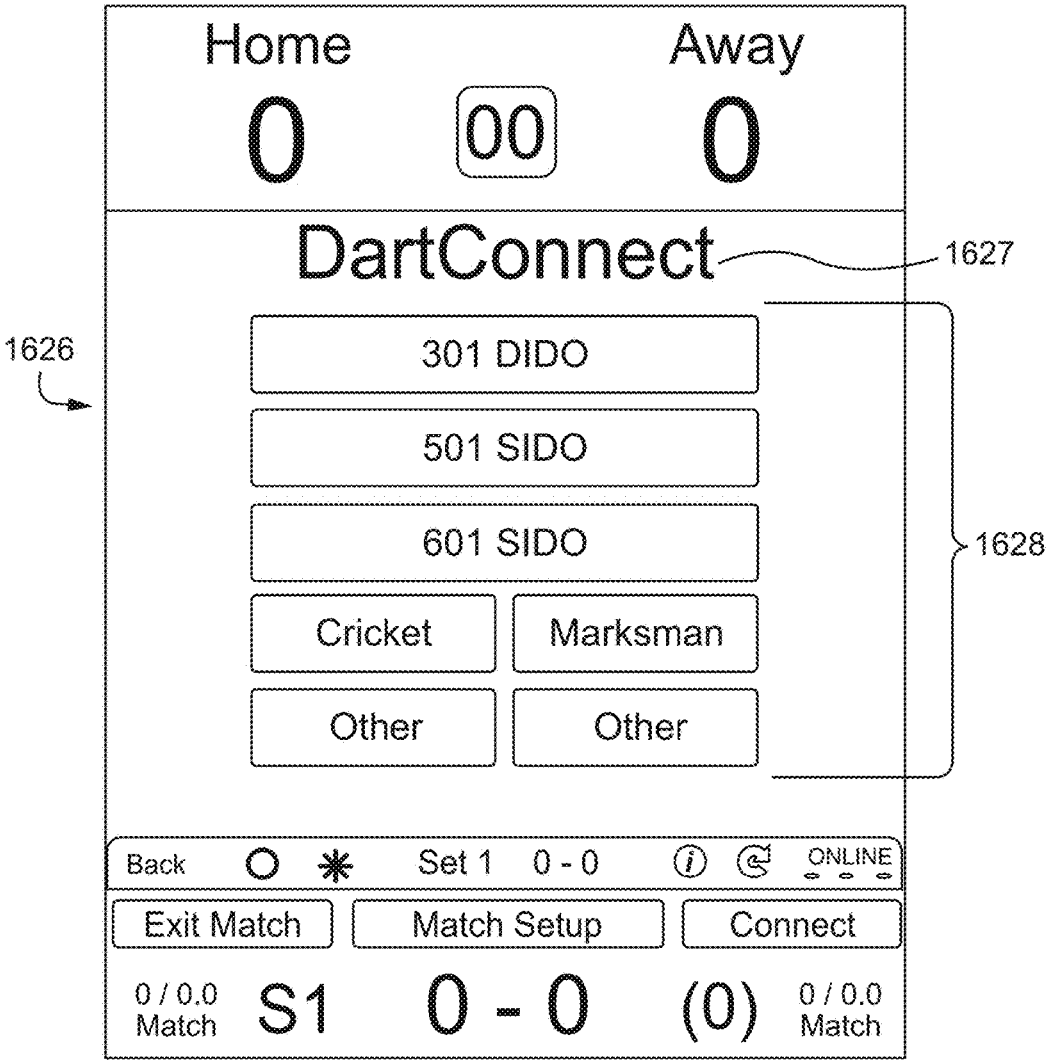
FIG. 16 depicts a menu screen according to one embodiment of the invention.
Figure 21:
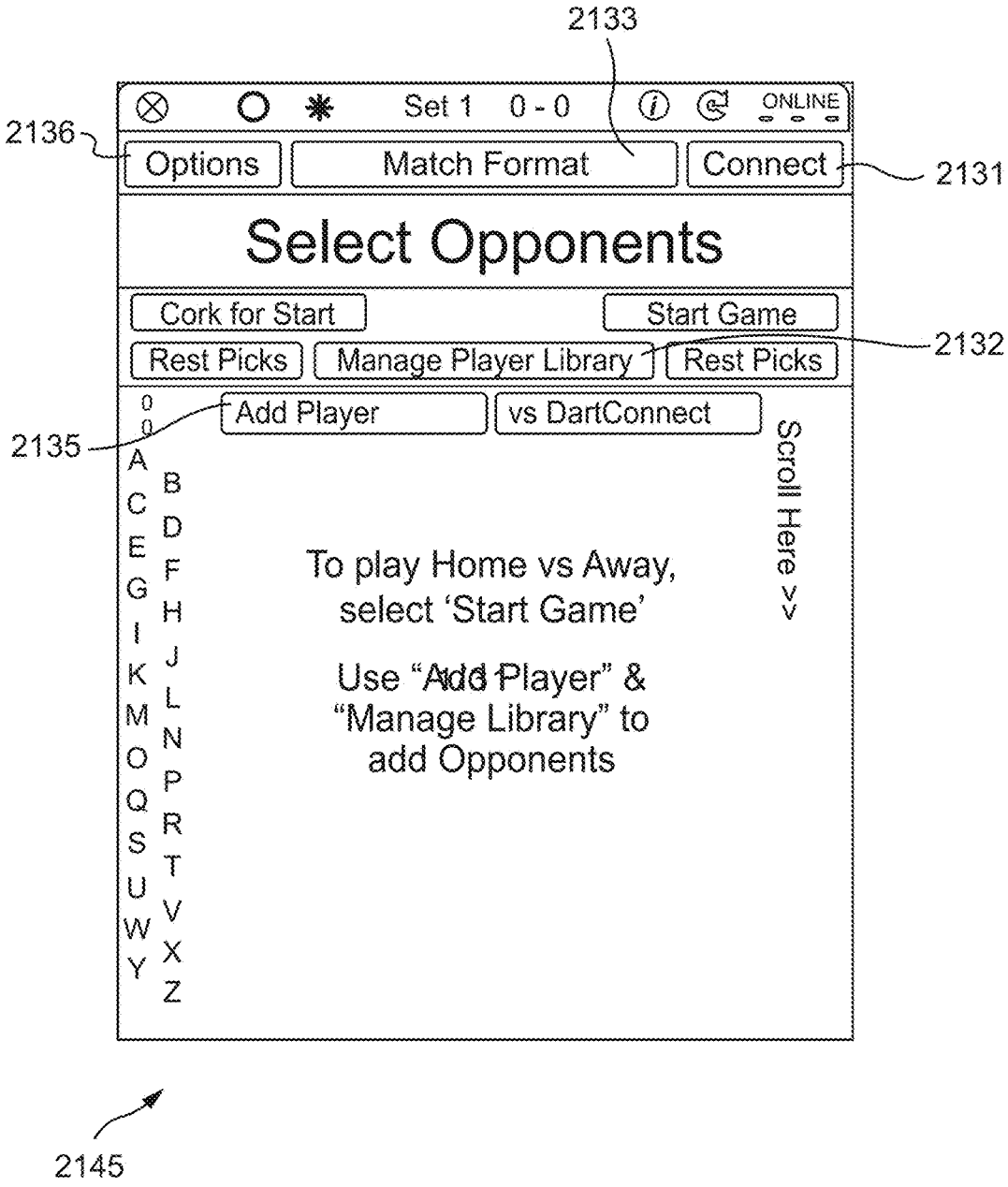
FIG. 21 depicts a match setup screen according to one embodiment of the invention.
Figure 22:
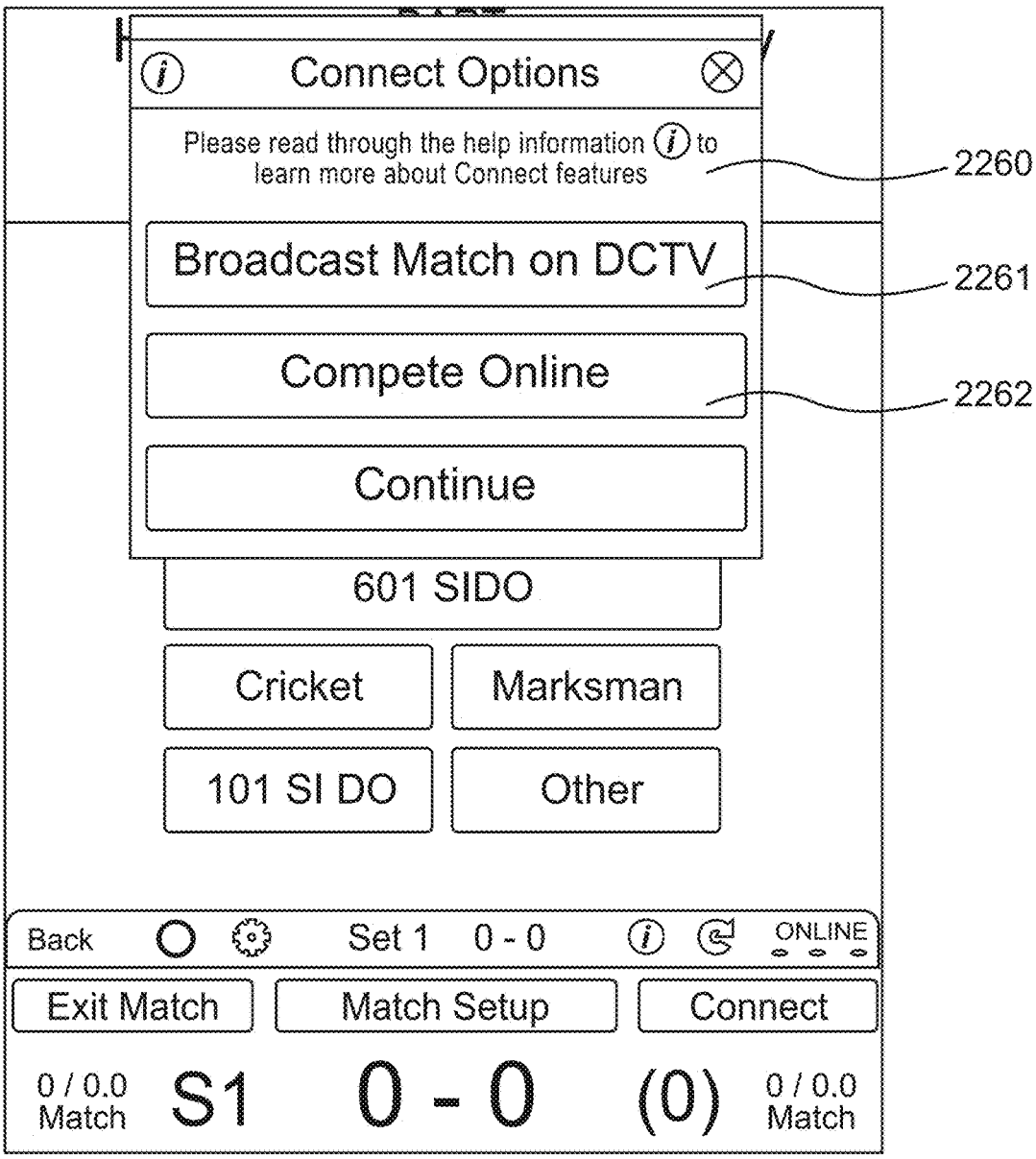
FIG. 22 depicts a connection options screen according to one embodiment of the invention.
Figure 23:
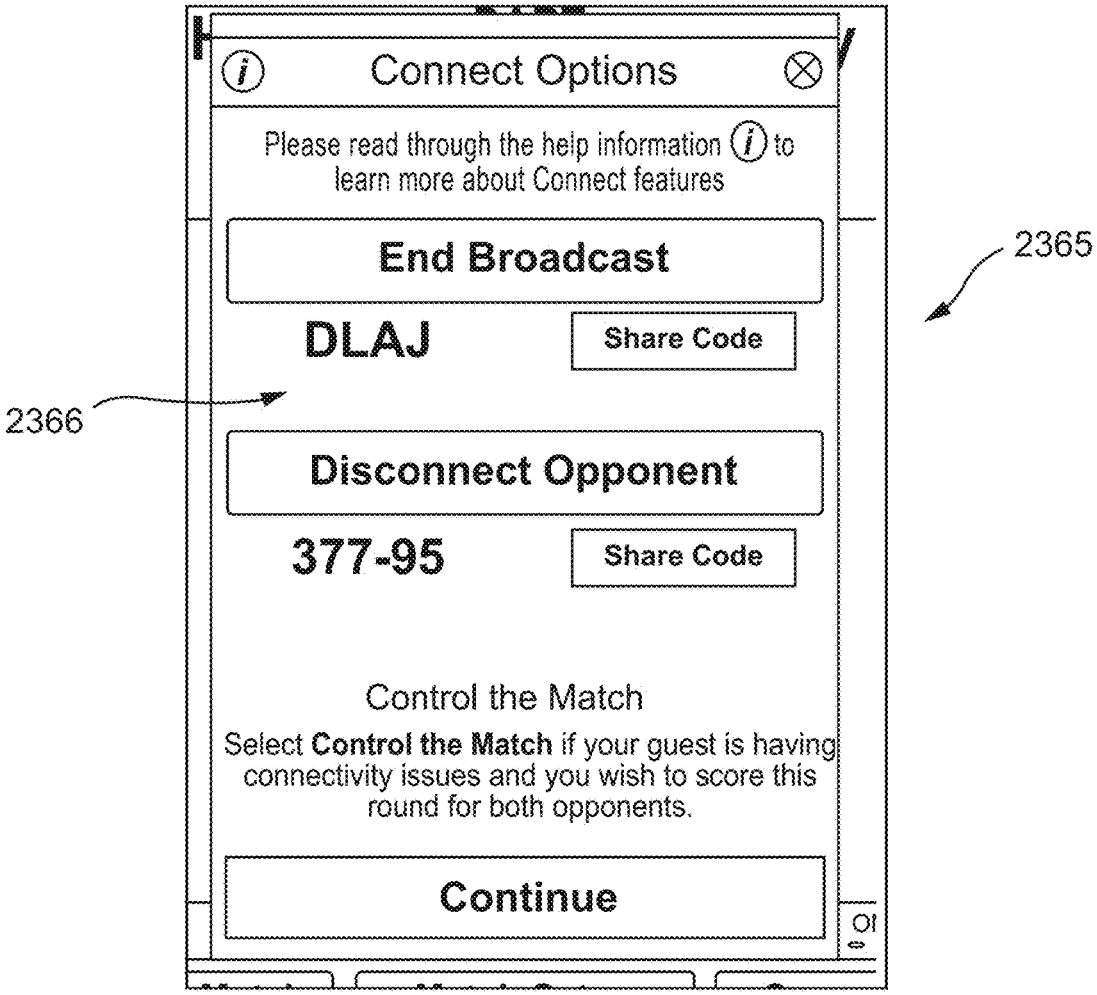
FIG. 23 depicts a second connection options screen according to one embodiment of the invention.

After entering a username/password into the log-in screen 2094, the launch screen 2050 may be displayed. The launch screen 350 is also seen in FIG. 3. Upon selecting the play 351 option in the launch screen 350, a menu 2026 screen, as also seen in FIG. 16 may be displayed. Seen in FIG. 16 are various dart game options 1628. A player may then select one of the dart game options 1628. Upon selecting one of the dart game options 1628, the match set up screen 2045 may be displayed, as seen in FIG. 20. As seen in FIG. 21, the match set up screen 2145 may comprise a connect 2131 option, manage player library 2132 option, match format 2133 option, add player 2134 option, and additional options 2136. The match format 2133 option modifies the no of games/sets/matches to be played. Players may be added through the add player 2134 and manage player library 2132 options. Upon selecting the players in the game, selecting the match format, and any additional options, the connect 2131 option may be selected. The connect 2131 option will display the first connection options screen 2060. As seen in FIG. 22, the connection options screen 2260 may provide a broadcast match option 2261 and an online option 2262. By selecting the broadcast match option 2261, a second connection options screen 2365 may be displayed, as seen in FIG. 23, which may provide a connection code 2366. The connection codes 2366, 266 described herein may also be referred to as a broadcast key, key, password, or any other similar term known in the art. The host may then share this connection code 266, 2366 with other users so that the other users may view the match.

Figure 2A:
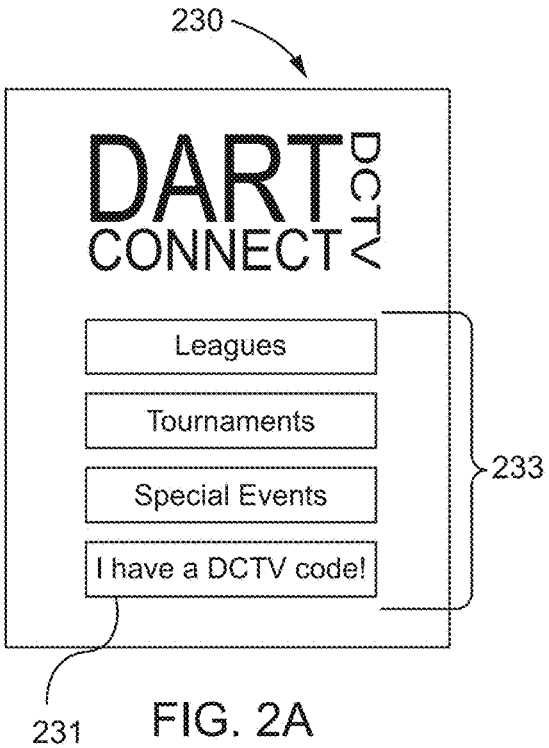
FIG. 2A depicts a first screen of a dart gaming system broadcasting feature according to one embodiment of the invention.
Figure 2B:
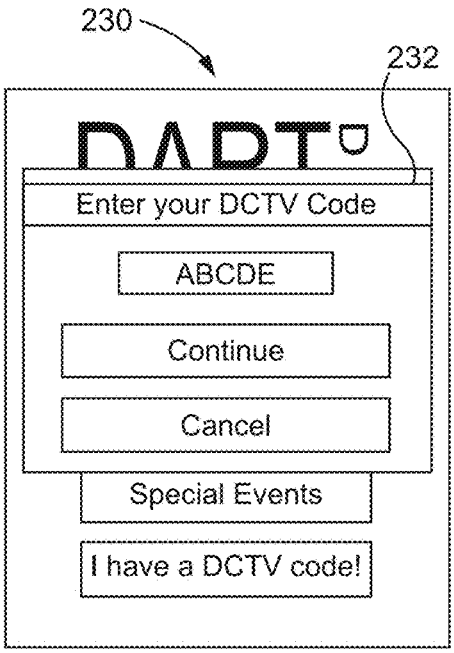
FIG. 2B depicts a code screen according to one embodiment of the invention.
Figure 2C:
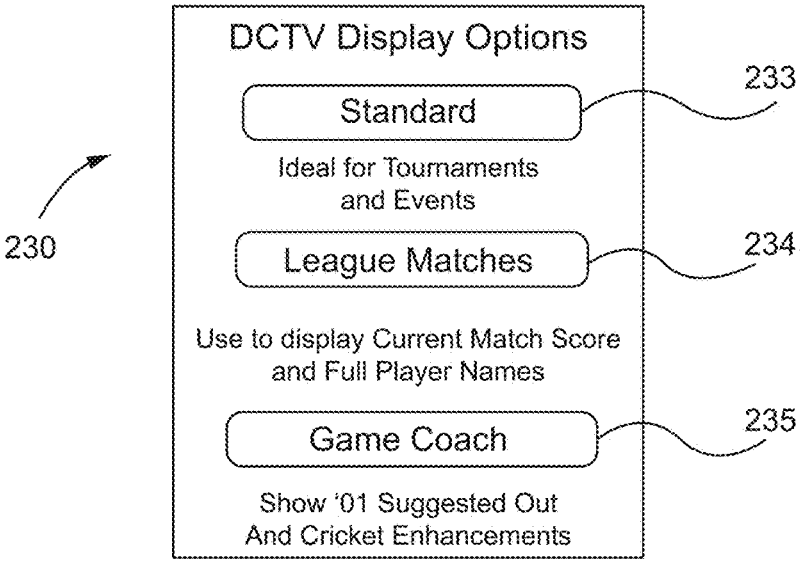
FIG. 2C depicts various dart game broadcasting options according to one embodiment of the invention.

Turning now to FIGS. 2A-2C, seen are examples of a dart gaming system broadcasting feature 230. The screen seen in FIG. 2A may comprise a code option 231, which, when selected, may display the code screen 232 seen in FIG. 2B. Entering the connection code 2366 into this screen will enable the spectator to receive the scoring interface from the scoreboard 112 or other on-site solution 110 device, via the server 180 in at least one embodiment. Selecting one of the link options 233 may provide a link to public matches to view. For example, the online option 2262 seen in FIG. 22 may create a publicly-accessible link on a publicly-available webpage. This link may have the ability to "broadcast" their match play on the internet—viewable with any browser, when the link is accessed. For public broadcasts, interested parties may also be directed to a listing on a web page that provides a link which gives the spectator instant access to the game/match/tournament. The broadcasting application may comprise a feature which takes advantage of landscape display environments. One dart gaming system 100 may comprise an HTML5 (or any other program known in the art) program capable of running on any computing device comprising an internet browser such as, but not limited to, Internet Explorer®, Mozilla®, or Google Chrome®. As seen in FIG. 2C, a standard viewing option 233, league viewing option 234, and/or game coach viewing option 235 may be provided to a spectator after either entering the code, as seen in FIG. 2*b,* or accessing the link through the link options 233. The standard viewing option 233 may display a scoring interface and current averages for each player. The league viewing option 234 may also provide a match score and full name listing of the players, while the game coach option 235 may also enable the viewers to receive game tips and strategies. The players may also receive these tips and strategies or may choose not to receive them through the user settings 1919, as seen in FIG. 19.

The system 100 may comprise an audio and/or video component (e.g., live two-way audio and video) to any dart game initiated on the dart gaming system. Such audio/video may be provided through the dart gaming system using any 3rd-party VOIP or video-streaming service. It is contemplated that the video component may be utilized to support the scoring in the system 100. For example, if a score is contested, a video replay may be used to determine whether the entered score was accurate. Alternatively, the video feed may be automatically utilized by the system 100 to record scores in the system.

Two players, geographically separated, can play a match through the dart gaming system 100 by connecting through the server 180. The server 180 will also distribute the user interface on the scoreboard 112 device to the spectators, as well as record and save all player, team, league, and tournament score data for each throw in every game played on the system 100. To enable play between two geographically remote players, a match host may provide the broadcast key to an opponent that the opponent uses to join the host in the system 100. The game may proceed on two devices, giving each player an opportunity to score their own turn. The server 180 ensures that each player's scoreboard 112 is updated with the same data in real-time, regardless of which player enters the data. The host may also have the option of broadcasting this game to spectators at the same time through the broadcasting feature seen in FIG. 2 or described in relation to FIGS. 22 and 23.

One embodiment of the system 100 may comprise using data generated by the system 100 to create an interactive community between users of the system. In such a community, statistics for players may be created for comparison within and amongst the community. Such statistics and reports may be seen in FIGS. 24 and 25. Furthermore, rankings may be created among friends and/or competitors, players may be allowed to share achievements amongst other users and the system may enable players to play another player's games from a system database. For example, users have the ability to practice against "real games" that were previously played by users of the system 100 (themselves or others). This feature is provided by the system 100 keeping a historical log of all games played by users of the system. In one such feature, the system 100 may select a random recent game previously played by a user. Such a game may have been won by the user. The system 100 then reproduces each turn the player had, while the challenging player throws live darts and records his turns as he normally would in the system 100. The result is a similar to playing against a computer opponent, but instead the user is alternating turns with a historical game.

Figure 25:
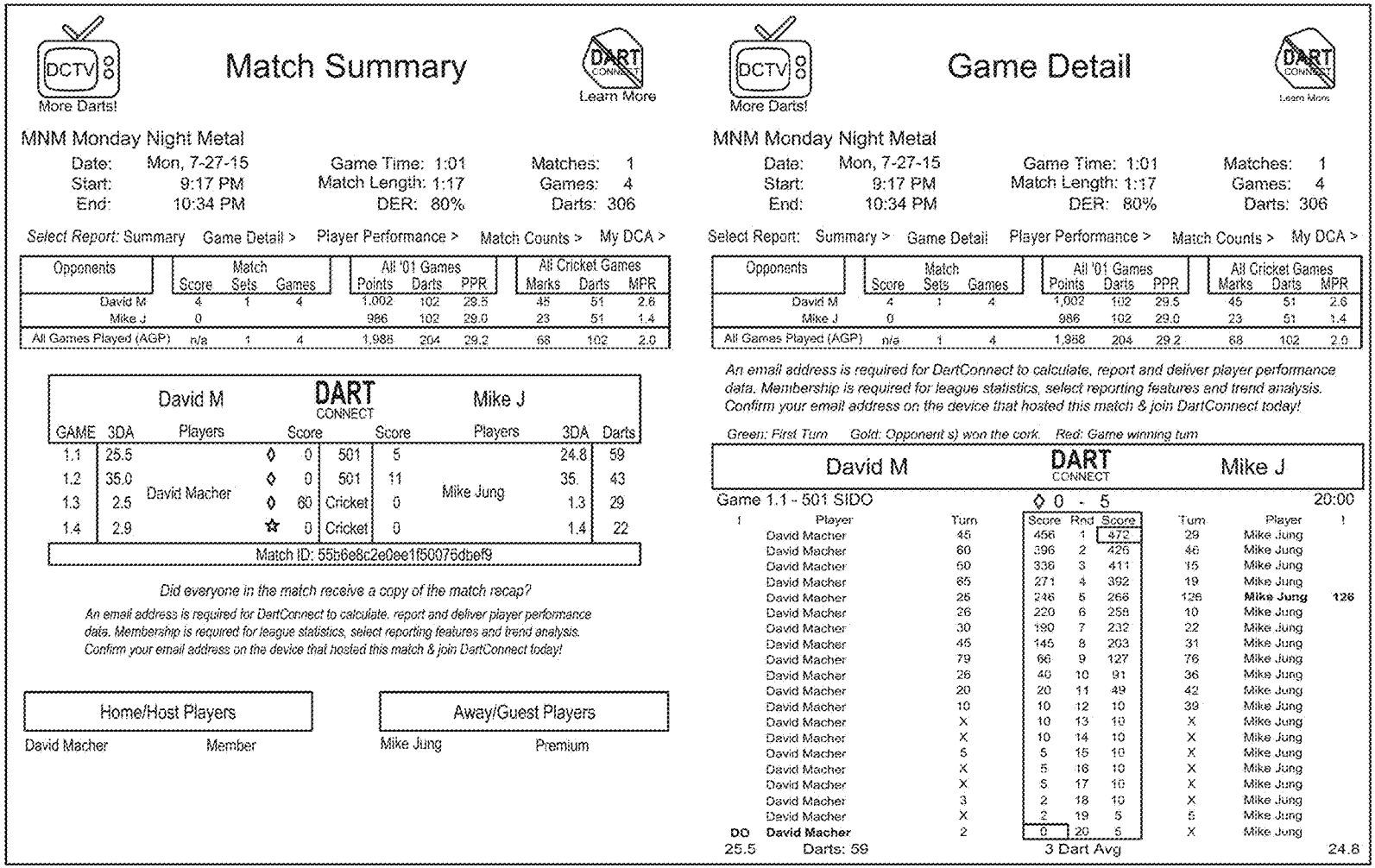
FIG. 25 depicts a report comprising statistics screen according to one embodiment of the invention.

After a match ends, the dart gaming system 100 may generate a communication such as, but not limited to, an email with a link which accesses the reports seen in FIGS. 24 and 25, or any other report. One such communication 2626 is seen in FIG. 26. An example of statistics 2727 created with the system is shown in FIG. 27. These reports and/or statistics may comprise information for all match participants and may comprise (a) an event description, (b) a match analysis, (c) a match recap, (d) the recognition of an exceptional player and any team accomplishments, and (e) any other news and/or offers for the user. In one embodiment, a user may have the ability to combine match data from separate devices or separate matches into one event summary that the user can review afterwards. For multi-device summaries, a user may request an "event key" and then distribute the key to other members of the match who may then flag their matches on their devices with this identifier. For a multi-match summary, a user can create an on-going "open" event. Anytime a user wants to include a specific match, they would simply reuse the assigned key.

The dart gaming system 100 is adapted to reduce new user anxiety. For example, any required math skills for scoring are eliminated as the system 100 accommodates all level of users. This increases the scoring accuracy, using redundant features to mitigate the typical mistakes associated with electronic interfaces, including user miss-keys, score keeper errors and unresponsive devices. Furthermore, the system 100 uses traditional scoring methods to replicate the "chalk board" scoring experience, enabling easier, faster and more accurate match scoring, allowing the players and score keepers to focus on the game itself.

Figure 4:
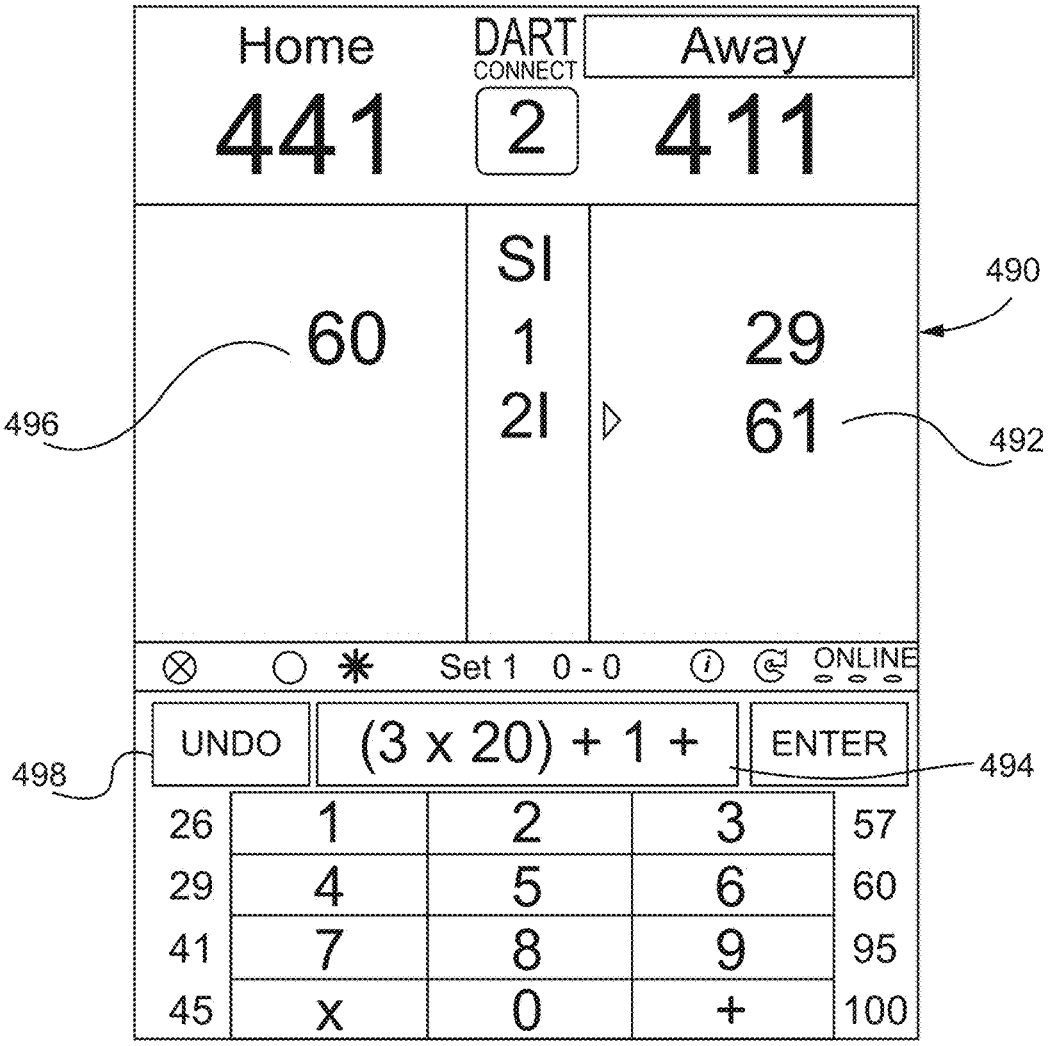
FIG. 4 depicts an '01 scoring interface according to one embodiment of the invention.

Turning now to FIG. 4, seen is one example of a scoring screen 490 for an '01 dart game. This may be the scoring screen 490 displayed on the scoring device 112 and adapted to receive scoring information, and may be broadcast to the off-site devices 120. Various challenges of scoring a dart match are addressed in such a screen 490. For example, the current turn 492 in the match (i.e., which identifies the user that needs to input a score for each round) is highlighted in s color different from the previously-entered scores in an audit trail 196 to make it clear to all what is being scored. Additionally, a score window 494 displays and stores for later review (upon accessing a score in the audit trail 496) what is actually being keyed by the user though an integrated calculator functionality within the keypad, which assists with math processing. Through the audit trail 496 of recent turns, players, score keepers and spectators may quickly and easily review the accuracy of entered prior turn scores. Also provided is an easy edit "UNDO" button 498 to erase the current entry. The UNDO button transforms into a BACK button when there are no entries in the score window 494 and the "BACK" button highlights the prior turn in the audit trail 496 to show parties what was keyed by the user in the score window 494 along with the resulting score in the audit trail 496.

Figure 5A:
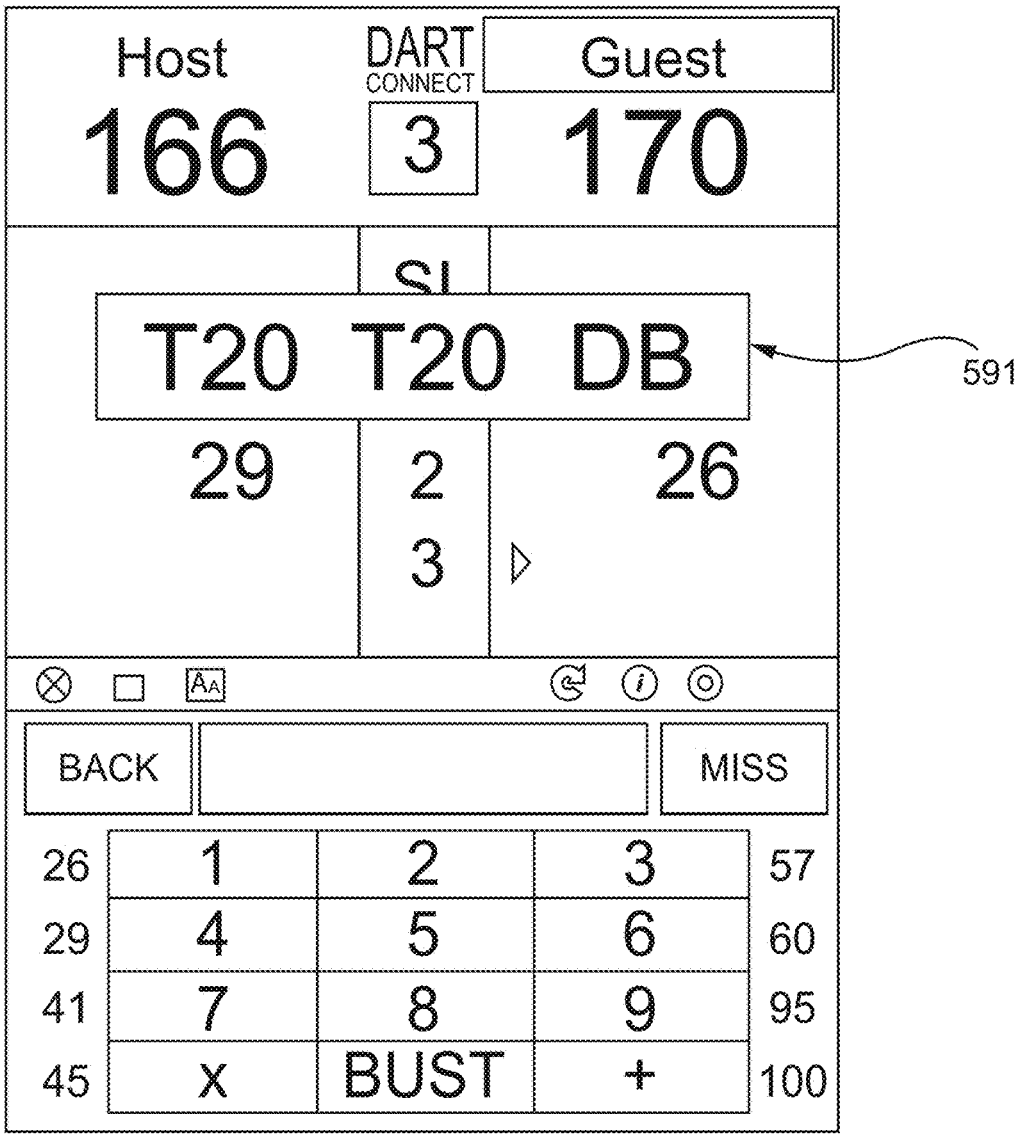
FIG. 5A depicts a training tool according to one embodiment of the invention.
Figure 5B:
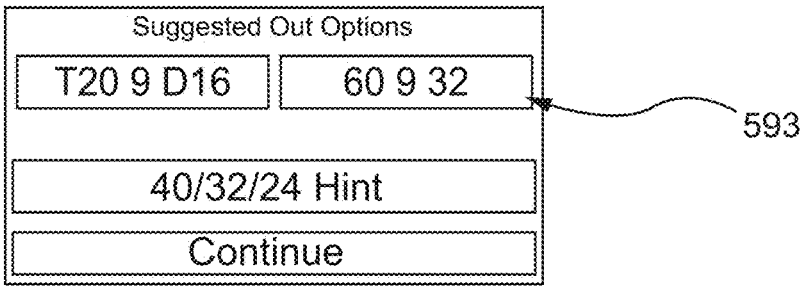
FIG. 5B depicts suggested out options in a notification according to one embodiment of the invention.

Seen in FIG. 5A is one example of a training tool to assist in determining the optimum targets to win an '01 game. As seen, as assist notification 591 may display what score the "Guest" player would need to obtain with each dart in a 3-dart throw in order to obtain a score of "170". These scores are shown as "T20," "T20," and "DB," which means that the first dart throw lands in a triple-20 score portion of the dartboard, the second dart throw also lands on a triple-20 score portion of the dartboard, and the third dart throw lands in the double bull's-eye. With each triple-20 score providing sixty points and the double bulls-eye providing 50 points, this point total would be 60+60+50, or 170 points. Seen in FIG. 5B are alternative or additional outputs 593 that may be shown in the notification 591. For example, instead of the alpha-numeric display shown in FIG. 5A, only a numerical display may be used (though the display in FIG. 5B does not add up to 170, so this is for a different game/user). The alternative output 593 may also provide a "hint" which provides a mathematical solution for reaching the optimum targets.

Figure 6:
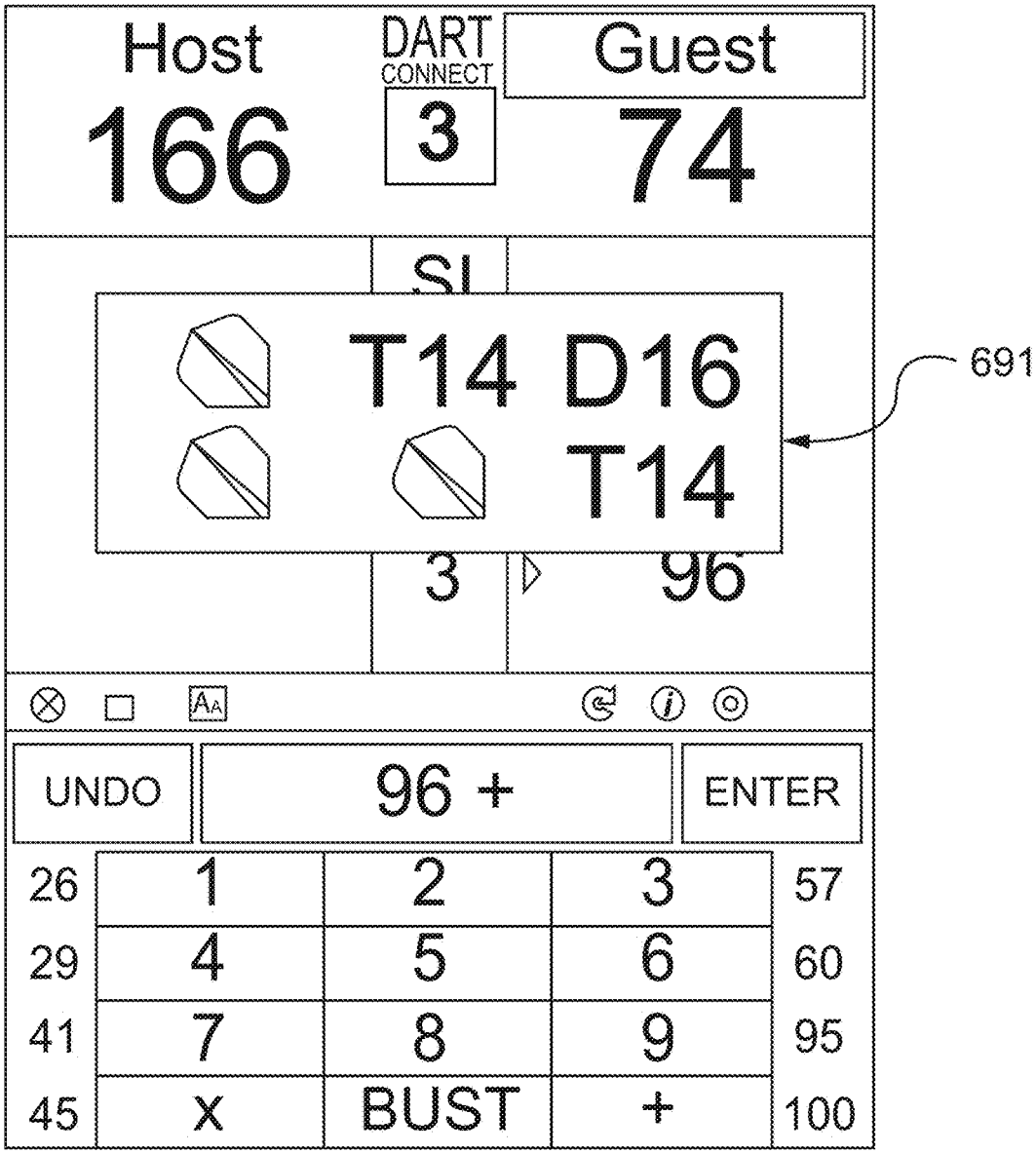
FIG. 6 depicts an assist notification according to one embodiment of the invention.

In one embodiment, suggested outs for an '01 match may be broadcast to one or more connected devices. The devices adapted to receive the suggested outs may be set up through the options 1919, as seen in FIG. 19. The suggested outs may be based on the current game score. For example, the system may utilize a network connection between the scoreboard 112, server 180, and remote devices to broadcast coaching tips to user device in real time or to assist a player with the current game. Such messages may be only displayed at an identified user device (e.g. the "host" device) and may not be displayed on a shared score board, which may also be referred to herein as a primary score board. In addition to the required out strategy for '01 games, additional examples of this feature comprise providing an additional number of point bullseyes required to win a game of Cricket. Alternatively, strategy tips may be provided to user for any game. As stated, such information may only be broadcast to a particular user, who may request it, which preserves the presentation of the game state on the primary device. Turning now to FIG. 6, seen is an assist notification 691 comprising a suggested out option provided to a user that has thrown a partial turn, but still has one or two darts to throw to complete his round. In such an instance, the user may click, for example, the "+" sign in the image below. This may display one or more suggested targets for each throw.

Figure 7:
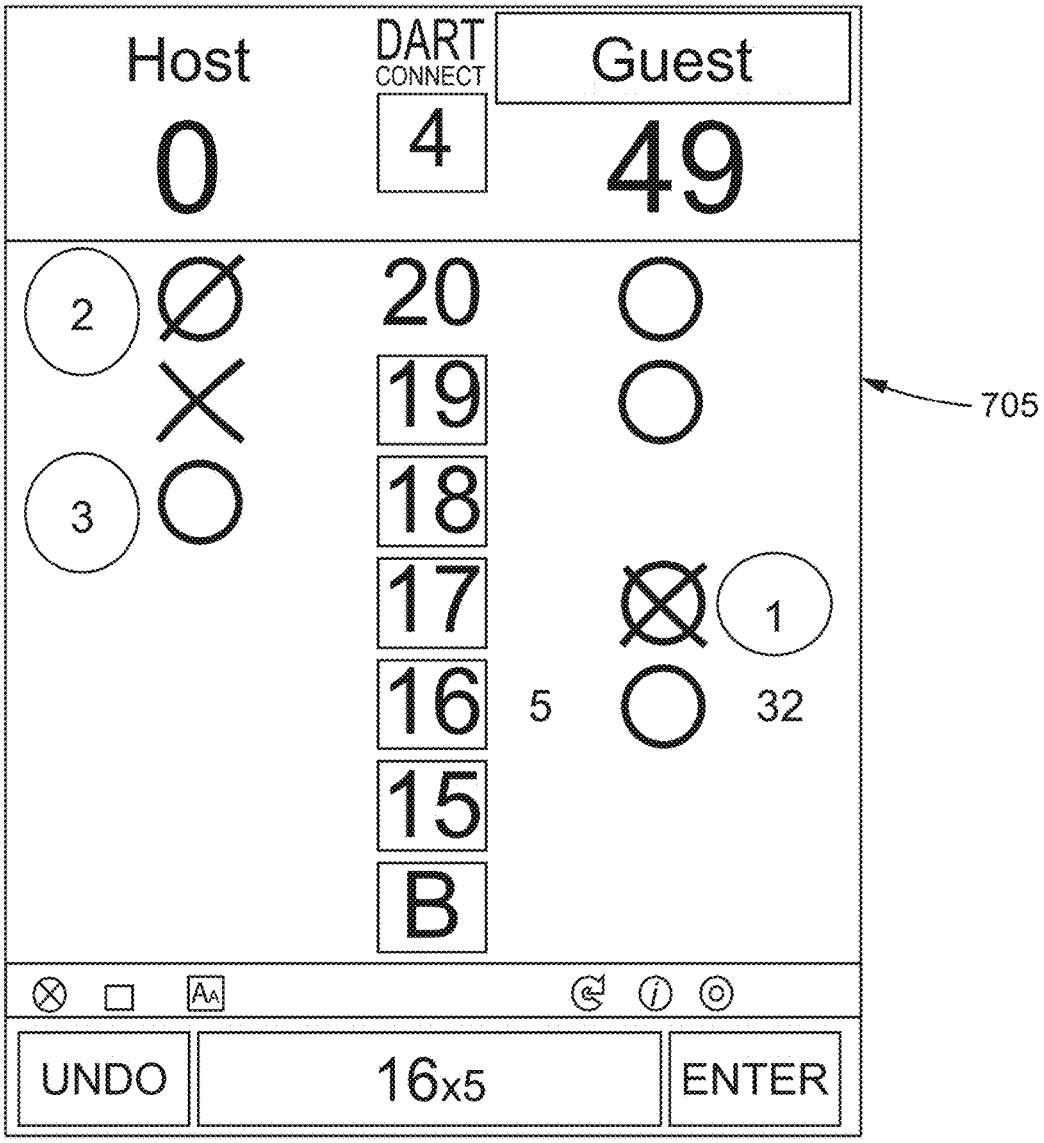
FIG. 7 depicts a cricket scoreboard according to one embodiment of the invention.

Turning now to FIG. 7, seen is a cricket scoreboard 705. As seen, the cricket scoreboard 705 uses a "/" or "slash," an "x," and an "O" identify a single hit in a single-point throw, a double-point hit in a single throw, and a triple-point hit in a single throw, respectively, on that number. The cricket scoreboard 705 also displays the exact throws which lead to three hits "O" mark. For example, the "1" bubble shows two slashes (an "x") and a circle. This is used for a user that hit the target over three separate turns. The "2" bubble displays a single-slash and a circle, evidencing that a player hit that target once in a prior turn (single slash) then connected again twice in a subsequent turn, with the additional two connections shown by the circle (a double target score portion of the mark was hit, for example). If the player hits a valid target three times in the same turn, then the closed target will be represented by a circle only, as seen in bubble "3."

Figure 8:
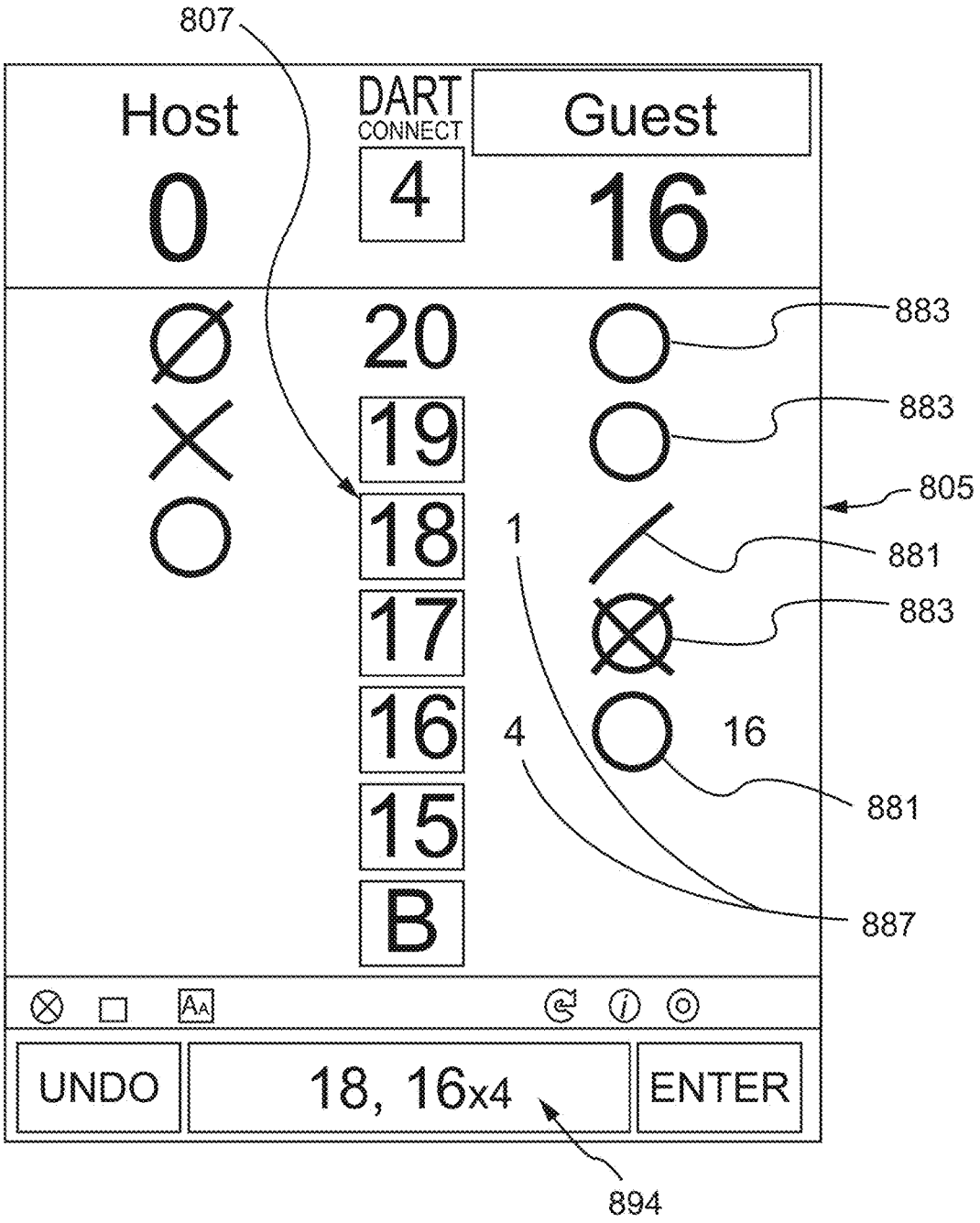
FIG. 8 depicts a cricket scoreboard according to one embodiment of the invention.

Turning now to FIG. 8, seen is one example of a cricket scoreboard 805 showing the redundancy in recording scores to ensure accuracy. For example, the current turn target "hits" 881 may be highlighted in a first color to differentiate current turn scores (marks) from pre-exiting scores 883 in a second color. Additional redundancy may be provided by displaying the number 887 of times a user has tapped the target button 807 for that target (tapping the target button 807 may be how a user identifies that the target was hit by a dart, thereby recording a score for that target). This number 887 is shown in FIG. 8 as the "1" & "4" next to the "18" and "16" targets, respectively. Furthermore, any target hit that results in points for the turn, is reflected in the margin for that target (note the "16" points) in the margin for the "16" target. Redundancy is further provided by listing all target entries for the turn in the score window 894 (note the "18, 16×4 times"). If a target has been "closed" by both players in prior turns (i.e., no further points may be obtained for either player for that target/number), the target may become visibly inactive (e.g., the "20" target button may comprise a darker color).

Figure 9:
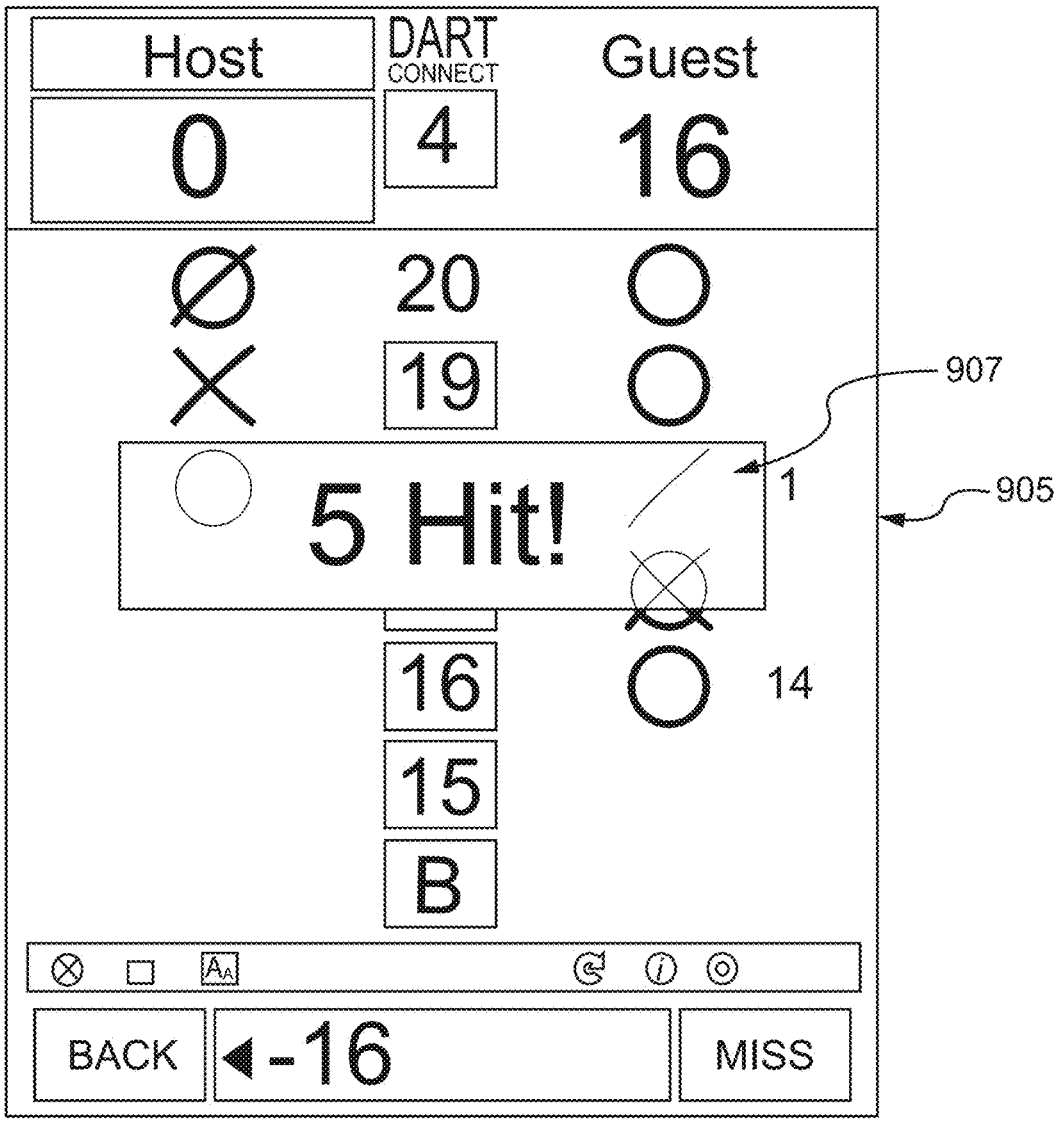
FIG. 9 depicts a cricket scoreboard according to one embodiment of the invention.

Turning now to FIG. 9, seen is what may happen after a turn has been submitted by pressing the "enter" button, as seen in FIG. 8. In one embodiment, the cricket scoreboard 905 may display what targets were scored on the previous turn (note the "1" and "4" in the margin). Exceptional or high-count turns may generate a pop-up fade-out message 907 calling out the nature of the accomplishment and to ensure the correct score was recorded.

Figure 10:
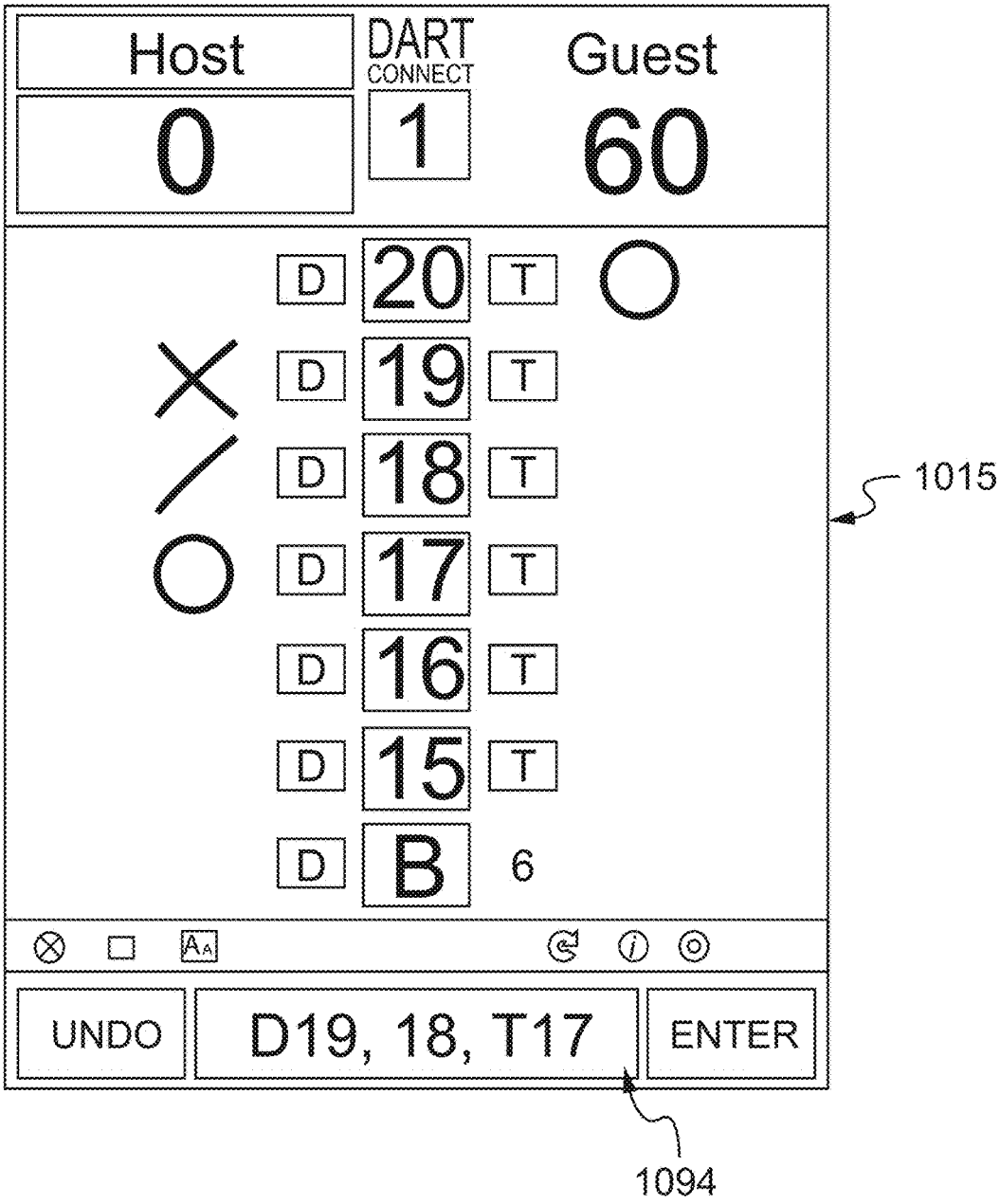
FIG. 10 depicts a marksman cricket scoreboard according to one embodiment of the invention.

Seen in FIG. 10 is a marksman cricket scoreboard 1015. The marksman cricket scoreboard 1015 comprises a 3-button ("D" button, target button, "T" button) approach to scoring cricket. The "D" button is for registering a double point score of the proximal Target Number and the "T" button is for registering a triple point score for the proximal Target Number amount. The Target Number registers a single target number score. This scoreboard 1015 may improve accuracy as the user avoids having to count and tap the Target Number multiple times for each hit that is a double or a triple. Furthermore, the score window 1094 displays exactly what was keyed. Speed of scoring may be increased since the maximum key stokes per turn is 3, as opposed to up to 9 with the approach seen, for example, in FIG. 9. Unique statistics may also be provided with the marksman cricket scoreboard 1015. For example, since the user informs the scoreboard 1015 what segment (single/double/triple) of each target the each dart actually hits (as opposed to the "roll up" scoring method associated with the standard FIG. 9 methods), specific statistics could be generated for this information, including, but not limited to, total missed darts (not just missed turns), total number of triple segments, doubles segments, single segments acquired, and targets hit but not scored due to opponent's existing position in the game. Such information may allow the user to know how many darts scored their full potential value or the average of potential value for each dart thrown.

Figure 11A:
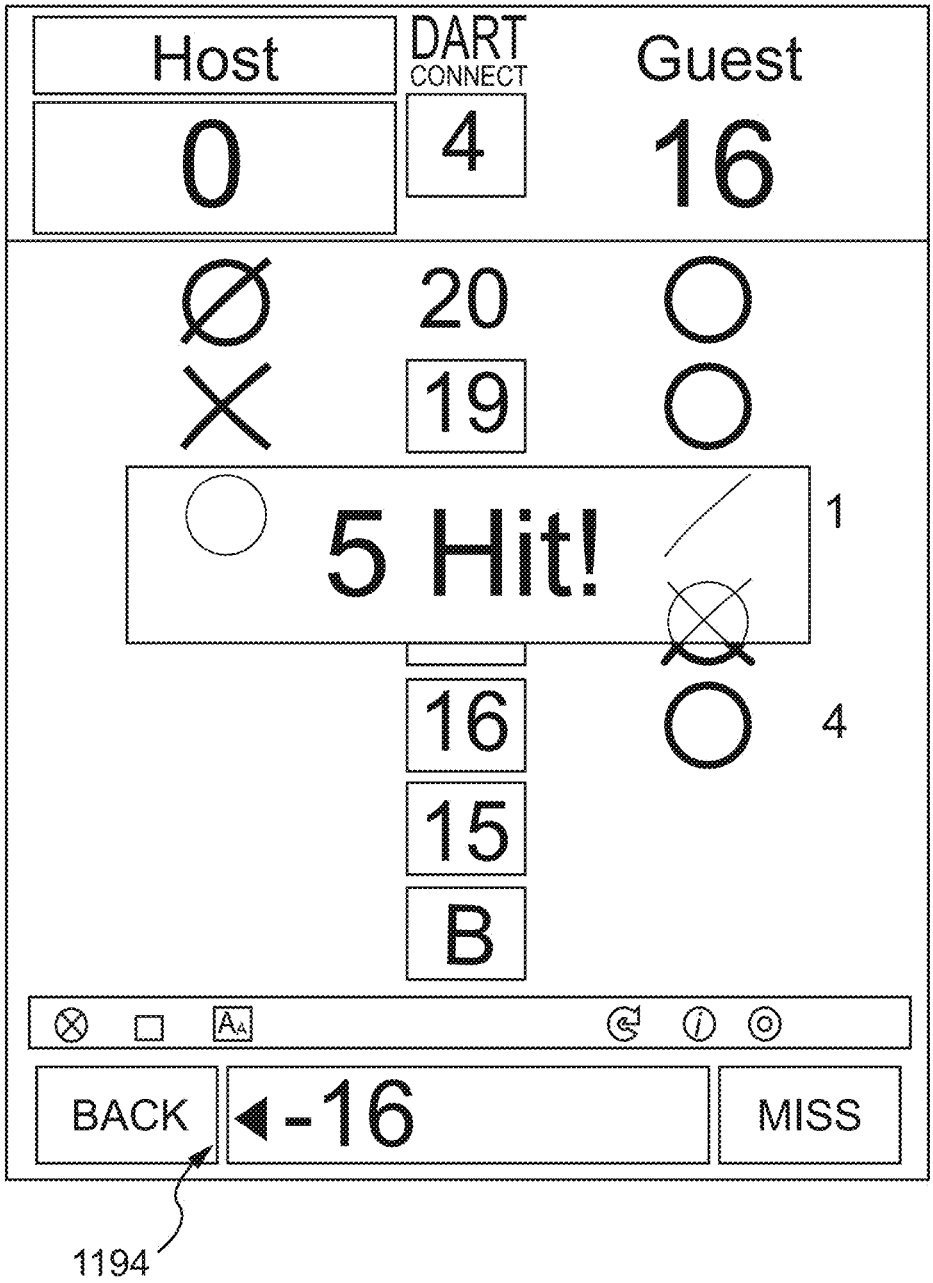
FIG. 11A depicts a hint that may be provided during cricket play scoreboard according to one embodiment of the invention.
Figure 11B:
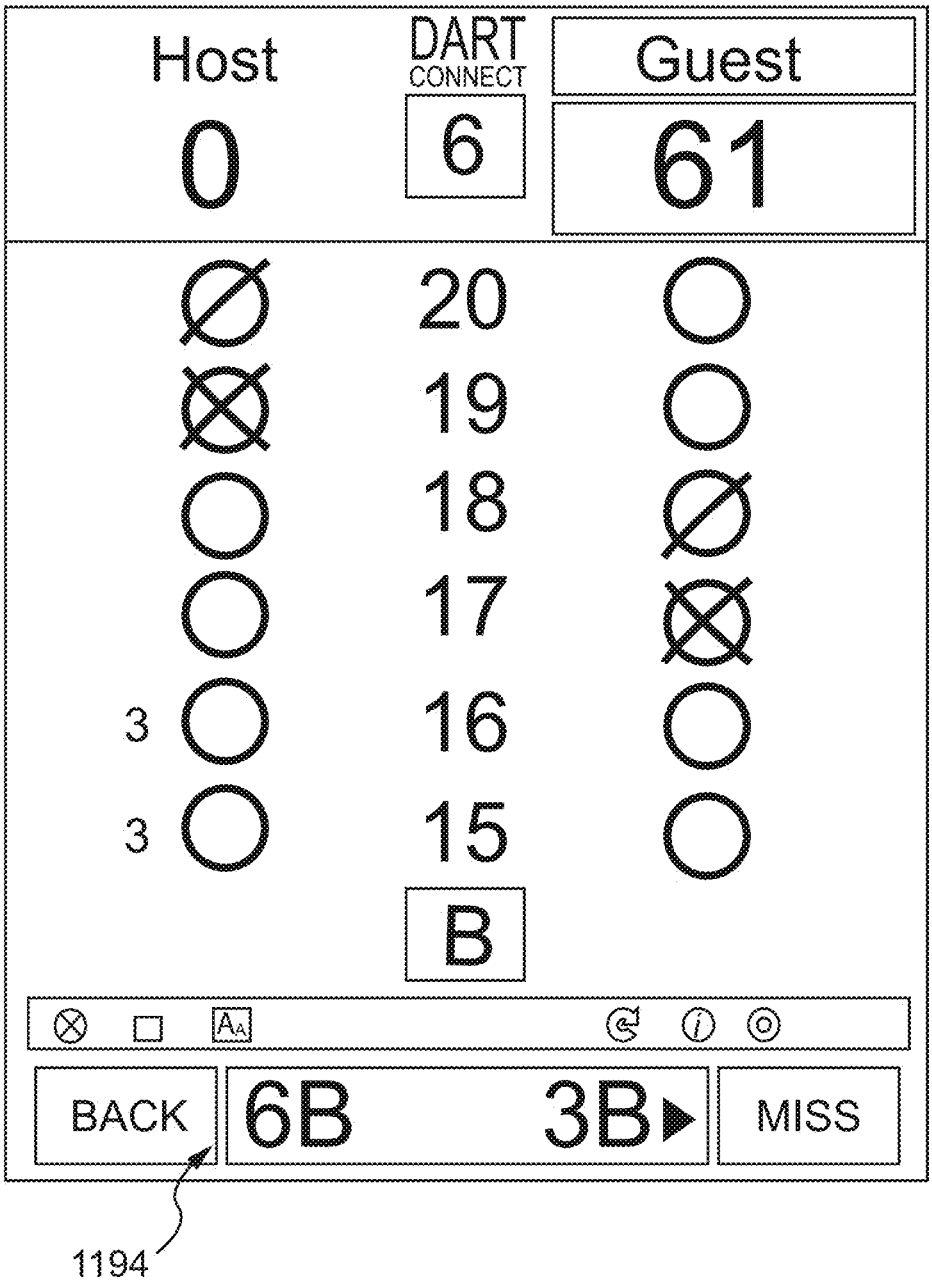
FIG. 11B depicts a hint that may be provided during cricket play scoreboard according to one embodiment of the invention.

Turning now to FIGS. 11A and 11B, seen are hints that may be provided during cricket play. In FIG. 11A the hint is shown in the score window 1194, informing the Host player that the player is behind by 16 points. In FIG. 11B, both players have closed out all their respective targets except the bulls-eye target ("B"). Rather than forcing each user to calculate the math value of the number of target bulls that are required for that player to win the game, the system calculates how many bull targets each player needs to hit to win the game. As seen in the score window 1194, the host player needs to acquire six Bull targets and the guest player requires only three bull targets to win.

Figure 12:
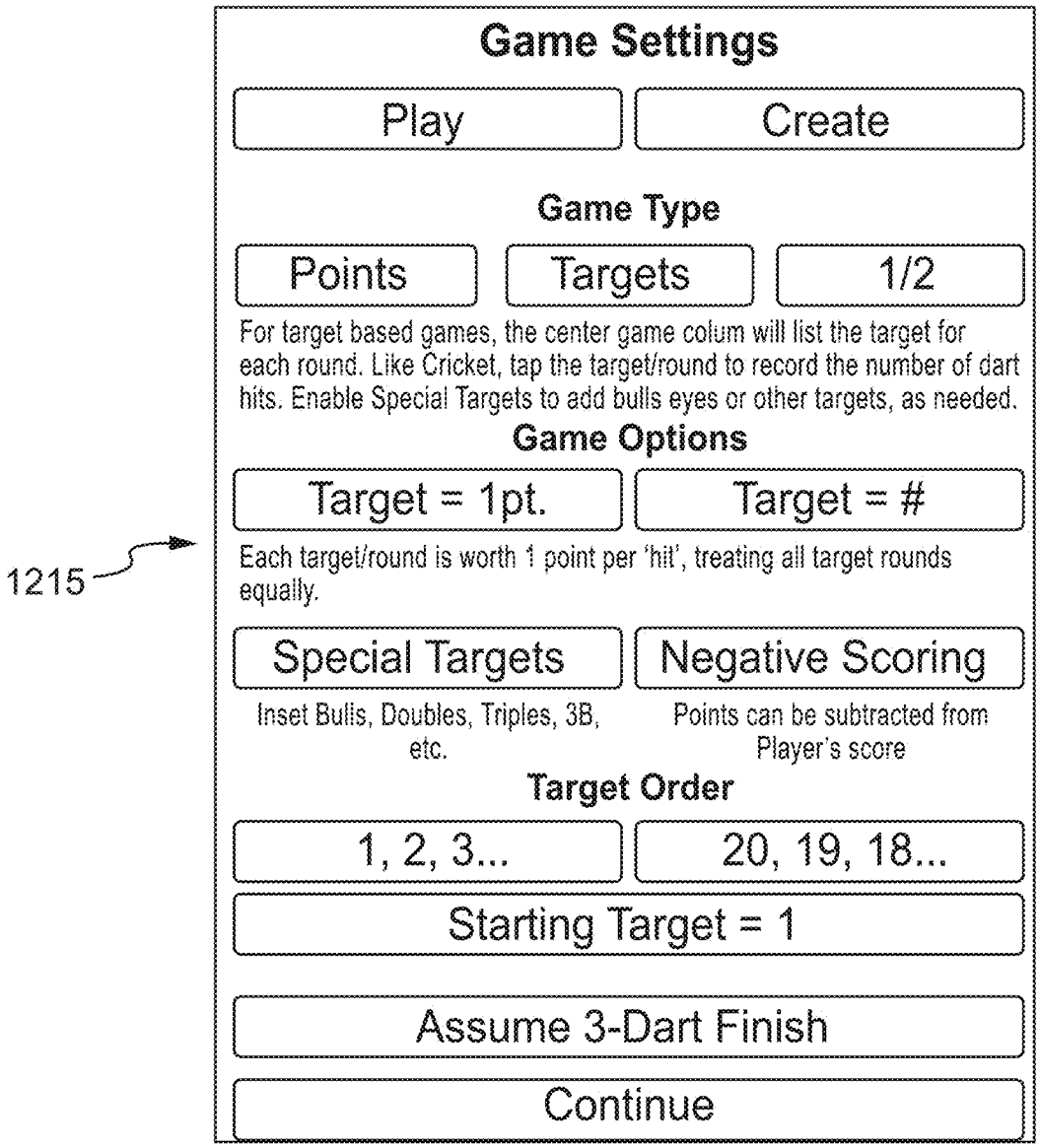
FIG. 12 depicts a game and practice generation screen scoreboard according to one embodiment of the invention.
Figure 12A:
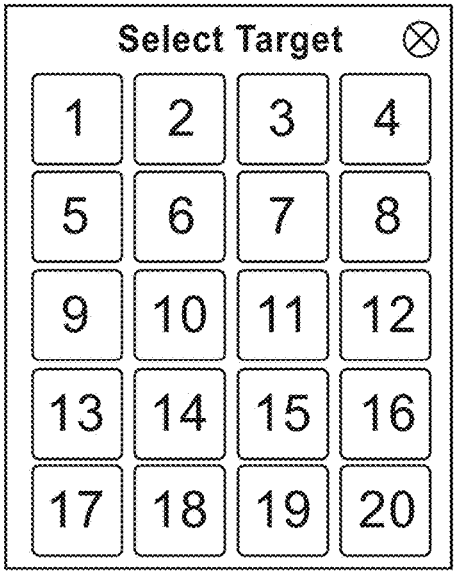
FIG. 12A depicts a game and practice generation screen scoreboard according to one embodiment of the invention.
Figure 12B:
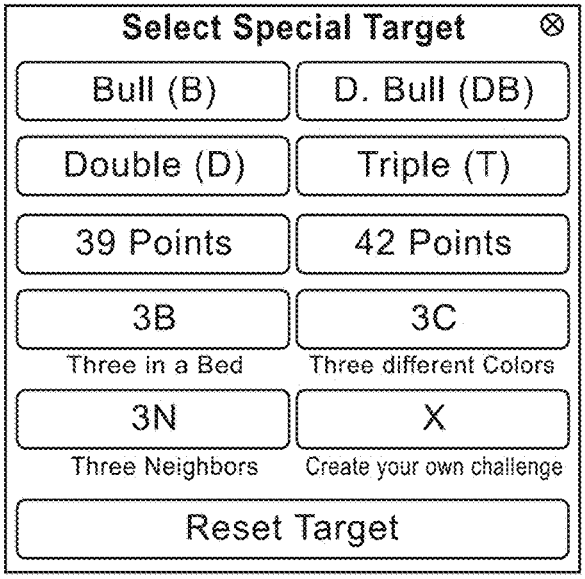
FIG. 12B depicts a game and practice generation screen scoreboard according to one embodiment of the invention.

Turning now to FIG. 12, seen is a game and practice generation screen 1215. The menu system seen in FIG. 12 enables a user to design a game or practice routine according to their personal preferences and rules. Games and routines fall into 3 general categories: (i) point-style games, (ii) half-it style games, and (iii) target-style games. Games & routines can be further customized with options including (a) Enable Negative scoring, (b) Assuming 3 Dart Finish, (c) Determining Target values, (d) Enabling inclusion of Special targets, and (e) Determining the Starting target. Created games and routines can be saved for future use. FIGS. 12A and 12B may also be used in creating the new games/practice routines.

Figure 13:
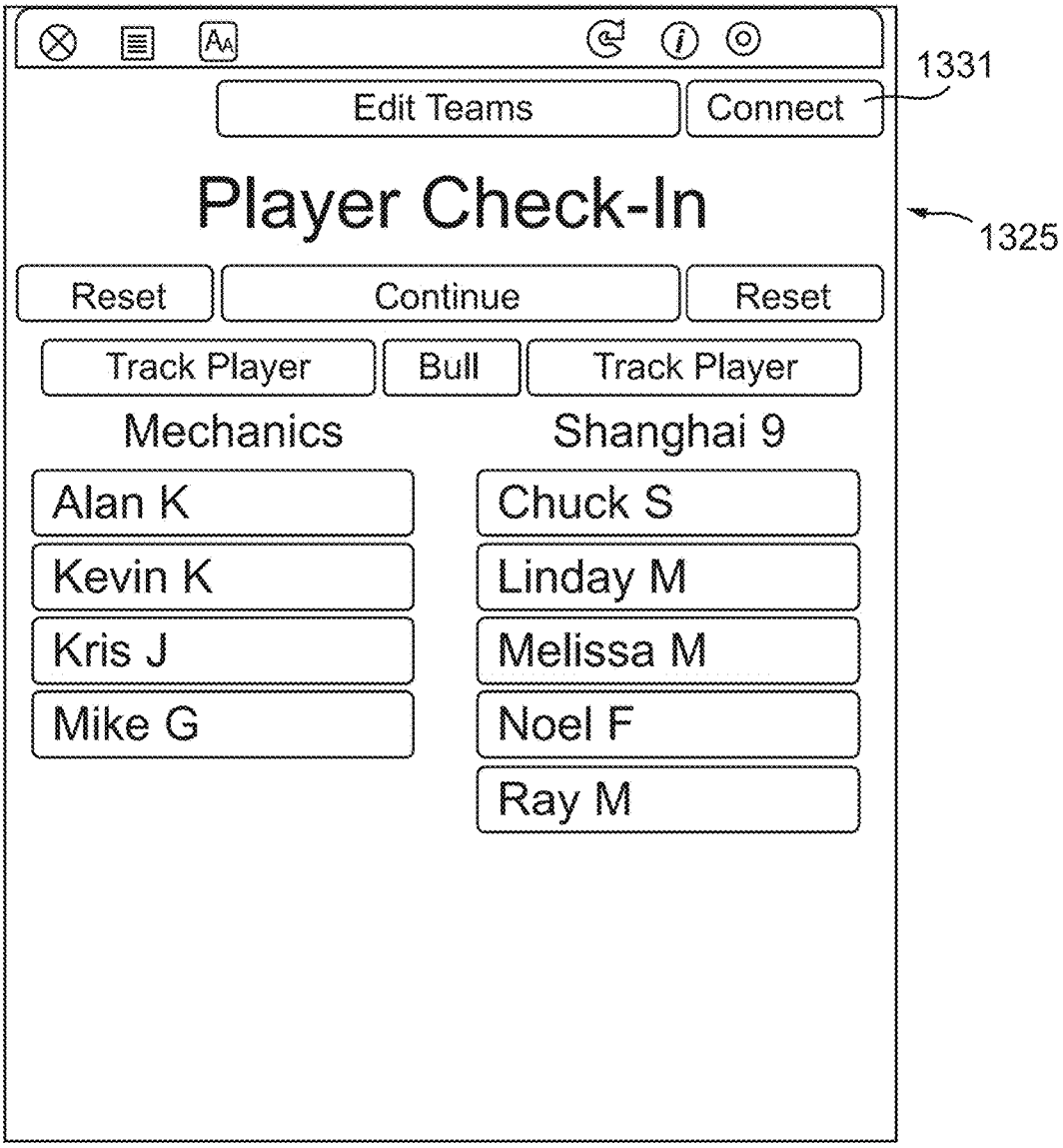
FIG. 13 depicts a Group/Team screen according to one embodiment of the invention.
Figure 14:
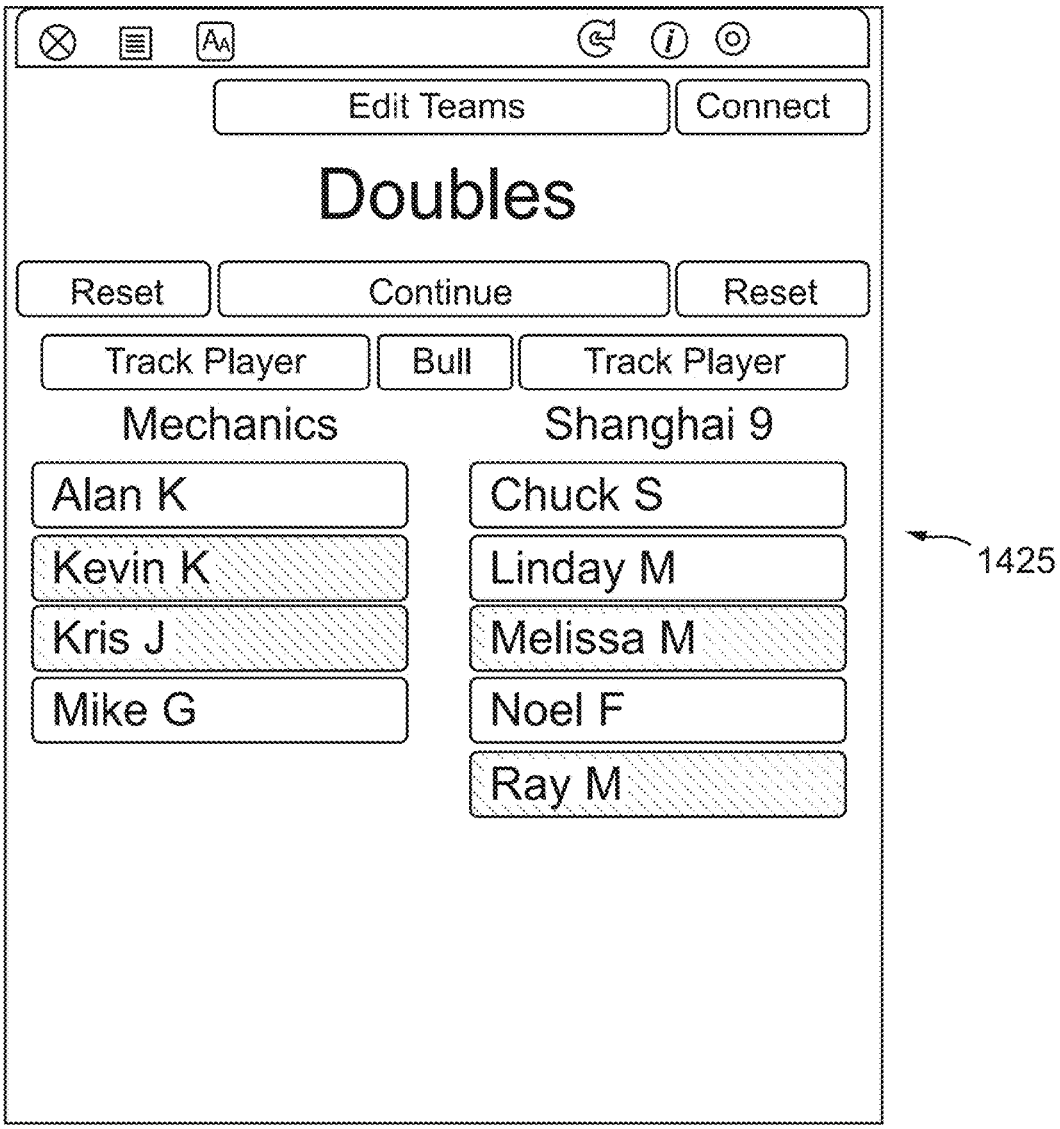
FIG. 14 depicts a Group/Team screen according to one embodiment of the invention.

Turning now to FIG. 13, seen is an example of a Group/Team screen 1325. The Group/Team screen 1325 provides the ability to easily run competing teams of 4-12 players (may have different number of player per team) in a multi-game match while also tracking their personal performance and updating their performance statistics in real-time without interfering with match play. The Group/Team screen 1325 sets up group play by eliminating traditional menus & software wizards. As players are selected for each game through the Edit Teams button, the screen 1325 will automatically change from singles to doubles, triples, etc. As seen in FIG. 13, one Group/Team screen 1325 may be adapted to select two teams for a match and display the team rosters. After selecting the players for each team, a match may be initiated by selecting the connect 1331 button. The connect button displayed in FIG. 13 comprises a similar functionality as the connect 2131 option in FIG. 21 and as seen and/or described elsewhere herein. The system 100 may record each player's turn in the order it occurred and automatically start a new set whenever there is a change in the player line-up. Through this feature, the system 100 is enabled to create a match summary populated with player names and their throwing order, while tracking individual performance—even when participating in group play (Doubles, Triples, Quadruples). The system 100 may inform the players to "Check In" before the next game commences As seen in the Group/Team screen 1425 in FIG. 14, the players or a third-party score keeper may select the opponents from each team, with the system 100 automatically determining what type of group play is occurring (Doubles in the FIG. 14 case). The system 100 may accommodate team number mismatches such as, but not limited to, Singles vs. Doubles, by automatically recording a "bye" (or miss) for the group that is short a player. Alternatively, the system 100 may rotate through each team, ensuring a team member is assigned to each round. The system 100 may also provide each opposing team how player data is displayed to the team members. For example, a Team Report may display team-related statistical data related to the match, tournament, league, and/or team history. A Group Report may provide data for an identified Doubles/Triples/Quads, etc. team. A Player Report may provide individual darts and accomplishments data, assigned to each player, regardless of whether they are involved in any team or group play. Examples of these reports may be seen in FIGS. 24 & 25.

Figure 15:
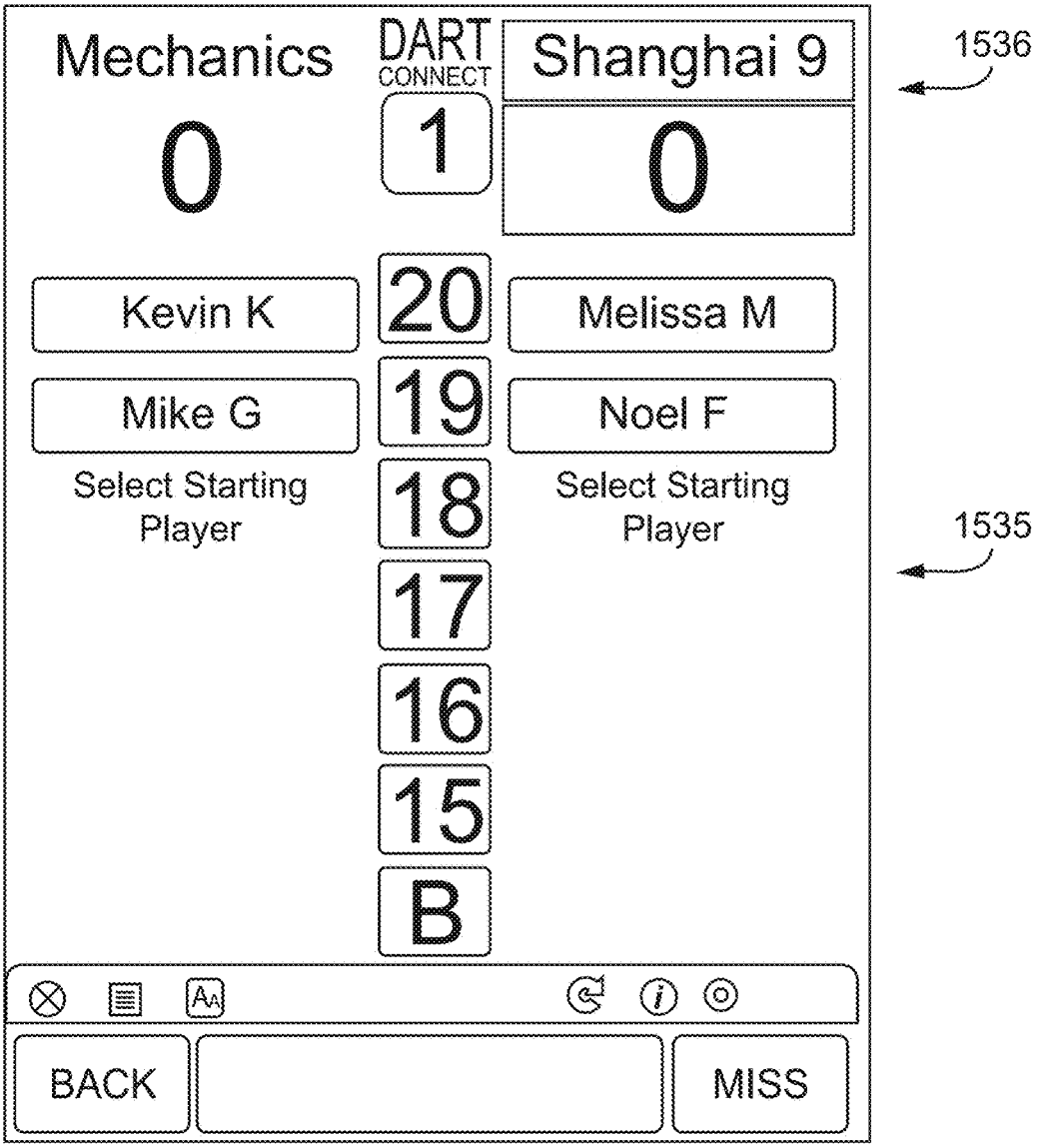
FIG. 15 depicts a game start screen according to one embodiment of the invention.

Turning now to FIG. 15, seen is how to select a starting player. After choosing the teams through the edit teams selection, selecting team members from each team to participate in the game from the team lists and connecting, the game start screen 1535 is shown. In the game start screen 1535, the selected players are listed and the user selects the play order for each group. This is done by touching or selecting each player in each team in the order which they will participate in the match. Selecting the player order allows the system 100 to assign the entered dart throw data and corresponding stats and achievements to each individual player, as opposed to a generic "pairing" or group. Dart throw data may be entered through one of the screens seen in FIGS. 4-11B, or any other screen, depending on the dart game being played. During group play, the system 100 alternates between opposing teams, listing which player is currently throwing. For example, the player name may be listed at the top 1536 of the screen in lieu of, or in addition to, listing the team name.

The system 100 may also create and provide custom menus for leagues and tournaments to reflect their exact format. One benefit of this would be fewer game set-up decisions (game type and options) that need to be made by the score keeper and players. When playing an accepted league format, upon launching the system 100 on a mobile computing device, players may be greeted with a simplified menu, such as, but not limited to, the menu 1626 seen in FIG. 16. Such a menu 1626 would substantially eliminate the need to format each game prior to game start. One such menu 1626 may display the league name 1627, acronym and/or logo to reinforce the league brand and assure users they are playing the correct format. Also listed are various game options 1628.

Figure 17:
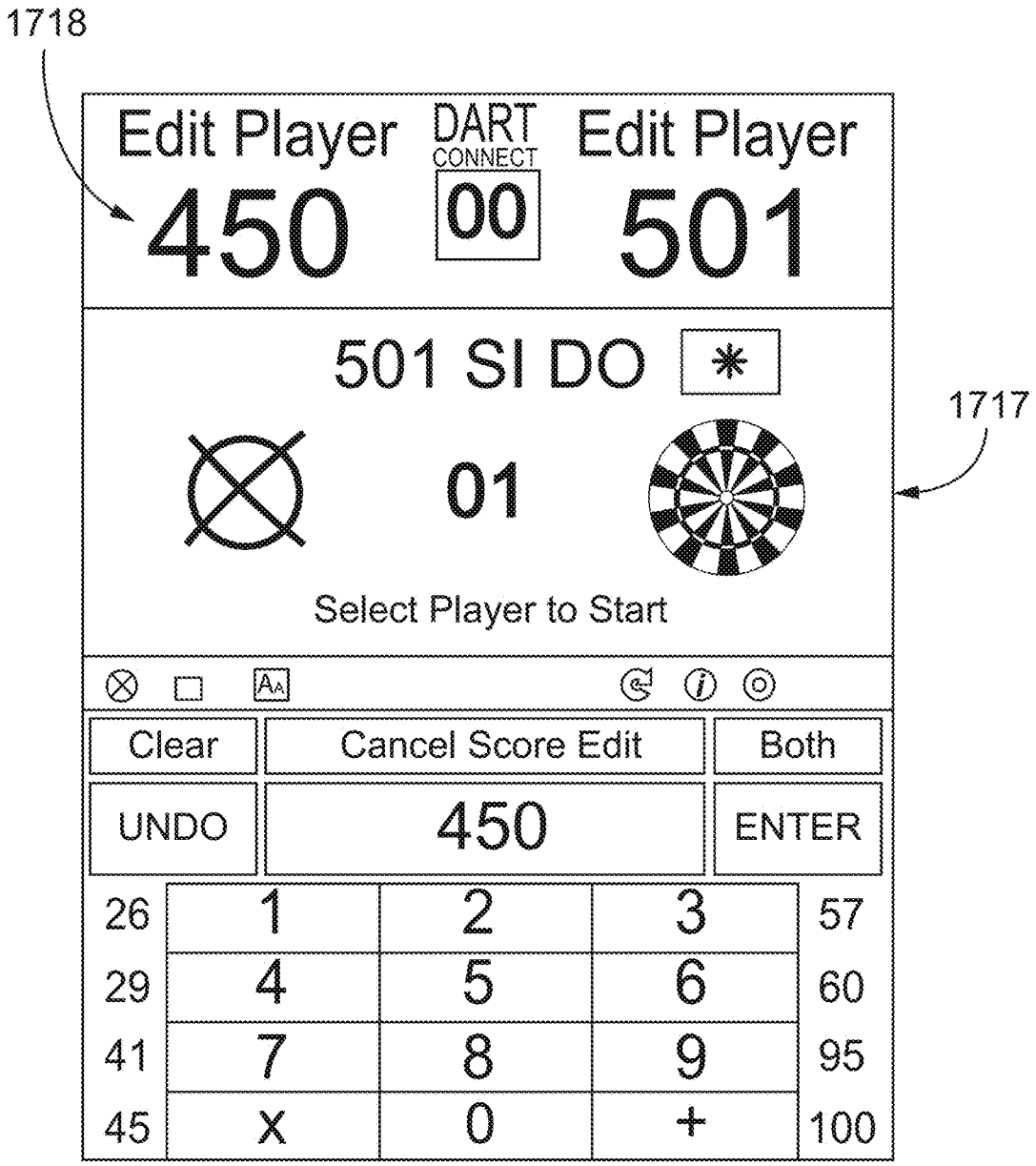
FIG. 17 depicts handicapping and custom scoring screen according to one embodiment of the invention.

Looking now at FIG. 17, seen is a handicapping and custom score chart 1717. Users have the ability with this chart 1717 to modify their starting score to create any custom game or to handicap one of the opponents. In one embodiment, prior to starting any game, a user can adjust the starting points, by simply tapping the starting score 1718 in the header. The system may allow you to input the starting total (point games) or pre-scored marks (cricket and target games) for either player. Users may also have the option of allowing the system to automatically determine the appropriate handicap for a given match up, based on their historical performance.

Figure 18:
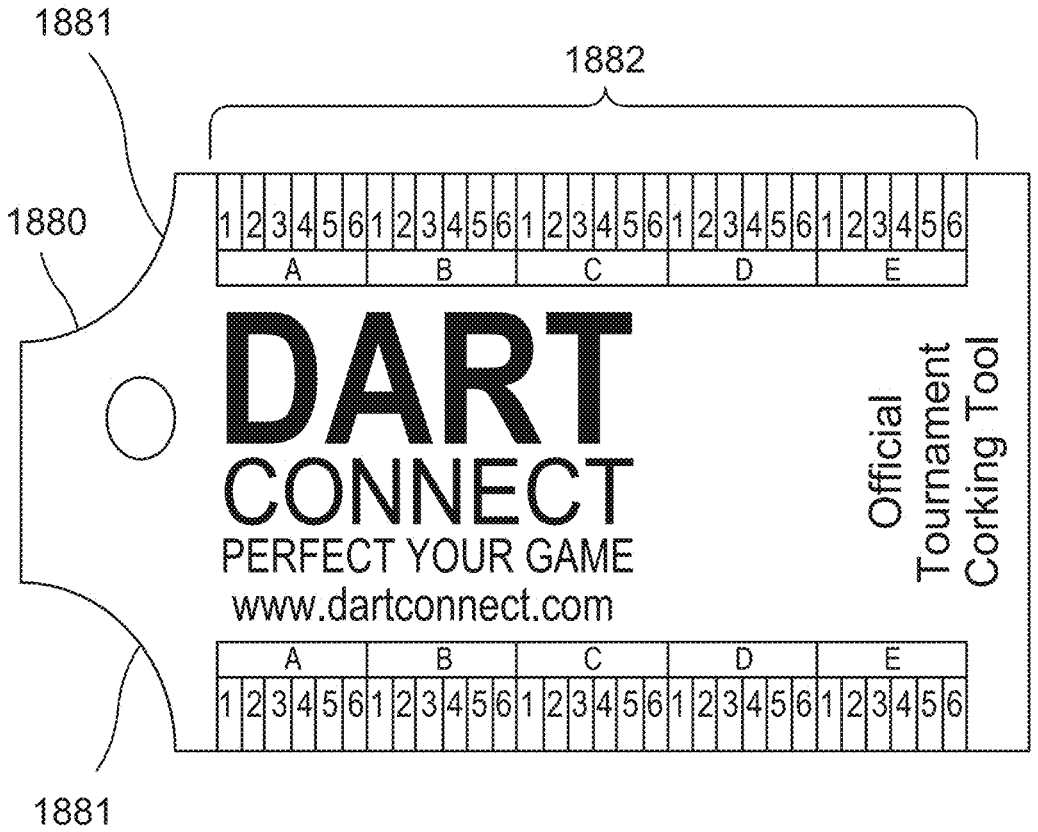
FIG. 18 depicts a corking tool according to one embodiment of the invention.

One system 100 seen in FIG. 1 may also comprise a corking tool 1880, as seen in FIG. 18. Such a tool may be used to determine who throws first in a dart game. Prior to game play, each player often throws a single dart at the bulls-eye of a dart board & the player with the closest dart throws first. In order to determine who is the closest to the bulls-eye, the corking tool 1880 seen in FIG. 18 was created. The arcs 1881 on the corking tool 1880 are shaped to align with the outer ring on the bulls-eye of a dart board. Using the measurement markings 1882 along the edges of the corking tool 1880, a user may determine what distance the dart is located from the outer ring of the bulls-eye, and compare such distance with a distance of another player, potentially playing from a remote location. As seen, the measurement markings 1882 are divided up into six lettered sections (A-D), with each lettered section being divided up into six separate numbered sections (1-6). The player with the smallest distance to the bull eye would throw first.

Figure 28:
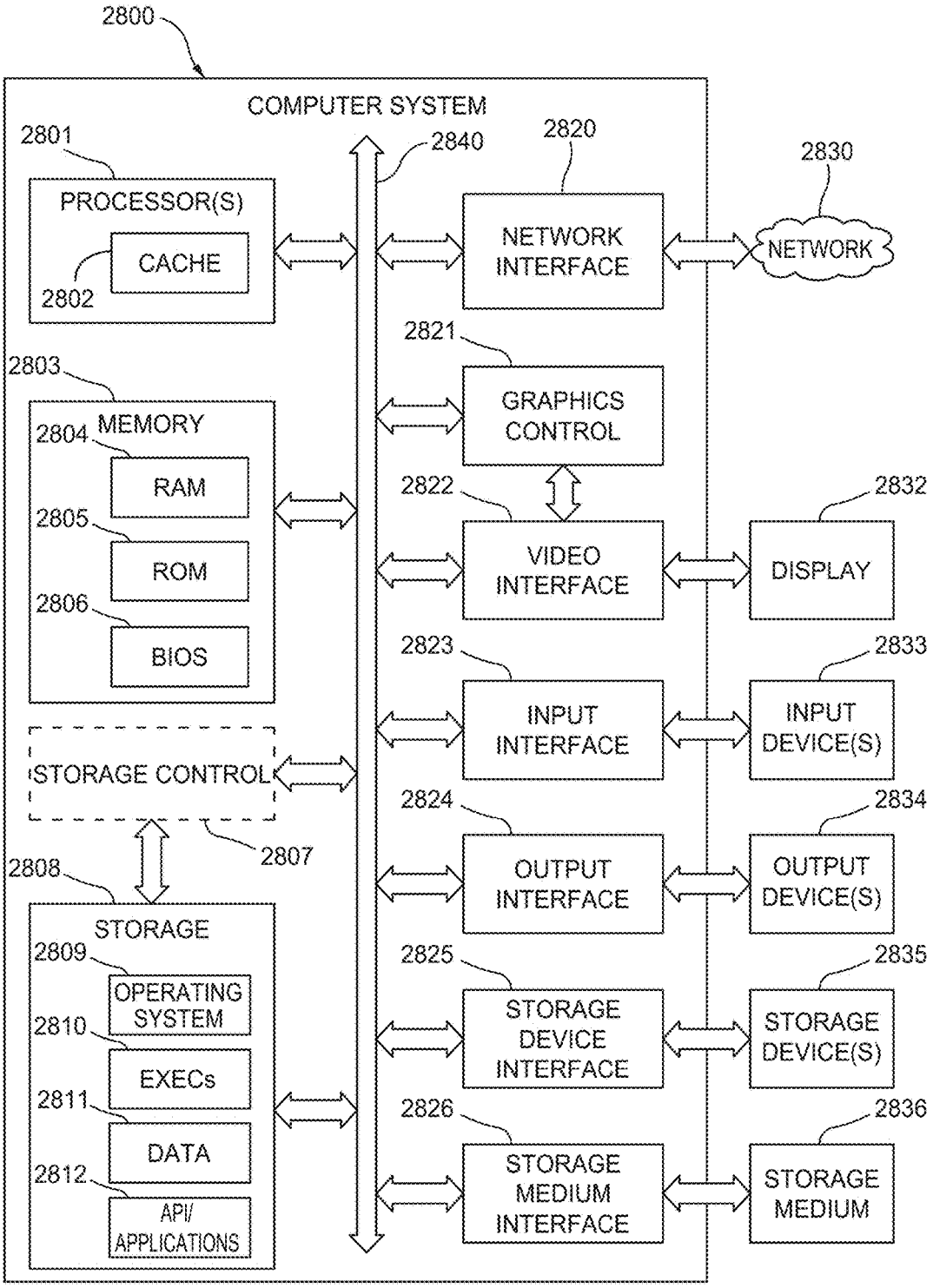
FIG. 28 depicts a diagrammatic representation of one embodiment of a computer system according to one embodiment of the invention.
Figure 29:
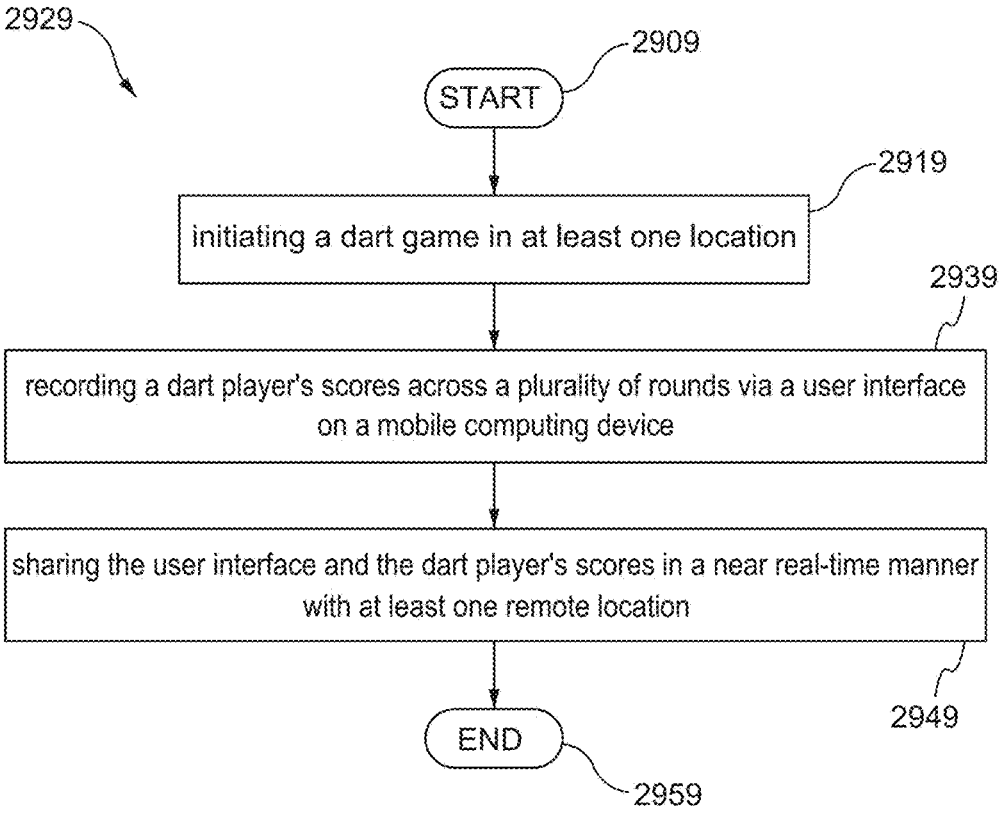
FIG. 29 depicts a method according to one embodiment of the invention.

Turning now to FIG. 29, seen is method 2929 of conducting a dart game. The dart game referred to in method 2929 may comprise any of the dart games referred to in any of FIGS. 1-28 such as, but not limited to, '01 and cricket. One method starts at 2909 and at 2919 comprises initiating a dart game in at least one location. For example, the location of the scoreboard 112 may comprise such a location. At 2939, the method comprises recording a dart player's scores across a plurality of rounds via a user interface on a mobile computing device. For example, the user interface may be any of the scoring interfaces described above such as, but not limited to, the '01 interface seen in FIG. 4 or the cricket interface see in FIG. 7. At 2949, the method 2929 comprises sharing the user interface and the dart plyer's scores in a near real-time manner with at least one remote location. Such a remote location may be the off-site devices 120 seen in FIG. 1.

Although not explicitly listed in FIG. 29, it is contemplated that the user interface in the method 292 may comprise a first display screen, with the first display screen comprising a game creation option, a game join option, a game share option, and a game watch option. For example, and as seen in FIG. 20 is the launch screen 2050, which may comprise the first display screen. Through the launch screen 2050, as use may create a game through the "play" feature (i.e., a game creation option), may join a game through the "connect" 2131 feature (or as otherwise described herein) after selecting any of the league, play, or another other of the options on the screen 2050, and may comprise a game watch option.

Whatever dart game is chosen may comprise a first dart game. One method 2929 may further comprise initiating a second dart game. For example, the first and second dart games may be related to a league and/or event/tournament, as seen in FIG. 20. One or more statistics may be obtained for the first dart game and the second dart game (as well as any additionally-related dart games, as identified by the player in the user settings 1919 or otherwise), aggregating the one or more statistics from the first dart game and the second dart game into a plurality of statistics for the dart player/league/tournament/event, and ranking at least a portion of the plurality of statistics for the dart player against one or more additional dart players/leagues/tournaments/events.

The method 292 may further comprise providing match summary information to the dart player upon conclusion of the match—for example in a message with a link as shown in FIG. 26. Game detail information may be provided to the dart player upon conclusion of the match. Player performance information may also be provided to at least one of the dart player and the at least one remote location one of during the match and upon conclusion of the match. Such information may be seen in FIGS. 25, 26, as well as FIGS. 9, 5, and 6. Further methods 292 may comprise storing the dart player's scores related to each of the plurality of rounds in the server 180, choosing to play a game against game stored in the server, and/or utilizing a server device to share the user interface and the dart player's scores in a near real-time manner with at least one additional location.

Another aspect of the disclosure pertains to systems and methods for integrating the scoring application with systems for managing tournament brackets. Some software programs exist for managing the match-ups within sports tournaments, including dart tournaments. Such programs may be referred to herein as "electronic bracket programs," or simply "bracket programs." The present disclosure provides an electronic bracket program that interacts with the dart scoring application to create a comprehensive electronic tournament scoring and management system. The disclosure also provides application program interfaces (APIs) to allow the dart scoring system to integrate with existing electronic bracket programs. The APIs of the present dart scoring system provide several features and functions that facilitate the management of dart tournaments.

Historically, steel tip dart competition has been conducted with a multi-part paper ticket based system, using one part to operate the bracket, one part to accompany the players as they proceed to each match assignment, and the last as proof of event registration. Such paper systems are inherently prone to errors and delays, since they are filled out by hand, manually numbered, and continuously change hands between staff and players. Sometimes, slips go missing or become duplicated.

The APIs coordinate an electronic bracket program (including the one provided in the present disclosure and third-party programs) with the connected match scoring system described herein, which provides a level of service to players, spectators and staff that has not previously been available for events and tournaments. The APIs enable an electronic bracket program and dart match scoring software to communicate critical information with each other, simplifying the operation of each, reducing event staffing and the need for operational expertise with both programs. In addition, the overall system provides players and fans public access to all aspects of the tournaments, so they can locate individual matches, peruse bracket standings, or review results.

Figure 30:
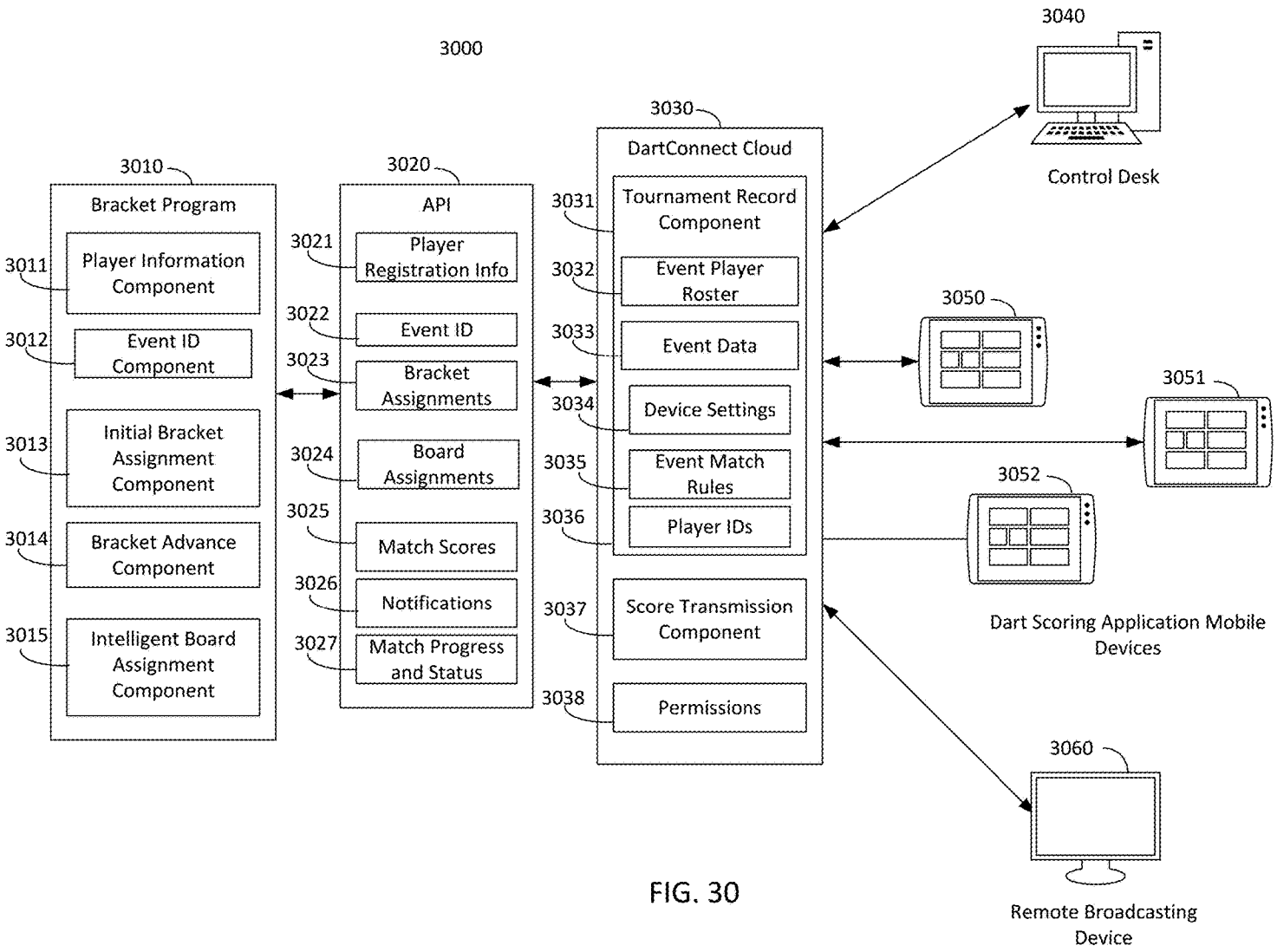
FIG. 30 depicts a logical block diagram of an integrated dart scoring platform for managing tournaments.

FIG. 30 shows a logical block diagram of an integrated dart scoring platform 3000 (which may also be referred to as an integrated dart scoring system) for conducting dart tournaments of the present disclosure. The diagram should not be construed as a hardware diagram, and may be implemented in software, hardware, or a combination of software and hardware. The system 3000 comprises a bracket program 3010. One function of the electronic bracket program 3010 is to provide an interface for collecting player (or team) information, which may be implemented by a Player Information Component 3011. For the purposes of a dart tournament, player information including a player name, player ID (e.g., an ID number assigned to members of sporting associations), and a player e-mail, may be entered upon registration in a particular tournament. Bracket programs can generate complete player rosters for a particular event and create an event ID (or competition ID) through an Event ID component 3012. A main function of an electronic bracket program is to create matchups of players out of the roster, based on the competition structure of the tournament, which may be implemented by an Initial Bracket Assignment Component 3013. For example, players on the roster may be placed into a single- or double-elimination competition format, or may be placed into round-robin pool play before being placed in single- or double-elimination rounds. Placing players in such brackets manually can be time-consuming and confusing, especially when there are large numbers of players. It can be even more time-consuming and confusing to manually advance players into different stages after wins and losses, which is why existing electronic bracket programs create the initial placements and advance players automatically when they win or lose. The automatic advancing of players may be implemented by the Bracket Advance Component 3014. The bracket program of the present disclosure provides these functions, but also provides unique features to facilitate the interaction with the dart scoring application.

Several features of the bracket program of the present disclosure also make it easier to manage tournaments. One such feature includes dashboard indicators to create calls to action for a bracket operator. Another is a list view of the bracket to provide a simple action list for the bracket operator. Yet another is a system for creating a printable mailing label or other small paper document system that expedites the pairing of players and board assignments in the correct initial event board call process to expedite the running of the event. This is especially helpful for "Blind Draw" events, which, in a paper based system, require a multi-step process:

First, staff must match all the individual player entries with a partner randomly, creating a doubles team. Then, staff must then randomly match each doubles team with an additional doubles team. Then, the match assignments are organized into a board assignment call order.

With previous paper-based systems, written entry slips are spread out on a large table to create an initial match of paired teams. Then, a secondary match is performed to create the competitions, and then they are organized according to preferred board call assignment. The presently disclosed bracket program combines all three steps into one succinct process, that allows a bracket operator to print the board call slips, with the proper partners and opponents in the order they are to be call. Printing can occur on cards, full sheets of paper, or mailing labels. This feature reduces a 30-minute (or greater) process into an approximately five-minute process. Mailing labels allow the staff to reuse the original submitted paper entry slips.

To utilize a bracket program (either the one of the present disclosure or a third-party bracket program) for a tournament, participants register once for the entire tournament, creating a player record that is aggregated into the Master Player Roster. Each player is then eligible to enter into individual event competitions. Individual event competition may include, for example, women's only, men's only, one game type only (e.g., either cricket or '01), multiple game types, singles, doubles, etc. The Master Player Roster comprises the player information for any player who registers a to play in at least one event throughout the tournament. An Event Player Roster (or simply "Event Roster") is comprises just the player information for players competing in one particular event. There may be multiple Event Rosters within a Master Tournament Roster.

Once a player enters an event through a registration process, the bracket program can either automatically import the eligible players for the event, or the tournament staff can manually enter and/or select participants. The bracket program then organizes the competition and provides a dart board assignment for each of the initial match(es) between players. In prior approaches, paper tickets would then be used to score the matches and the scores and winners would have to be manually entered in the bracket program, which would typically be run at one, or at most, a few computing devices operated by tournament administrators or staff. The integration system of the present disclosure allows the scoring to be done electronically, through computing devices at each board at which a match is being played that execute the dart scoring application of the present disclosure, and transmitted in real time to the bracket program via the cloud server application 3030. The cloud server application 3030 may be the same cloud server application referred to previously throughout this disclosure.

The bracket program 3010 can then advance players automatically based on the transmitted scores from dart scoring application mobile devices 3050-3052, rather than wait for manual entry of scores and winners. The transferring functions between each of the computing devices and applications depicted in FIG. 30 are performed by one or more APIs, depicted in FIG. 30 as API 3020. As will be described throughout this disclosure, the API(s) 3020 allows the transfer of information back and forth between the bracket program 3020, cloud server application 3030, and the mobile devices 3050-3052, the control desk(s) 3040, and the remote broadcasting device(s) 3060. As depicted, this information includes, but is not limited to, player registration info 3021, event ID 3022, bracket assignments 3023, board assignments 3024, match scores 3025, notifications 3026, and match progress and status 3027.

The integration system 3000 also allows spectators to view scores and tournament standings at one or more remote broadcasting devices 3060 for matches in progress in real-time. The present disclosure has previously described how individual matches may be viewed by spectators when broadcast publicly or with a private key; the integration system adds the ability for spectators to view multiple match scores within a tournament and the live tournament standings themselves. Additionally, the integrated scoring system 3000 may include a control desk interface 3040, on which certain functions for tournament administrators and staff may be displayed. It is contemplated that, in some embodiments, a separate device may not be required to implement the control desk interface 3040, and it may be displayed, instead, on a screen of a device that is running the dart scoring application.

Still referring to FIG. 30, to set up a tournament once players have been registered, a bracket program 3000 may first provide player registration information 3021 to the cloud server of the dart scoring application. The bracket program sends an Event ID 3022 (also known as a "Competition ID"), and a complete Event Player Roster, which includes at least a Player Name, Player ID, and (optionally, though not required) the Player e-mail of each player on the Event Player Roster. Then, the cloud server application, via a Tournament Record Component 3031, develops a Tournament Record, which adds, based on the Event ID, the following information: a Tournament ID (for login purposes) Event Data, Device Settings, Event Format (which provides designations indicating whether the event is Elimination, Round Robin, Set Play, Win by Two, etc.), and Match Instructions (which provide actual instructions like Cork for Start, number of legs, alternate, etc.), and optionally, a Player ID associated with the scoring application.

Turning to FIG. 31, the Device Settings may be visible on a settings screen 3100 of the dart scoring application that show which functions that may be accessible or inaccessible to scorers depending on the Match Rules, as shown on the match rules screen 3150. The device settings screen may highlight what features of the scoring application will be visible during game play and scoring. It may be configurable by a scorer, or frozen, depending on the tournament rules. Event Match Rules shown on the match rules screen 3150 may include, for example, the eligible games for the match, the starting rules, the number of legs to be played, etc. As shown in the match rules screen 3150, the applicable match rules are highlighted and the others are grayed out. Depending on the embodiments, scorers may or may not be able to alter these settings.

Referring back to FIG. 30, mobile devices 3050-3052 with the dart scoring application may associate with the tournament by logging in (e.g., entering the Event ID on a screen) to the dart scoring application. Any device (including the control desk 3040, the mobile application scoring devices 3050-3052, and the remote broadcasting device 3060) associated with the tournament may then receive, from the cloud server application 3030, the Tournament Record 3031, which comprises the complete Event Player Roster 3032, the Event Data 3033, the Device Rules 3033, the Event Match Rules 3035, and any associated Player IDs 3036 (including any player association IDs and scoring-application-specific IDs). In some embodiments, only selected information may be sent to each computing device depicted, based on permissions set at the permissions component 3038 at the cloud server application.

The scoring system is intended to maintain wireless connectivity throughout the competition, so that board assignments, scores, and other information may be transmitted back-and-forth between the scoring devices, the cloud server application, and the bracket program. However, several features of the system provide backup and redundancy features to preserve information if network connectivity is lost. One of those features is that each device, once logged into the tournament, receives the Tournament Record and Master Tournament Player List and keeps a copy of it locally. This feature ensures that, once the device has logged into the tournament, it has at least all the assigned and scheduled matches at the proper boards. If, for example, network connectivity is lost after a few matches have been played, and the board assignments are no longer being updated to the device in real-time, the dart scoring application will still be able to pull up a list of correct possible match-ups at particular boards, and may be used to manually select players from the master tournament list if absolutely necessary.

The Tournament Record 3031 is also transferred from the cloud server application to the bracket program itself through the API 3030. To continue setting up a tournament, the bracket program 3010 may then use this Tournament Record 3031 to create a board assignment for each match. Creating a bracket in order to figure out how to advance players and create match-ups is a first component of setting up a tournament; assigning the boards on which those matches are to take place is another endeavor. "Boards" may also be referred to as "dart alleys," and may be identified by numbers. For example, the first two players may be assigned to Board 1, the second two players to Board 2, etc. In the past, tournament staff set up board assignments manually, which was a very cumbersome and confusing process. Some bracket programs have recently developed board assignment tools. The bracket program of the present disclosure provides an advanced "intelligent board assignment" system (depicted by component 3015) to further improve the process.

In general, the process of board assignment in any tournament is accomplished by first creating a list of eligible events. Each event can import a player list or be manually populated from the master player list. After the bracket program organizes the competition for a specific event, the bracket program creates a Match ID for each individual player vs. player competition, associating it with the Event ID and Tournament ID. The final step is assigning a dart alley (board assignment) where the competition will take place. The cloud server application electronically notifies participants (for example, via e-mail, text message, push notification, or any other suitable electronic communication) of their board assignment, as well as publishing an electronic master list on viewing screens of the display system (e.g., the dart game display system referred to in FIGS. 2A-2C).

One of the fundamental challenges of running a steel tip dart tournament is that there are a limited number of playing fields (dart alleys), with potentially hundreds of players, that are being used by multiple events at the same time. Depending on the event format and match rules, the dartboards can turn over every 10-15 minutes.

No matter what kind of system is used to facilitate a dart tournament, it is the goal of tournament staff to continuously assign as many boards as quickly as possible, without assigning multiple live matches to the same dart alley for certain events. In some event formats, though, multiple matches may purposefully be assigned to a single dart alley with the intention that they are to be played sequentially. To enable the continual assignment of boards without assigning multiple matches at the same time at the same boards, the bracket program must have a board management system, which is at the tournament level, and not at the individual event level. This allows the board management system to manage which boards are currently available (not being actively played on) and to enable tournament staff to develop individual board assignment guidelines for each event.

For instance, in a singles competition event, staff may want to assign every available board. In a team event, staff may choose to assign every other board, or only even/odd boards to allow for additional physical spacing for the multi-player teams (since boards are often placed close together). Staff can also designate a range of dart alleys that are eligible for an individual event. For example, a particular event may have a board assignment guideline of "even numbered boards only, from 2 to 20," out of a total of 50 available. In prior approaches, assigning boards in this way has been done manually and has been cumbersome to implement.

These guidelines are typically set before the tournament begins, but may be updated as the tournament continues. In embodiments of the disclosure, the event board assignment can either be "absolute" or a "guideline". When it is a guideline, each event bracket operator may view the total list of available dart alleys (those not being currently utilized by an active match from any event). However, the preferred dart alleys for the particular event the bracket operator is running may have a primary color designation, while the remaining ones are monochromatic. This allows the bracket operator to readily identify recommended boards, yet select any available board, should the need arise. In contrast, if an event board assignment is absolute, the designated boards do not appear in the list of boards that other bracket operators can view for their respective events.

The intelligent board assignment system of the present disclosure (depicted in intelligent board assignment component 3015 of FIG. 30) enables the assigning of multiple available boards at once. This system alleviates a large challenge for tournament management which is made apparent at the start of each event. A large event can have more than 50 dart alleys, and it is the goal of tournament staff to facilitate the board assignments as quickly as possible once the initial event draw is done. Assigning each board individually creates a time delay that prevents the event from getting underway. With a single command, the intelligent board assignment system of the bracket program allows an operator to assign all "available" boards (i.e., ones not being currently utilized), while respecting the board assignment guidelines for that particular event, and any others that are underway. The bracket operator has the option of "activating" the board assignments immediately, or setting them to a delay, to both enable additional editing (un-assigning or changing particular board assignments) and to manage when electronic board notifications are sent to the participants.

Another aspect of the intelligent board management system is that the event operator has the ability to designate which round of the tournament this function should be applied to when they run the command: Preliminary round, Round 1, Round 2, etc. For example, a youth event may be set up with an absolute board assignment for boards 1-4 (i.e., all the boards 1-4) for the duration of the youth event, which, for this example, begins sometime after the very start of the tournament and ends sometime before the very end of the tournament. These boards will not be listed in any operator's event board list, except for the list of the bracket operator running the youth event.

This same tournament may begin with a doubles event, for which the staff have set the board assignment guideline to "even numbered" dart alleys. Since the doubles event is the first event, there are no boards being utilized yet, the system automatically assigns matches to all available even numbered boards 5-50 in the initial round of competition, because boards 1-4 are not made available for assignment, having been assigned absolutely to the youth event.

In this same tournament, towards the end of the doubles event, but still during the youth event, a singles competition event begins, and it has a broader board assignment guideline of "all boards," which means that all boards that are available can be assigned. With a single command, all available even and odd boards (including ones that are available despite having been used in the doubles competition earlier) are assigned for the Prelim Round, and then repeated for Round 1 of the singles event with the exception of boards 1-4, which are still assigned to the youth event. For the remaining doubles matches, which are now fewer in number, only even numbered dart alleys continue to be recommended and available for the doubles bracket operator to schedule. Eventually the youth event ends, and the absolute board guideline for that event is retired, freeing up boards 1-4, for both the doubles and singles events, still respecting their event board guidelines.

Additional guidelines may be implemented at the tournament level or event level to properly assign boards based on tournament or event rules. For example, some tournaments have a rule that a player cannot play on the same board for two consecutive matches because it could potentially give that player an advantage over his or her opponent. In order to implement this rule, the intelligent board assignment system may track previously played boards and take those into account in addition to the other event board assignment guidelines.

In some embodiments, the intelligent board assignment system may have an option of placing a tournament in a full automation mode, rather than having bracket operators assign boards based on guidelines. Guidelines could instead be used to automatically assign everything from the initial board assignments to the final event match. The results from the scoring application would be used to automatically advance each winner through the bracket and create the board assignments based on bracket assignments.

Figure 32:
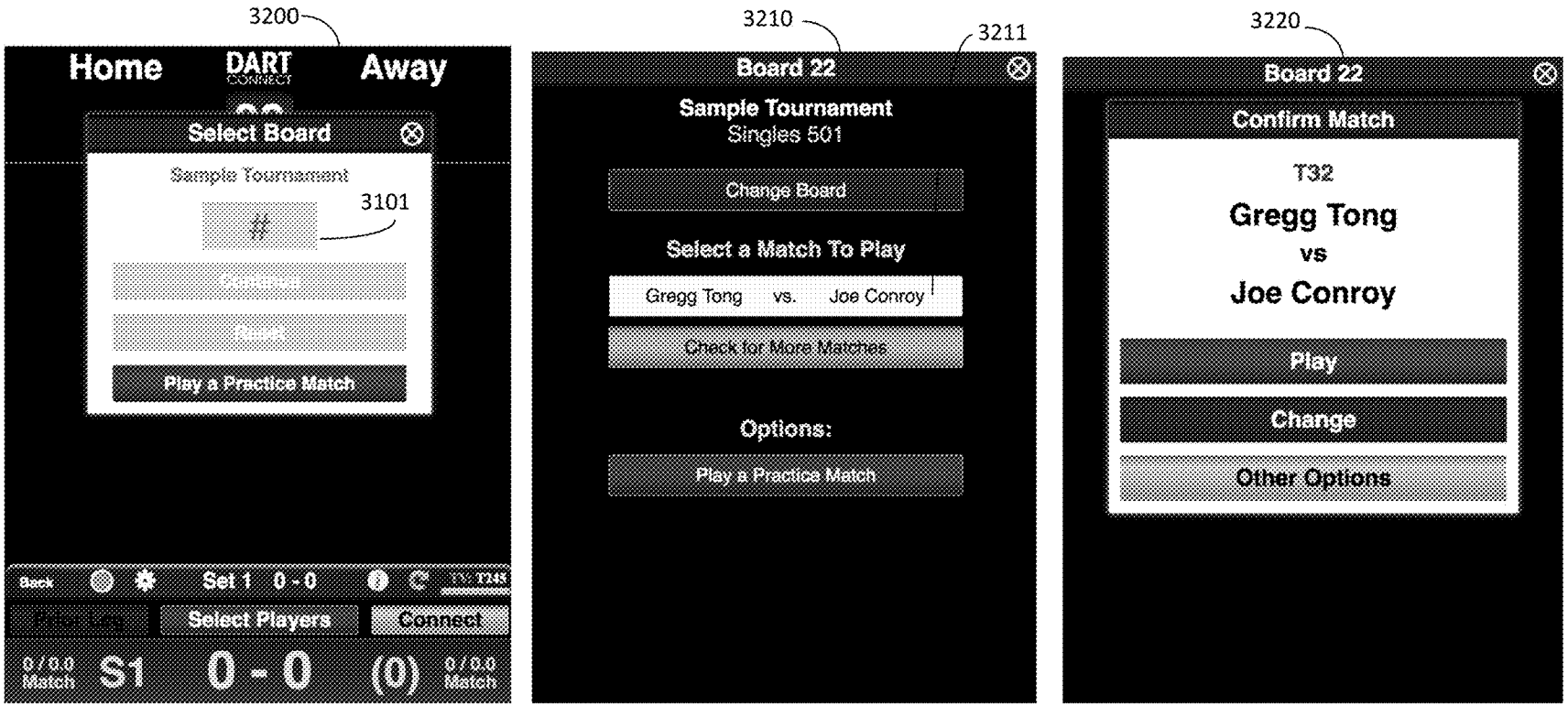
FIG. 32 depicts a board selection screen, a selectable match screen, and a match confirmation screen according to one embodiment of the invention.
Figure 34:
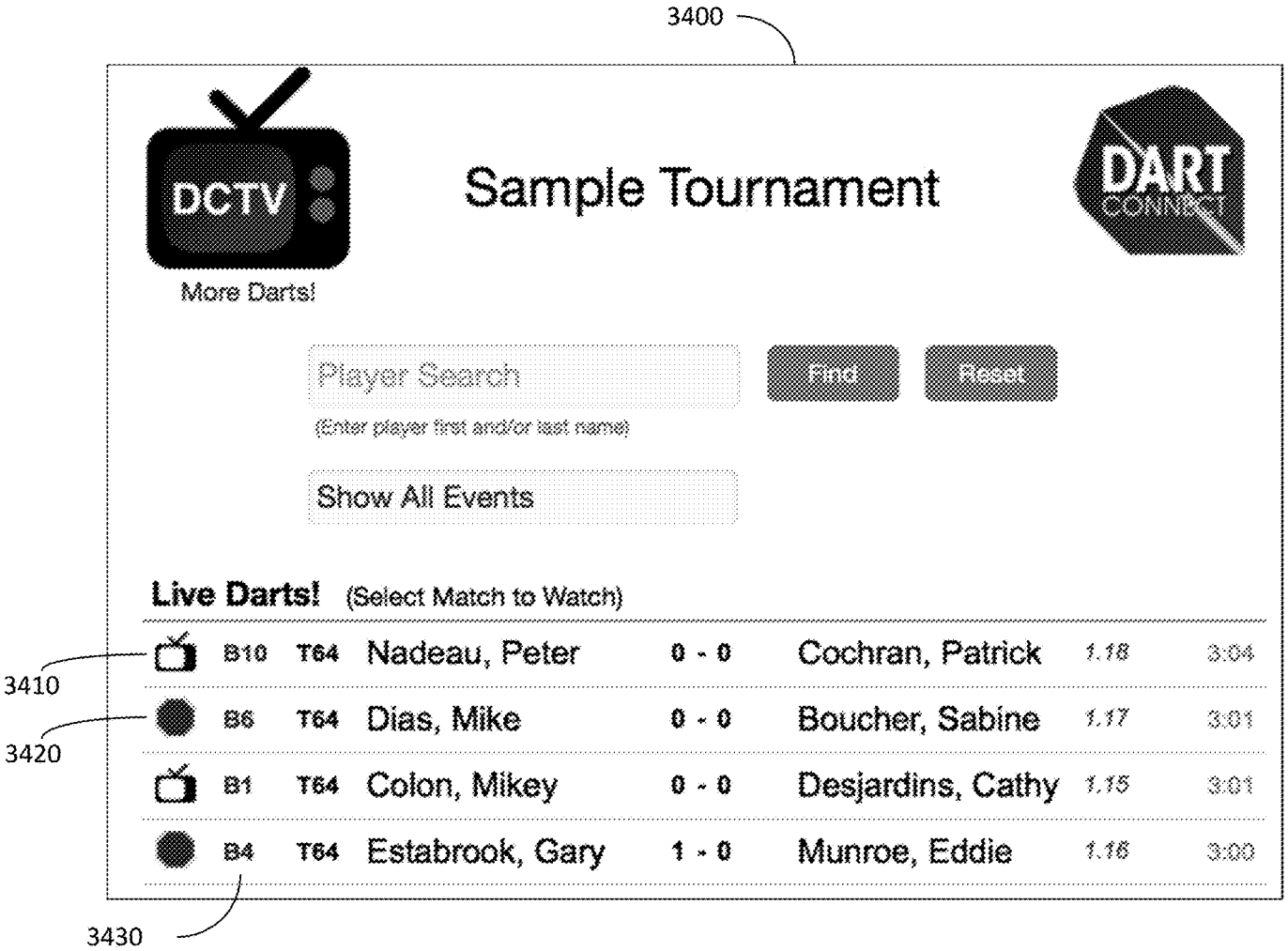
FIG. 34 depicts a tournament viewing screen according to one embodiment of the invention.

The overall integrated scoring system (or platform) may implement several permissions of restriction levels at the various interfaces of the system. In general, the scoring application is available to members (i.e., paid subscribers to the scoring application, whether participating in the current tournament or not) and tournament participants. The bracket operations, which may be implemented at the control desk 3040, are general only available to tournament staff. The dart game display system (e.g., on the remote broadcasting device 3060), is generally available to anyone who wants to watch, including tournament participants, staff, and spectators. The display system includes public access to tournament check-in, event registration confirmation (which allows viewing of registrations, but not the function of actually registering), fan alerts, board calls, and live match scores and statuses. The live scores and statuses are shown in FIG. 34, As part of the integration between the bracket program and the scoring application, scorers on devices associated with the tournament may enter a board assignment in a board entry field 3201, as shown in board selection screen 3200 of FIG. 32. Scorers may be players who self-score in some tournaments, or referees who score in other tournaments. Once a board assignment is entered, the scoring application presents only player match-ups that are assigned to that particular board. For example, in the match selection screen 3210, only one selectable match 3211 is presented for the scorer to select. In some embodiments, this selectable match is also presented based on the time and on previous matches that have been played. A "more options" button 3212 is also available, which may allow a scorer to view matches assigned to that particular board for future matches and alternate events. In some tournaments, multiple matches may be assigned to the same board at the same time, and the selectable match screen 3211 may present the matches in the recommended order of play to maximize efficiency. This selectable match screen 3211 is the result of filtering data at the cloud server application and/or the local scoring application. Without such filtering, scorers would have to manually check a master tournament list, and possibly a board assignment list and event list to confirm that the correct players are at the correct board. In large tournaments, the process of checking such lists can be time-consuming and error-prone, because they may have dozens or hundreds of entries. The selectable match screen 3210 presents only the correct possible matches for the selected board, reducing time and mistakes. Once a match is selected, a match confirmation screen 3220 may be shown.

Each of the pieces of data created by the cloud server application enables the tailoring of distinct match instructions for each event to be delivered to each device. This, in turn, allows the dart scoring application and cloud server to run multiple overlapping events simultaneously at each individual scoring device. That is, event staff and players do not need to intervene manually to change scoring application instructions every time the same device is used for a different event. For example, a single tournament may have both cricket and '01 events, and singles and doubles events. Some players may be participating in both simultaneously. Also, some dart alleys may be used for both events. The rules may differ greatly or slightly between events; no matter the degree of change, it can be difficult to keep track of such changes manually or even mentally. When a board assignment is entered into the board selection screen 3200, one of the matches on the match selection screen 3210 is selected, and the match is confirmed on a match confirmation screen 3220, the scoring application screens that will be presented to the scorer will automatically have the correct competition records and match rules for the match. This ensures that, when players show up to play at an assigned board at a particular time, neither the staff nor players have to worry about interpreting and implementing the match rules for each event, and do not have to go through a tedious process of selecting participants from the master tournament list.

Another aspect of the dart scoring system and integration with the bracket program is that match results may be reported in substantially real-time to the bracket program via the cloud server application and used to advance the winner. When the match is complete, the scoring application utilizes the API to return the competition record, appended with the match score, to the bracket program. The bracket program can then be set up in one of two ways. A first option is that an electronic notification appears in the bracket program, that the operator manually approves, releasing the board assignment, advancing the winning player and recording the match score. The second option is that the notification automatically performs these steps. The match result reporting feature allows tournaments to be run more efficiently and with fewer delays, because it eliminates the need to call in or physically walk scores over to a central control area where the bracket program is run. It also eliminates the need for waiting for advances and new board assignments from the bracket program to be communicated to a central viewing area or individual dart alleys. In any kind of tournament, bracket advances (whether done manually or electronically) are often displayed on some kind of whiteboard or paper on an easel. Since the bracket program itself is electronic, it may be displayed on a central screen, but finding an individual match or player on an entire displayed bracket can still be time-consuming in a big tournament. Sometimes, board assignments may be verbally broadcast over a PA system, but such announcements are easy to miss.

In the present integrated dart scoring system, bracket advances and new board assignments are communicated in real-time back to the scoring applications on individual devices. They are also communicated electronically to each player via e-mail, text message, and/or push notification. It is contemplated that many tournament participants may have the dart scoring application running on their own smartphones, whether they are self-scoring the tournament matches or not, because if they have the application on their smartphones and are logged into the tournament, they can receive a push notification immediately with a new board assignment. Players may want to have the application running on their smartphones for other purposes, including watching other match scores and bracket standings in the tournament. Other spectator features enabled by the integrated dart scoring system will be described later in this disclosure.

Figure 33:
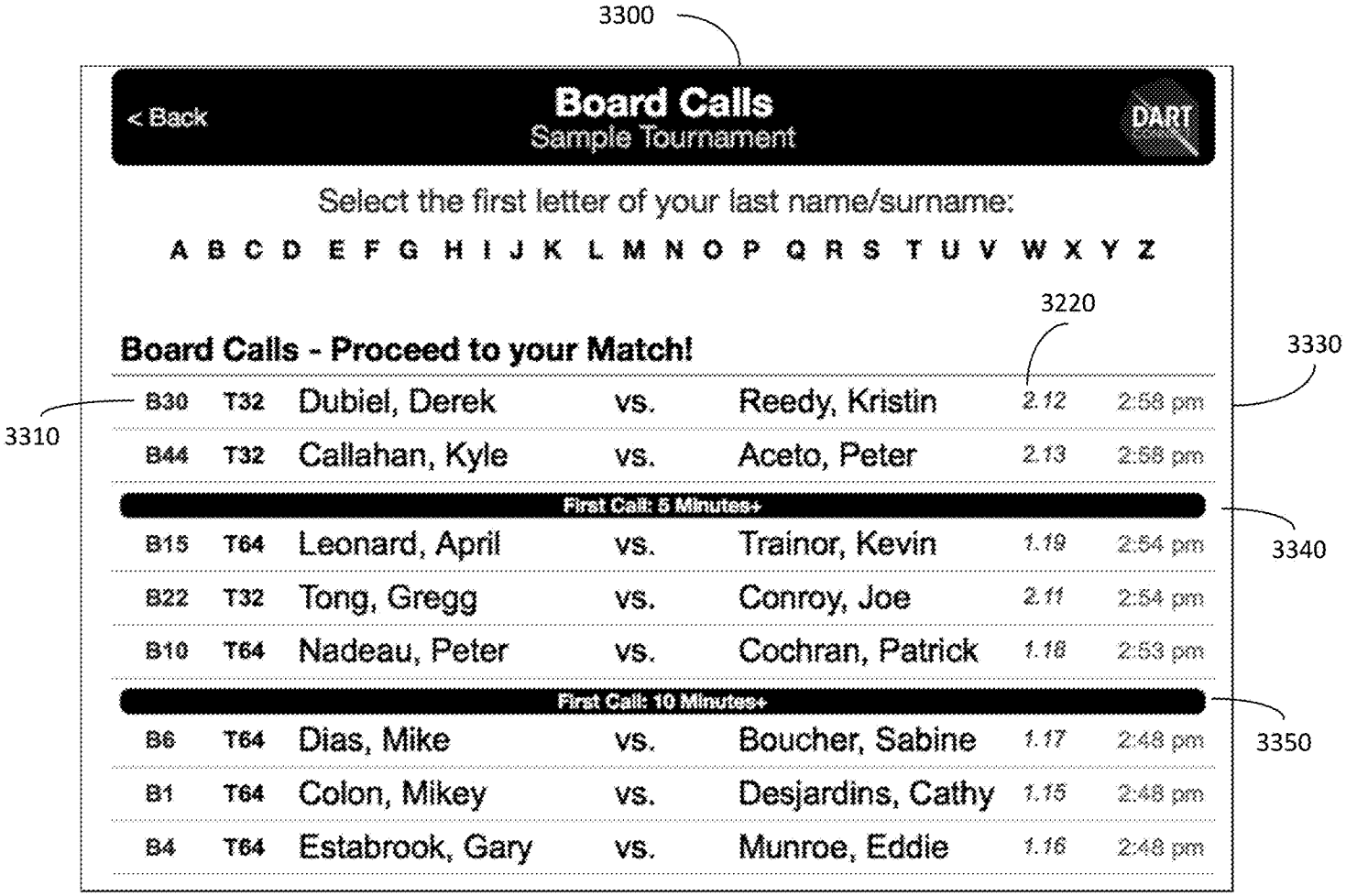
FIG. 33 depicts an aging board calls screen according to one embodiment of the invention.

Other features of the integrated dart scoring system are related to the automated match status reporting feature, and provide additional tournament efficiency benefits. A challenge for all tournament events is running on-time. In a traditional paper-based environment, the two most common obstacles are players not responding to their verbal board assignments, which delays the start times of scheduled matched, or failing to report the winning result, which delays the next match assignment. Some players who delay reporting winning results do so because they are playing in a high volume of matches, and they may purposefully delay reporting in order to pace themselves and have the matches be a bit more spread out. In the present system, the cloud server application automatically time stamps all board assignments, and groups them according their delayed status in 5-minute increments. As shown in FIG. 33, these delayed match starts may be displayed on an "aging board calls" screen 3300. This screen may be visible at a control desk interface of the integrated dart scoring system, and may only be accessible to tournament staff or officials. In other embodiments, it may be available to any user of the dart scoring application who is logged into the tournament. The aging board calls screen 3300 shows a list in which each line includes a board assignment 3310, a Match ID 3320, and a time-stamp of the board call 3330. Any board calls that have been time-stamped more than five minutes in the past and have not started a match are shown under a 5+ minutes line 3240 and any that have been time-stamped more than 10 minutes in the past are shown under a 10+ minutes line 3250. Other visual cues may be used to alert viewers that matches are running late. For example, matches that are more than 15 minutes late may be highlighted in or changed to red. This display is enabled by time-stamping bracket advances once they have occurred in the bracket program, sending out board calls to players contemporaneously, and transmitting this information to a computing device that displays the control desk interface. This display screen allows staff to police procrastinators and provide the documentation required to disqualify players who are delaying the tournament. Tournaments may have rules that disqualify players who are more than 10 minutes late to a board call, for example.

Some other problems can delay tournaments as well. For example, matches may become abandoned or not formally completed due to technical glitches such as devices freezing or running out of batteries, or any number of other unique circumstances. FIG. 34 shows a tournament viewing screen 3400 that may be available on a control desk screen or to any viewer watching the tournament through a viewing mode of the scoring application. If matches are abandoned, if they are not formally completed, or should the individual tablet become disconnected to the network, the cloud server application will replace a "live match" icon 3410 with a stop sign icon 3420 to alert tournament staff that a match or device needs to be investigated. With the board assignment provided in the match listing, staff can be dispatched to fix the device and/or complete the match, sending results back to the bracket program to free up the board and advance the bracket.

As discussed previously, there are several features throughout the integrated scoring system that prevent issues resulting from a loss of network connectivity. Even if the network fails during the competition, the tournament record (comprising the event list, along with the corresponding match instructions) and the master tournament players list is still stored locally at the mobile computing device, which creates a backup option to score a match. Players (or other scorers) can manually select the event and their participant records to create a match. The completed match will reside on the individual tablet until the connectivity is restored. When a connection is re-established, the scoring application will forward the completed match record(s) to the bracket program via the cloud server application. While the record will lack a match ID and board assignment, it will contain a tournament ID, event ID and player IDs, enabling the bracket operator to manually fill in this information and update the results as needed.

Figure 35:
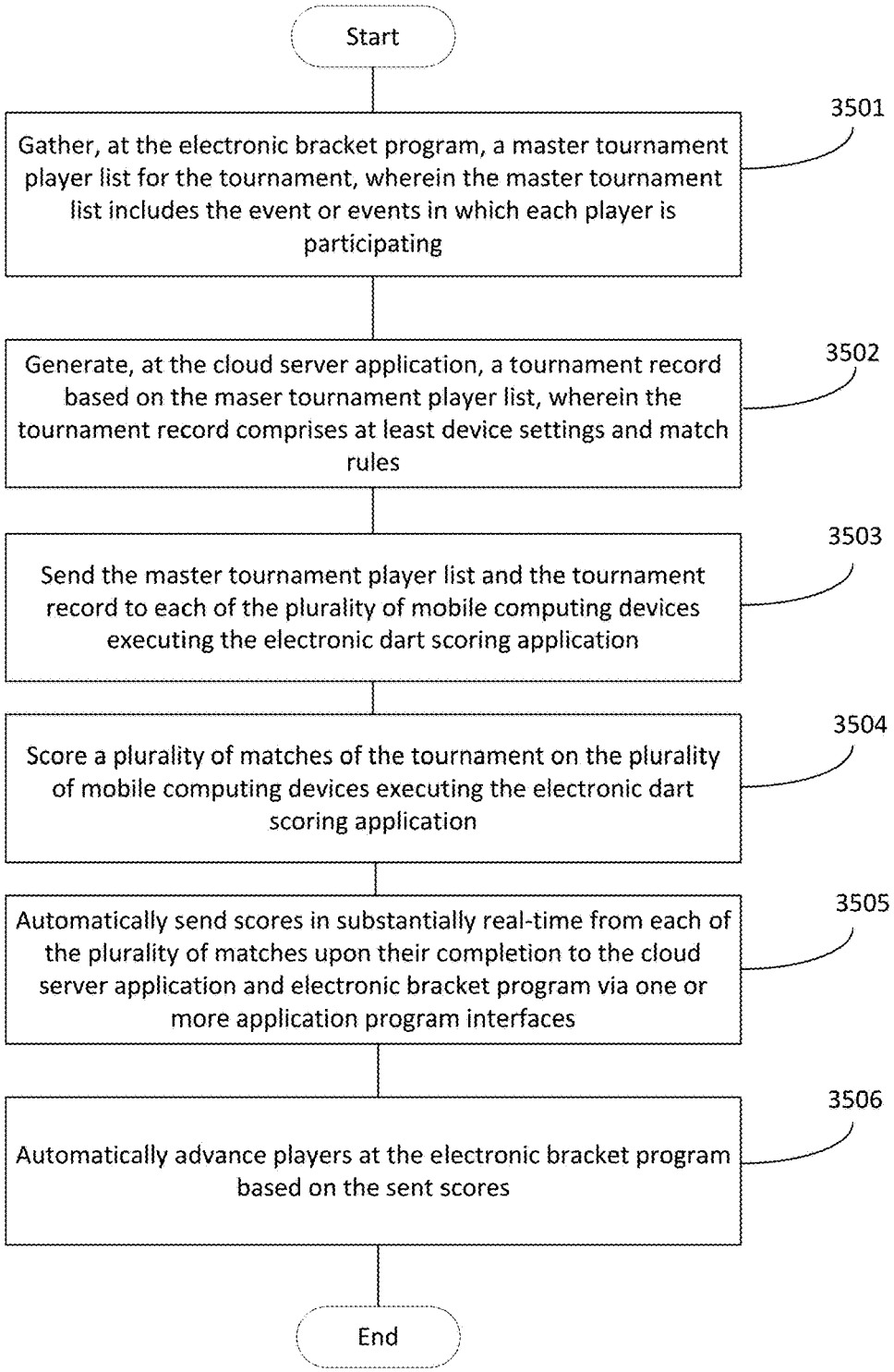
FIG. 35 depicts a method for implementing a tournament via an integrated dart scoring platform according to one embodiment of the invention.

FIG. 35 shows a method for facilitating a dart tournament using the integrated scoring system of the present disclosure. The method may be implemented by an electronic bracket program, a cloud server application, an electronic dart scoring application, and one or more application program interfaces by first, at 3501, gathering, at the electronic bracket program, a master tournament player list for the tournament, wherein the master tournament player list includes the event or events in which each player is participating. Then, the method may include, at 3502, generating, at the cloud server application, a tournament record based on the master tournament player list wherein the tournament record comprises at least device settings and match rules. The method may further comprise, at 3503, sending the master tournament player list and the tournament record to each of the plurality of mobile computing devices executing the electronic scoring dart application. At 3504, the method may comprise scoring a plurality of matches of the tournament on the plurality of mobile computing devices executing the electronic scoring dart application. Then at 3505, the method may include automatically sending scores in substantially real-time from each of the plurality of matches upon their completion to the cloud server application and electronic bracket program via the one or more application program interfaces; and at 3506, automatically advancing players at the electronic bracket program based on the sent scores.

Embodiments of the invention may further comprise a non-transitory, tangible, computer-readable storage medium, encoded with processor-readable instructions to perform a method of providing information related to a dart game. One non-transitory, tangible, computer-readable storage medium, encoded with processor-readable instructions may be described with reference to FIG. 28, below. One such method may comprise rendering a dart game scoring interface on a mobile computing device. One dart game scoring interface may comprise the various scoring interfaces and display screens shown in the figures and described herein. One such interface may display at least one current player score and at least one another player score. The method may further comprise ensuring that a dart score is entered correctly into the dart game scoring interface. For example, a color of the at least one current player score (the player currently entering scoring data) may be differentiated from the color of the at least one another player's score. Additionally, each entry to the scoring interface may be displayed in a scoring interface score window. Also, the method may comprise at least one of (i) displaying in an audit trail a sum of each previous entry entered into the score window, and (ii) displaying a number of times a user has selected a target. The method may also comprise sharing the dart game scoring interface with a plurality of additional mobile computing devices.

It is contemplated that a portion of the at least one current player score comprises mark notations, as described herein. Furthermore, target on the dart board may comprise one of an enabled target and a disabled target. This may occur in a cricket game. For example, prior to both or all players hitting the target three times, after a player hits the target three times (receives three mark notations—two slashes and a circle), that player may receive a numerical score for the target amount for any subsequent hits (i.e., "selected" on the user interface) prior to the other player or players hitting the target three times. During this period, the target is enabled. After all players have hit the target three times, the target is disabled and no points may be obtained for this target by any player. The user interface may also comprise a first scoring redundancy and a second scoring redundancy, to ensure scoring accuracy. One such first redundancy may comprise differentiating a color of the enabled target from the disabled target. A second redundancy may comprise: (i) accessing one sum in the audit trail, (ii) differentiating the color of the accessed sum from each other sum, and (iii) displaying in the score window each previous entry related to the accessed sum.

The non-transitory tangible computer-readable storage medium method may further comprise requesting an event key, also referred to herein as a code or a password, or any other term known in the art. The event key may then be distributed to another computing device and then a dart game scoring interface may be received by another computing device, as well as displaying score information on the interface. Such scoring information may be related to one or more forthcoming player dart throws for a next round. Such scoring information may be provided before or after the player has thrown at least one dart for the round. A fade-out display message may also provide information related to one or more recent dart throws to the plurality of additional mobile computing devices.

It is contemplated that ensuring that a dart score is entered correctly into the dart game scoring interface further comprises providing a series of selectable features that automatically enter a score related to a dart throw, decreasing a number of selections required to enter the score as compared to the number of selections required not using the series of selectable features, and calculating statistics related to the selectable features.

The systems and methods described herein can be implemented in a computer system in addition to the specific physical devices described herein. Referring back to FIG. 28, shown is a diagrammatic representation of one embodiment of a computer system 2800 within which a set of instructions can execute for causing a device to perform or execute any one or more of the aspects and/or methodologies of the present disclosure. A computer comprising the any of the devices disclosed with reference to FIGS. 1 and 30, such as, but not limited to, the scoreboard 112 device, the cloud server application 3030, the API 3020, and the bracket program 3010 are examples of some implementations of the computer system 2800. The components in FIG. 28 are examples only and do not limit the scope of use or functionality of any hardware, software, firmware, embedded logic component, or a combination of two or more such components implementing particular embodiments of this disclosure. Some or all of the illustrated components can be part of the computer system 2800. For instance, the computer system 2800 can be a general purpose computer (e.g., a laptop computer) or an embedded logic device (e.g., an FPGA), to name just two non-limiting examples.

Computer system 2800 includes at least a processor 2801 such as a central processing unit (CPU) or an FPGA to name two non-limiting examples. Any of the subsystems described throughout this disclosure could embody the processor 2801. The computer system 2800 may also comprise a memory 2803 and a storage 2808, both communicating with each other, and with other components, via a bus 2840. The bus 2840 may also link a display 2832, one or more input devices 2833 (which may, for example, include a keypad, a keyboard, a mouse, a stylus, etc.), one or more output devices 2834, one or more storage devices 2835, and various non-transitory, tangible computer-readable storage media 2836 with each other and with one or more of the processor 2801, the memory 2803, and the storage 2808. All of these elements may interface directly or via one or more interfaces or adaptors to the bus 2840. For instance, the various non-transitory, tangible computer-readable storage media 2836 can interface with the bus 2840 via storage medium interface 2826. Computer system 2800 may have any suitable physical form, including but not limited to one or more integrated circuits (ICs), printed circuit boards (PCBs), mobile handheld devices (such as mobile telephones or PDAs), laptop or notebook computers, distributed computer systems, computing grids, or servers.

Processor(s) 2801 (or central processing unit(s) (CPU(s))) optionally contains a cache memory unit 2802 for temporary local storage of instructions, data, or computer addresses. Processor(s) 2801 are configured to assist in execution of computer-readable instructions stored on at least one non-transitory, tangible computer-readable storage medium. Computer system 2800 may provide functionality as a result of the processor(s) 2801 executing software embodied in one or more non-transitory, tangible computer-readable storage media, such as memory 2803, storage 2808, storage devices 2835, and/or storage medium 2836 (e.g., read only memory (ROM)). For instance, the methods 2929 in FIG. 29 may be embodied in one or more non-transitory, tangible computer-readable storage media. The non-transitory, tangible computer-readable storage media may store software that implements particular embodiments, such as the method 2929 and processor(s) 2801 may execute the software. Memory 2803 may read the software from one or more other non-transitory, tangible computer-readable storage media (such as mass storage device(s) 2835, 2836) or from one or more other sources through a suitable interface, such as network interface 2820. Any of the subsystems herein disclosed could include a network interface such as the network interface 2820. The software may cause processor(s) 2801 to carry out one or more processes or one or more steps of one or more processes described or illustrated herein. Carrying out such processes or steps may include defining data structures stored in memory 2803 and modifying the data structures as directed by the software. In some embodiments, an FPGA can store instructions for carrying out functionality as described in this disclosure (e.g., the method 2929). In other embodiments, firmware includes instructions for carrying out functionality as described in this disclosure (e.g., the method 2929).

The memory 2803 may include various components (e.g., non-transitory, tangible computer-readable storage media) including, but not limited to, a random access memory component (e.g., RAM 2804) (e.g., a static RAM "SRAM", a dynamic RAM "DRAM, etc.), a read-only component (e.g., ROM 2805), and any combinations thereof. ROM 2805 may act to communicate data and instructions unidirectionally to processor(s) 2801, and RAM 2804 may act to communicate data and instructions bidirectionally with processor(s) 2801. ROM 2805 and RAM 2804 may include any suitable non-transitory, tangible computer-readable storage media. In some instances, ROM 2805 and RAM 2804 include non-transitory, tangible computer-readable storage media for carrying out the method 2929. In one example, a basic input/output system 2806 (BIOS), including basic routines that help to transfer information between elements within computer system 2800, such as during start-up, may be stored in the memory 2803.

Fixed storage 2808 is connected bidirectionally to processor(s) 2801, optionally through storage control unit 2807. Fixed storage 2808 provides additional data storage capacity and may also include any suitable non-transitory, tangible computer-readable media described herein. Storage 2808 may be used to store operating system 2809, EXECs 2810 (executables), data 2811, API applications 2812 (application programs), and the like. Often, although not always, storage 2808 is a secondary storage medium (such as a hard disk) that is slower than primary storage (e.g., memory 2803). Storage 2808 can also include an optical disk drive, a solid-state memory device (e.g., flash-based systems), or a combination of any of the above. Information in storage 2808 may, in appropriate cases, be incorporated as virtual memory in memory 2803.

In one example, storage device(s) 2835 may be removably interfaced with computer system 2800 (e.g., via an external port connector (not shown)) via a storage device interface 2825. Particularly, storage device(s) 2835 and an associated machine-readable medium may provide nonvolatile and/or volatile storage of machine-readable instructions, data structures, program modules, and/or other data for the computer system 2800. In one example, software may reside, completely or partially, within a machine-readable medium on storage device(s) 2835. In another example, software may reside, completely or partially, within processor(s) 2801.

Bus 2840 connects a wide variety of subsystems. Herein, reference to a bus may encompass one or more digital signal lines serving a common function, where appropriate. Bus 2840 may be any of several types of bus structures including, but not limited to, a memory bus, a memory controller, a peripheral bus, a local bus, and any combinations thereof, using any of a variety of bus architectures. As an example, and not by way of limitation, such architectures include an Industry Standard Architecture (ISA) bus, an Enhanced ISA (EISA) bus, a Micro Channel Architecture (MCA) bus, a Video Electronics Standards Association local bus (VLB), a Peripheral Component Interconnect (PCI) bus, a PCI-Express (PCI-X) bus, an Accelerated Graphics Port (AGP) bus, HyperTransport (HTX) bus, serial advanced technology attachment (SATA) bus, and any combinations thereof.

Computer system 2800 may also include an input device 2833. In one example, a user of computer system 2800 may enter commands and/or other information into computer system 2800 via input device(s) 2833. Examples of an input device(s) 2833 include, but are not limited to, an alphanumeric input device (e.g., a keyboard), a pointing device (e.g., a mouse or touchpad), a touchpad, a joystick, a gamepad, an audio input device (e.g., a microphone, a voice response system, etc.), an optical scanner, a video or still image capture device (e.g., a camera), and any combinations thereof. Input device(s) 2833 may be interfaced to bus 2840 via any of a variety of input interfaces 2823 (e.g., input interface 2823) including, but not limited to, serial, parallel, game port, USB, FIREWIRE, THUNDERBOLT, or any combination of the above.

In particular embodiments, when computer system 2800 is connected to network 2830, computer system 2800 may communicate with other devices, such as mobile devices and enterprise systems, connected to network 2830. Communications to and from computer system 2800 may be sent through network interface 2820. For example, network interface 2820 may receive incoming communications (such as requests or responses from other devices) in the form of one or more packets (such as Internet Protocol (IP) packets) from network 2830, and computer system 2800 may store the incoming communications in memory 2803 for processing. Computer system 2800 may similarly store outgoing communications (such as requests or responses to other devices) in the form of one or more packets in memory 2803 and communicated to network 2830 from network interface 2820. Processor(s) 2801 may access these communication packets stored in memory 2803 for processing.

Examples of the network interface 2820 include, but are not limited to, a network interface card, a modem, and any combination thereof. Examples of a network 2830 or network segment 2830 include, but are not limited to, a wide area network (WAN) (e.g., the Internet, an enterprise network), a local area network (LAN) (e.g., a network associated with an office, a building, a campus or other relatively small geographic space), a telephone network, a direct connection between two computing devices, and any combinations thereof. A network, such as network 2830, may employ a wired and/or a wireless mode of communication. In general, any network topology may be used.

Information and data can be displayed through a display 2832. Examples of a display 2832 include, but are not limited to, a liquid crystal display (LCD), an organic liquid crystal display (OLED), a cathode ray tube (CRT), a plasma display, and any combinations thereof. The display 2832 can interface to the processor(s) 2801, memory 2803, and fixed storage 2808, as well as other devices, such as input device(s) 2833, via the bus 2840. The display 2832 is linked to the bus 2840 via a video interface 2822, and transport of data between the display 2832 and the bus 2840 can be controlled via the graphics control 2821.

In addition to a display 2832, computer system 2800 may include one or more other peripheral output devices 2834 including, but not limited to, an audio speaker, a printer, and any combinations thereof. Such peripheral output devices may be connected to the bus 2840 via an output interface 2824. Examples of an output interface 2824 include, but are not limited to, a serial port, a parallel connection, a USB port, a FIREWIRE port, a THUNDERBOLT port, and any combinations thereof.

In addition, or as an alternative, computer system 2800 may provide functionality as a result of logic hardwired or otherwise embodied in a circuit, which may operate in place of or together with software to execute one or more processes or one or more steps of one or more processes described or illustrated herein. Reference to software in this disclosure may encompass logic, and reference to logic may encompass software. Moreover, reference to a non-transitory, tangible computer-readable medium may encompass a circuit (such as an IC) storing software for execution, a circuit embodying logic for execution, or both, where appropriate. The present disclosure encompasses any suitable combination of hardware, software, or both.

Those of skill in the art will understand that information and signals may be represented using any of a variety of different technologies and techniques. Those of skill will further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein (e.g., the method 2929) may be embodied directly in hardware, in a software module executed by a processor, a software module implemented as digital logic devices, or in a combination of these. A software module may reside in RAM memory, flash memory, ROM memory, EPROM memory, EEPROM memory, registers, hard disk, a removable disk, a CD-ROM, or any other form of non-transitory, tangible computer-readable storage medium known in the art. An exemplary non-transitory, tangible computer-readable storage medium is coupled to the processor such that the processor can read information from, and write information to, the non-transitory, tangible computer-readable storage medium. In the alternative, the non-transitory, tangible computer-readable storage medium may be integral to the processor. The processor and the non-transitory, tangible computer-readable storage medium may reside in an ASIC. The ASIC may reside in a user terminal. In the alternative, the processor and the non-transitory, tangible computer-readable storage medium may reside as discrete components in a user terminal. In some embodiments, a software module may be implemented as digital logic components such as those in an FPGA once programmed with the software module.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. An integrated dart scoring platform comprising:
an electronic bracket program,
a cloud server application,
an electronic dart scoring application, and
one or more application program interfaces,
wherein the platform is configured to facilitate a dart tournament scored on a plurality of mobile computing devices executing the electronic dart scoring application by:
gathering, at the electronic bracket program, a master tournament player list for the tournament, wherein,
the master tournament player list includes an event in which each player is participating, and
the event comprises one of a plurality of competition types within the tournament;
generating, at the cloud server application, a tournament record based on the master tournament player list, wherein the tournament record comprises:
device settings, the device settings enabling one or more features of the electronic dart scoring application, and
match rules, the match rules comprising at least one of,
match format type,
match legs type,
game type, and
player start format type;
sending the master tournament player list and the tournament record to each of the plurality of mobile computing devices executing the electronic dart scoring application;
scoring a plurality of matches of the tournament on the plurality of mobile computing devices executing the electronic dart scoring application;
automatically sending one or more scores in substantially real-time from each of the plurality of matches upon their completion to the cloud server application and electronic bracket program via the one or more application program interfaces; and
automatically advancing players at the electronic bracket program based on the sent scores.

2. The integrated dart scoring platform of claim 1, wherein,
the event comprises a plurality of events;
at least one player in the master tournament player list is associated with at least two of the plurality of events; and
the platform is further configured to facilitate the dart tournament by broadcasting, at one or more broadcasting devices,
one or more of the scores,
one or more brackets showing a plurality of players scheduled to play in the dart tournament, and
current tournament standings of at least some of the plurality of players.

3. The integrated dart scoring platform of claim 2, wherein the platform is further configured to facilitate the dart tournament by broadcasting the one or more of the scores for matches in progress in substantially real-time.

4. The integrated dart scoring platform of claim 2, wherein the plurality of events comprise at least two of,
a mens's only event;
a women's only event;
a cricket event;
an '01 event;
a singles event; and
a doubles event.

5. The integrated dart scoring platform of claim 1, wherein the platform is further configured to facilitate the dart tournament by:
generating a complete player roster for at least one event of the dart tournament, and
creating an event ID associated with the at least one event.

6. The integrated dart scoring platform of claim 1, wherein the platform is further configured to facilitate the dart tournament by automatically creating, through the electronic bracket program, initial matchups of players for the plurality of matches.

7. The integrated dart scoring platform of claim 6, wherein,
the platform associates a Tournament ID with the tournament;
the event comprises more than one event, each of the more than one event comprising,
a different subset competition type, and
an Event ID;
each of the plurality of matches comprise a Match ID;
each player is associated with a Player ID; and
board assignments for the initial matchups across each of the more than one event are provided by,
electronically notifying players of their board assignments, and
displaying the board assignment on an electronic display.

8. The integrated dart scoring platform of claim 7, wherein,
each of the more than one event comprises more than one round;
the initial matchups comprise matchups in a first of the more than one round;
the platform comprises board assignment guidelines;
the board assignment guidelines limit each of the more than one round to an identified board or group of boards; and
the board assignment guidelines are used to continually assign open board for subsequent matches between advancing players.

9. The integrated dart scoring platform of claim 7, wherein, continually assigning open boards for subsequent matches between advancing players comprises assigning multiple boards at the same time.

10. The integrated dart scoring platform of claim 1, wherein,
the platform further comprises a bracket operator application executed on a computing device; and
the platform is further configured to facilitate the dart tournament by displaying, on a dashboard on the bracket operator application, one or more of:
dashboard indicators for bracket operator calls to action, and
a list view of a bracket and an associated bracket operator action list.

11. The integrated dart scoring platform of claim 10, wherein the platform is further configured to facilitate the dart tournament by printing, via the bracket operator application, physical board call slips having:
assigned event partners;
assigned opponents; and
assigned boards for matches between the opponents.

12. The integrated dart scoring platform of claim 11, wherein the platform is further configured to facilitate the dart tournament by printing the physical board call slips in a chronological call order.

13. The integrated dart scoring platform of claim 1, wherein the tournament record further comprises each of:
a tournament ID;
event data;
an event format; and
match instructions.

14. The integrated dart scoring platform of claim 1, wherein,
the platform is further configured to facilitate the dart tournament by displaying, on the electronic dart scoring applications, scoring functions that are accessible or inaccessible to a scorer based on the match rules for a particular match within the tournament; and
the match rules are received at one or more of the mobile computing devices executing the electronic dart scoring application from the tournament record generated by the cloud server application.

15. The integrated dart scoring platform of claim 1, wherein the platform is further configured to facilitate the dart tournament by:
receiving, from the cloud server application, at one or more of any computing device executing an application implementing at least a portion of the platform, a copy of the tournament record and the master tournament player list, and
storing the copy of the tournament record and the master tournament player list locally.

16. The integrated dart scoring platform of claim 1, wherein the platform is further configured to facilitate the dart tournament by automatically creating board assignments for available boards while the dart tournament is in progress based on board assignment rules set by a bracket operator.

17. The integrated dart scoring platform of claim 16, wherein the platform is further configured to facilitate the dart tournament by sending electronic notifications of board assignments to players.

18. The integrated dart scoring platform of claim 16, wherein the platform is further configured to facilitate the dart tournament by automatically creating board assignments for all matches of the tournament based on the advancing of players through the bracket by the electronic bracket program.

19. The integrated dart scoring platform of claim 1, wherein the platform is further configured to facilitate the dart tournament by:
providing an entry field on the electronic dart scoring application for a board assignment, and
presenting, to a scorer, only player match-ups that correspond to the board assignment.

20. The integrated dart scoring platform of claim 1, wherein the platform is further configured to facilitate the dart tournament by:
time-stamping any board assignment upon creation; and
displaying, on one or more of any computing device executing an application implementing at least a portion of the platform, any board assignments for which a predetermined time period has passed and a match has not begun to be scored.

21. The integrated dart scoring platform of claim 1, wherein the platform is further configured to facilitate the dart tournament by:

storing, if network connectivity between one or more of the mobile computing devices executing the electronic dart scoring application and the cloud server application is interrupted, one or more of the scores locally on the one or more of the mobile computing devices, and sending the one or more of the scores once network connectivity is restored.

22. The integrated dart scoring platform of claim 21, wherein the platform is further configured to facilitate the dart tournament by attaching a match record to the one or more of the scores, the match record comprising at least a tournament ID, an event ID, and player IDs.

* * * * *